US009644362B2

(12) United States Patent
Nakamura et al.

(10) Patent No.: US 9,644,362 B2
(45) Date of Patent: May 9, 2017

(54) URINAL WITH SANITATION DEVICE

(71) Applicant: TOTO LTD., Fukuoka (JP)

(72) Inventors: Yusuke Nakamura, Kitakyushu (JP); Yusuke Araki, Kitakyushu (JP); Koichi Toyoda, Kitakyushu (JP); Aiko Itami, Kitakyushu (JP); Masahiro Yamamoto, Kitakyushu (JP); Akemi Takeshita, Kitakyushu (JP); Hiroyuki Kameshige, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 277 days.

(21) Appl. No.: 14/198,337

(22) Filed: Mar. 5, 2014

(65) Prior Publication Data

US 2014/0352048 A1 Dec. 4, 2014

(30) Foreign Application Priority Data

Mar. 6, 2013 (JP) ..... 2013-044760

(51) Int. Cl.

| | |
|---|---|
| ***E03D 13/00*** | (2006.01) |
| ***E03D 1/00*** | (2006.01) |
| ***E03D 5/10*** | (2006.01) |
| ***E03D 9/00*** | (2006.01) |
| ***E03D 9/02*** | (2006.01) |
| ***E03D 9/03*** | (2006.01) |

(52) U.S. Cl.

CPC ..... *E03D 13/005* (2013.01); *E03D 5/105* (2013.01); *E03D 9/002* (2013.01); *E03D 9/005* (2013.01); *E03D 9/02* (2013.01); *E03D 9/032* (2013.01); *E03D 13/00* (2013.01); *E03D 13/007* (2013.01)

(58) Field of Classification Search

CPC ..... E03D 13/005; E03D 5/10
USPC ..... 4/309, 302
See application file for complete search history.

(56) References Cited

U.S. PATENT DOCUMENTS

| | | | | |
|---|---|---|---|---|
| 2005/0229297 | A1 | 10/2005 | Higgins | |
| 2005/0247342 | A1 | 11/2005 | Higgins | |
| 2010/0031430 | A1 * | 2/2010 | Chang | E03D 5/10 4/302 |

FOREIGN PATENT DOCUMENTS

| | | | | |
|---|---|---|---|---|
| EP | 0597286 | A1 | | 5/1994 |
| JP | H01-284628 | A | | 11/1989 |
| JP | H03-183832 | A | | 8/1991 |
| JP | 09-021164 | A | * | 9/1997 |
| JP | H10-237923 | A | | 9/1998 |
| JP | 2005-299092 | A | | 10/2005 |
| JP | 2006-009556 | A | | 1/2006 |
| JP | 2007-518005 | A | | 7/2007 |
| WO | 2005/071173 | A1 | | 8/2005 |

OTHER PUBLICATIONS

English machine translation of EP 0597286 A1 dated Mar. 24, 2016.*

(Continued)

*Primary Examiner* — Christine Skubinna
(74) *Attorney, Agent, or Firm* — Studebaker & Brackett PC

(57) ABSTRACT

A urinal with a sanitation device capable of preventing the generation of a smell and urine scale with reliability without reducing a water conservation effect. In the urinal US, a liquid agent is ejected in different modes by predetermined timing according to areas on the urinal US.

9 Claims, 31 Drawing Sheets

(56) References Cited

OTHER PUBLICATIONS

Machine English translation of JP 09-021164 A dated Sep. 8, 2016.*
The extended European search report issued by the European Patent Office on Jun. 6, 2014, which corresponds to European Patent Application No. 14158021.7-1608 and is related to U.S. Appl. No. 14/198,337.

* cited by examiner

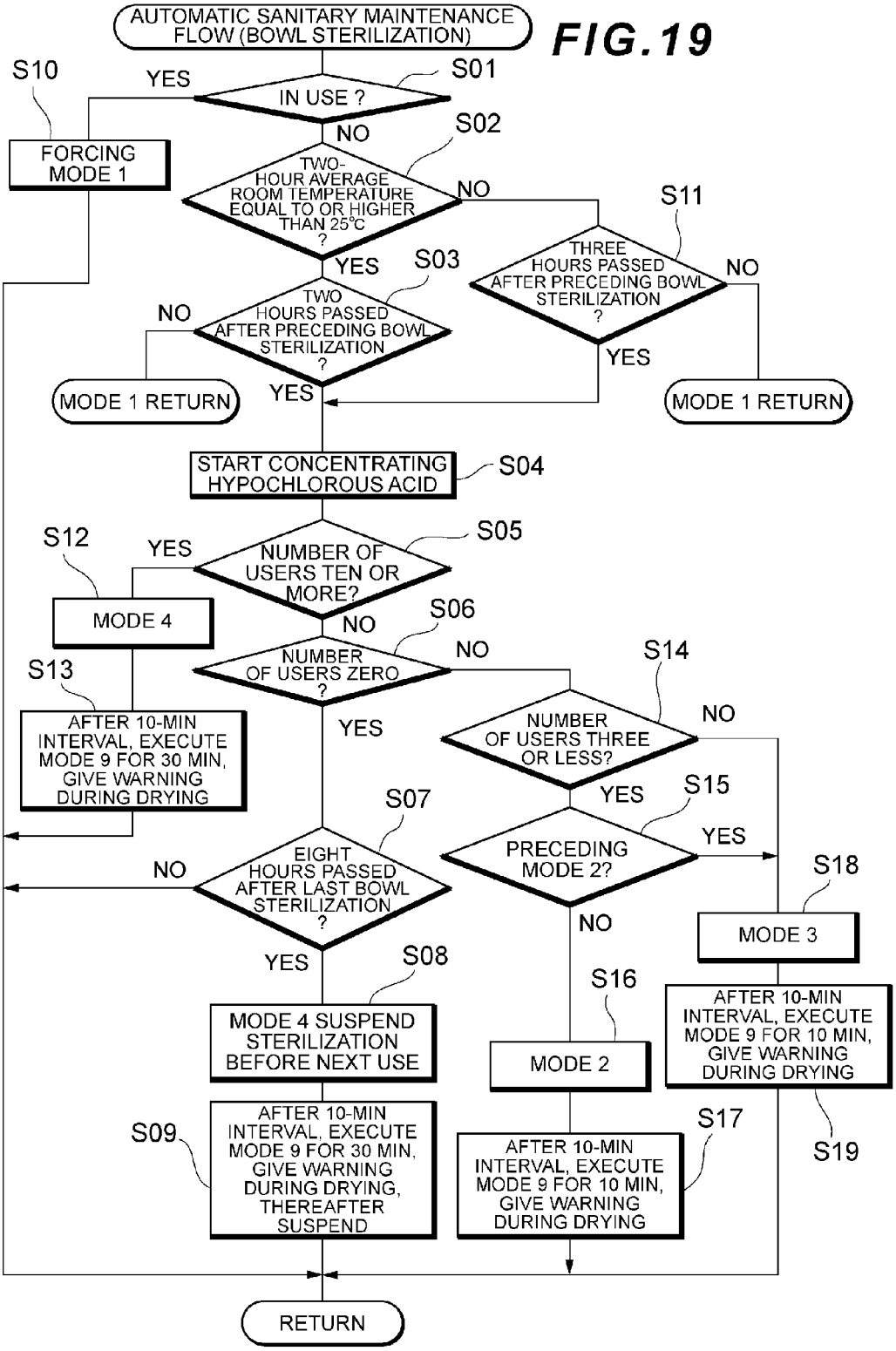
AUTOMATIC SANITARY MAINTENANCE FLOW (BOWL STERILIZATION)
FIG.19
S01
IN USE ?
YES
NO
S10
FORCING MODE 1
S02
TWO-HOUR AVERAGE ROOM TEMPERATURE EQUAL TO OR HIGHER THAN 25°C ?
NO
YES
S11
THREE HOURS PASSED AFTER PRECEDING BOWL STERILIZATION ?
NO
YES
S03
TWO HOURS PASSED AFTER PRECEDING BOWL STERILIZATION ?
NO
YES
MODE 1 RETURN
MODE 1 RETURN
START CONCENTRATING HYPOCHLOROUS ACID
S04
S05
NUMBER OF USERS TEN OR MORE?
YES
NO
S12
MODE 4
S06
NUMBER OF USERS ZERO ?
NO
YES
S13
AFTER 10-MIN INTERVAL, EXECUTE MODE 9 FOR 30 MIN, GIVE WARNING DURING DRYING
S14
NUMBER OF USERS THREE OR LESS?
NO
YES
S15
PRECEDING MODE 2?
YES
NO
S07
EIGHT HOURS PASSED AFTER LAST BOWL STERILIZATION ?
NO
YES
S08
MODE 4 SUSPEND STERILIZATION BEFORE NEXT USE
S09
AFTER 10-MIN INTERVAL, EXECUTE MODE 9 FOR 30 MIN, GIVE WARNING DURING DRYING, THEREAFTER SUSPEND
S16
MODE 2
S17
AFTER 10-MIN INTERVAL, EXECUTE MODE 9 FOR 10 MIN, GIVE WARNING DURING DRYING
S18
MODE 3
AFTER 10-MIN INTERVAL, EXECUTE MODE 9 FOR 10 MIN, GIVE WARNING DURING DRYING
S19
RETURN

URINAL WITH SANITATION DEVICE

BACKGROUND OF THE INVENTION

Field of the Invention

The present invention relates to a urinal with a sanitation device in which the whole of a trap unit having a water seal formed by urine or component parts constituting the trap unit are interchangeable, and in which a sanitary condition is maintained by using a chemical agent.

Description of the Related Art

Flush urinals in which a sanitary condition is maintained by supplying water each time after use have come into wide use. Human urine contains various bacteria. If urine remains in the bowl of a urinal and other portions after use, various bacteria in the urine multiply increasingly with passage of time and produce ammonia by decomposing urea in the urine, thereby generating an ammonia smell and urine scale (solid matters such as calcium phosphate and magnesium phosphate derived from constituents of urine). In an ordinary flush urinal, therefore, water is delivered into the bowl of the urinal to flush away urine remaining in the bowl.

In this conventional flush urinal, water is delivered into the bowl and caused to flow into a trap connected to the bowl downstream of the same and replace urine retained in the trap, thereby discharging the urine. Further, urine remaining in a drain tube connected downstream of the trap is flushed away with water supplied from the bowl through the trap. Thereafter, delivery of water is stopped, with the trap filled with water. In this way, urine remaining in the bowl and other portions is flushed away before various bacteria in the urine multiply largely, thereby inhibiting the production of ammonia and urine scale and preventing the generation of a smell and clogging of the drain tube with urine scale. Water filling the trap functions as a water seal to prevent a backflow of a smell from the drain tube. After flushing, only water exists in the trap. Therefore, even when the water seal in the trap evaporates and diffuses in the toilet room where the urinal is installed, the evaporated constituents do not act as a cause of a smell.

Under circumstances as a result of the increase of environmental consciousness in recent years, a high level of water conservation performance is required of facilities and appliances using water. This is also the case with urinals. In flush urinals such as described above, however, flushing urine in the bowl, replacement and discharge of urine in the trap and flushing of urine in the drain tube are performed by delivering water one time into the bowl. A comparatively large amount of water is needed to perform those operations with reliability. From the viewpoint of water conservation, therefore, there is a demand for further reducing the amount of water to be used.

A non-flush urinal is known which has a trap such as described in National Publication of International Patent Application No. 2007-518005, and which is an example of a urinal designed to meet a water conservation requirement. In an ordinary flush urinal, water is supplied each time after use and water retained in a trap is used as a water seal. In the non-flush urinal having the trap described in National Publication of International Patent Application No. 2007-518005, supply of water after use is not performed in principle; urine retained in the trap is used as a water seal.

In the case where urine retained in the trap is used as a water seal, there is an apprehension that ammonia in the urine evaporates and diffuses in the toilet room to generate a smell, and that urine scale is generated in the trap. To solve this apprehended problem, a chemical agent is used in the trap described in National Publication of International Patent Application No. 2007-518005. A chemical agent such as citric acid is disposed at such a position as to contact urine flowing into the trap, and a part of the chemical agent dissolved by contact with the urine flows into the trap together with the urine. The trap described in National Publication of International Patent Application No. 2007-518005 is designed to supply a chemical agent into the trap by utilizing urine from a user in order to inhibit multiplication of various bacteria in urine retained in the trap and prevent generation of a smell and urine scale.

This trap is of such a construction (cartridge) as to be provided at a low cost and interchangeable. Therefore, the trap may be replaced with a new one to enable continued use of the urinal, for example, in a situation where the above-described chemical agent disappears during use of the urinal; the generation of urine scale in the trap progresses; and the performance in discharging urine from the trap becomes lower.

In a case where a chemical agent is supplied into a trap by utilizing urine from a user, as in the trap-interchange-type urinal described in National Publication of International Patent Application No. 2007-518005, however, stoppage of supply of the chemical agent into the trap occurs, for example, during a time period at a weekend during which the frequency of use is low, as in a case where the urinal is installed in a toilet room in an office building. In such a case, multiplication of various bacteria in the retained urine is not inhibited; the production of ammonia progresses over the weekend; and a smell is generated at the beginning of the next week.

In the trap-interchange-type urinal described in National Publication of International Patent Application No. 2007-518005, urine remains in the bowl since water is not supplied. The urinal described therein is incapable of coping with the generation of a smell and urine scale generated from the remaining urine.

SUMMARY OF THE INVENTION

The present invention has been achieved in consideration of the above-described problem, and an object of the present invention is to provide a urinal with a sanitation device capable of preventing the generation of a smell and urine scale with reliability without reducing a water conservation effect.

To achieve the above-described object, according to the present invention, there is provided a urinal with a sanitation device in which the whole of a trap unit having a water seal formed by urine or a component part constituting the trap unit is interchangeable, and in which a sanitary condition is maintained by using a chemical agent, the urinal including a bowl portion including a standing wall portion facing a user and a bottom surface portion that guides urine received by the standing wall portion to a drain hole, a trap unit that retains urine flowing in from the drain hole to form a water seal, and that communicates with a drain tube, a liquid agent ejection unit for ejecting to the urinal a liquid agent for dissolving a chemical agent capable of inhibiting generation of an ammonia smell and urine scale from urine, an use state detection unit for detecting the state of use of the urinal, and a control unit for controlling the liquid agent ejection unit on the basis of the detecting result of the use state detection unit, wherein the control unit controls the liquid agent ejection unit so that the amount of the liquid agent flowing into the trap unit is smaller when the frequency of use of the urinal is high than when the frequency of use is low.

In a urinal used with no or substantially no water supplied, various bacteria multiply if no countermeasure is taken on urine retained in a trap unit. The extent of this multiplication varies largely depending on the frequency of use of the urinal. When the frequency of use of the urinal is high, urine retained in the trap unit is discharged from the trap unit in a short time by being replaced with the next user's urine flowing in and, therefore, the extent of multiplication of various bacteria in the trap unit is comparatively small. When the frequency of use of the urinal is low, replacement of urine retained in the trap unit is not frequently performed, and the multiplication of various bacteria in the trap unit advances comparatively fast. The inventors of the present invention found that in efficiently controlling the generation of a smell and urine scale in a trap unit with a small amount of a chemical agent, it is preferable to adjust factors including the amounts of the chemical agent and a liquid agent to be supplied according to the frequency of use of the urinal. According to the present invention achieved based on this finding, the amount of a liquid agent flowing into a trap unit is reduced to conserve a chemical agent and the liquid agent when the frequency of use of the urinal is high, and when the extent of multiplication of various bacteria in the trap unit is small. On the other hand, when the frequency of use of the urinal is low, and when the extent of multiplication of various bacteria is large, the amount of the liquid agent flowing into the trap unit is increased to reliably inhibit the generation of a smell and urine scale in the trap unit with a large amount of the chemical agent dissolved. In this way, highly efficient maintenance of a sanitary condition is enabled, such that the generation of a smell and urine scale is reliably inhibited with small amounts of the chemical agent and the liquid agent. Further, for example, degradation in performance of the trap unit due to the generation of urine scale can also be limited. The frequency of interchange of the trap unit or component parts constituting the trap unit can thereby be reduced to reduce the interchange operation load and cost burden.

In the urinal with a sanitation device according to the present invention, the chemical agent is disposed so as to be dissolved by urine and supplied to the trap unit, and a chemical liquid ejection unit for ejecting a chemical liquid containing the chemical agent to the bowl portion is provided. Preferably, the control unit controls the chemical liquid ejection unit so that a reduction in the amount of the liquid agent flowing into the trap unit when a transition from a state where the frequency of use of the urinal is low to a state where the frequency of use of the urinal is high is made is larger than a reduction in the amount of the chemical liquid ejected to the bowl portion when a transition from a state where the frequency of use of the urinal is low to a state where the frequency of use of the urinal is high is made.

The possibility of urine urinated from a user directly hitting on a certain area in the bowl portion is high. Even if urine from a user remains in such area after use of the urinal by the user, the remaining urine can easily be flowed away by urine urinated by the next user. In the area where the possibility of direct hitting of urine is high, remaining urine, if any, can easily be replaced in a short time and, therefore, the extent of multiplication of various bacteria is comparatively limited. On the other hand, in an area where the possibility of direct hitting of urine is low, if urine remains in this area after hitting on other areas, diffusing, scattering and attaching to the portion in this area, the possibility of the urine being flowed away by the next user's urine is low, the same urine tends to remain for a long time and the extent of multiplication of various bacteria is comparatively large. In the trap unit, a smell, etc., are suppressed by the chemical agent supplied by being dissolved by user's urine. Therefore, if the frequency of use of the urinal is higher, urine retained in the trap unit is replaced in a shorter time period and the chemical agent is frequently supplied to the trap unit. In this preferable aspect, therefore, the reduction in amount of the liquid agent flowing into the trap unit when a transition from a state where the frequency of use of the urinal is low to a state where the frequency of use of the urinal is high is made is set larger than the reduction in amount of the chemical liquid ejected to the bowl portion when a transition from a state where the frequency of use of the urinal is low to a state where the frequency of use of the urinal is high is made. When a transition from a state where the frequency of use of the urinal is low to a state where the frequency of use of the urinal is high is made, the multiplication of various bacteria in the trap unit is comparatively limited and the amount of the chemical agent needed for inhibition of a smell, etc., is reduced. Therefore, the amount of the liquid agent to be ejected can be largely reduced to conserve the liquid agent and the chemical agent. On the other hand, the difference between the amount of the chemical liquid needed before the above-described state transition and the amount of the chemical liquid needed after the state transition for inhibition of a smell, etc., in the bowl portion is not so large as that need in the trap unit. The reduction in the amount of the chemical liquid to be ejected to the bowl portion is set smaller. Thus, a sanitary condition can be reliably maintained while the amounts of the liquid agent and the chemical agent used are reduced.

Preferably, in the urinal with a sanitation device according to the present invention, when a transition from a state where the frequency of use of the urinal is low to a state where the frequency of use of the urinal is high is made, the control unit reduces the amount of the liquid agent flowing into the trap unit without reducing the amount of the chemical liquid ejected to the bowl portion In this preferable aspect, when a transition from a state where the frequency of use of the urinal is low to a state where the frequency of use of the urinal is high is made, the amount of the liquid agent ejected to the trap unit is reduced to conserve the liquid agent and the chemical agent. On the other hand, the amount of the chemical agent ejected to the bowl portion where the influence of the frequency of use of the urinal on the multiplication of various bacteria is not so large as in the trap unit is not reduced. Thus, a sanitary condition can be reliably maintained while the amounts of the liquid agent and the chemical agent used are reduced.

Preferably, in the urinal with a sanitation device according to the present invention, when a transition from a state where the frequency of use of the urinal is low to a state where the frequency of use of the urinal is high is made, the control unit increases the amount of the chemical liquid ejected to width-direction-opposite-side areas on the standing wall portion in the bowl portion, and reduces the amount of the liquid agent flowing into the trap unit.

The possibility that urine urinated from a user facing the standing wall portion in the bowl portion directly hits on a width-direction-center area on the standing wall portion is high. Therefore, the possibility of the extent of multiplication of various bacteria in width-direction-opposite-side areas on the standing wall portion being larger than that in the width-direction-center area on the standing wall portion is high, as described above. Therefore, in this preferable aspect, when a transition from a state where the frequency of use of the urinal is low to a state where the frequency of use of the urinal is high is made, the amount of the liquid agent flowing into the trap unit is reduced to conserve the liquid agent and the chemical agent. On the other hand, the amount of the chemical liquid ejected to the width-direction-opposite-side areas on the standing wall portion in the bowl portion where the possibility of the multiplication of various bacteria being intensified is strong is increased. Thus, a sanitary condition can be maintained with further improved reliability while the amounts of the liquid agent and the chemical agent used are reduced.

Preferably, in the urinal with a sanitation device according to the present invention, the chemical liquid ejection unit is arranged so as to be capable of ejecting supplementary water for supplementing the water seal in the trap unit, and the control unit increases the amount of the supplementary water to be ejected when the frequency of use of the urinal is low relative to the amount of the supplementary water to be ejected when the frequency of use of the urinal is high.

In this preferable aspect, the chemical liquid ejection unit is also used to supplement the water seal in the trap unit, and the amount of supplementary water to be ejected when the frequency of use of the urinal is low is increased relative to the amount of supplementary water to be ejected when the frequency of use of the urinal is high. In a situation where the frequency of use of the urinal is low, no new urine flows in even when urine in the trap unit evaporates, and there is a possibility of a deficiency of the water seal. In such a situation, the amount of supplementary water to be ejected to the trap unit is increased to enable the water seal to be restored to the amount sufficient for reliably suppressing a smell backflow from the drain tube.

Preferably, in the urinal with a sanitation device according to the present invention, the chemical liquid ejection unit is arranged so as to be capable of ejecting the chemical liquid to the drain tube, and the control unit reduces the amount of the chemical liquid to be ejected to the drain tube when the frequency of use of the urinal is high relative to the amount of the chemical liquid to be ejected to the drain tube when the frequency of use of the urinal is low.

In this preferable aspect, the amount of the chemical liquid to be ejected to the drain tube when the frequency of use of the urinal is high is reduced relative to the amount of the chemical liquid to be ejected to the drain tube when the frequency of use of the urinal is low. In a situation where the frequency of use of the urinal is high, urine frequently flows into the drain tube downstream of the trap unit to flow away urine that has remained and, therefore, the same urine can hardly remain in the drain tube for a long time and the multiplication of various bacteria therein tends to be comparatively limited. According to the present invention, in a situation where the frequency of use of the urinal is high, the amount of the liquid agent to be ejected to the drain tube is reduced, thus enabling efficient suppression of a smell, etc., with small amounts of the liquid agent and the chemical agent.

Preferably, in the urinal with a sanitation device according to the present invention, substitute water ejection unit for ejecting substitute water for replacing urine retained in the trap unit is provided, and the control unit executes replacement discharge control for controlling the substitute water ejection unit so that the substitute water is ejected to discharge urine retained in the trap unit by replacement when the frequency of use of the urinal becomes equal to or lower than a predetermined frequency, and reduces the amount of the liquid agent flowing into the trap unit after the execution of the replacement discharge control relative to the amount of the liquid agent before the execution of the replacement discharge control.

In this preferable aspect, when the frequency of use of the urinal becomes equal to or lower than the predetermined frequency, the amount of urine retained in the trap unit can be reduced by executing replacement discharge control. Therefore, the extent of multiplication of various bacteria in the trap unit after execution of replacement discharge control is comparatively limited, thus enabling maintenance with small amounts of the liquid agent and the chemical agent of a state where a smell, etc., are suppressed.

Preferably, in the urinal with a sanitation device according to the present invention, the control unit is arranged so as to be capable of executing by predetermined timing a bowl portion ejection mode of ejecting the liquid agent containing the chemical agent to the bowl portion, a chemical agent supply ejection mode of ejecting the liquid agent so that the chemical agent is supplied to the trap unit, and a replacement ejection mode of ejecting an amount of the liquid agent larger than the amount of the liquid agent ejected in the chemical agent supply ejection mode to replace urine retained in the trap unit with the liquid agent; the control unit executes the chemical agent supply ejection mode when the frequency of use of the urinal is lower than a predetermined first frequency, and executes the replacement ejection mode when the frequency of use of the urinal is lower than a predetermined second frequency; and the predetermined second frequency is lower than the predetermined first frequency.

In the urinal with a sanitation device according to the present invention, the generation of an ammonia smell and urine scale from urine remaining on the bowl portion can be inhibited with the chemical agent supplied by executing the bowl portion ejection mode. Also, the generation of the ammonia smell, etc., from urine in the trap unit can be inhibited with the chemical agent supplied to the trap unit by executing the chemical agent supply ejection mode. In some situations, e.g., a situation where the frequency of use of the urinal is low, the same urine remains in the trap for a long time and various bacteria multiply extensively. Inhibiting the generation of the ammonia smell, etc., from such a state where various bacteria have multiplied extensively by executing the chemical agent supply ejection mode requires use of large amounts of the liquid agent and the chemical agent. In the present invention, the replacement ejection mode in which a large amount of the liquid agent is ejected compared with the chemical agent supply ejection mode is executed to replace the urine retained in the trap unit with the liquid agent ejected in the replacement ejection mode. The urine in which various bacteria have multiplied extensively is thereby discharged from the trap unit. The proportion of urine in the liquid retained in the trap unit can be largely reduced in this way. Thereafter, the generation of the ammonia smell, etc., can be inhibited with a small amount of the chemical agent. According to the present invention, even a urinal used by supplying no or substantially no water can be comfortably used by maintaining a highly sanitary condition. Further, for example, degradation in performance of the trap unit due to the generation of urine scale can also be limited. The frequency of interchange of the trap unit or component parts constituting the trap unit can thereby be reduced to reduce the interchange operation load and cost burden. In the urinal with a sanitation device according to the present invention, the chemical agent supply ejection mode is executed when the frequency of use of the urinal is low, and the replacement ejection mode is executed when the frequency of use of the urinal is much lower. These modes using different settings of the amount of the liquid agent to be ejected are executed according to the extent of multiplication of various bacteria in the trap unit, thereby enabling efficient use of the liquid agent and maintaining a sanitary condition.

Preferably, in the urinal with a sanitation device according to the present invention, the control unit executes the chemical agent supply ejection mode when the lapse of time from the preceding use of the urinal exceeds a predetermined first time period, and executes the replacement ejection mode when the lapse of time from the preceding use of the urinal exceeds a predetermined second time period, and the predetermined second time period is longer than the predetermined first time period.

In this preferable aspect, the chemical agent supply ejection mode is executed in a situation where the urinal is not used for a substantially long time, and the replacement ejection mode is executed in a situation where the urinal is not used for a much longer time. In a trap unit having such a characteristic that if the time period during which the urinal is not used is longer, various bacteria multiply more extensively, ejection of the amount of the liquid agent according to the extent of multiplication of various bacteria can be performed, thus enabling maintenance of a sanitary condition using the liquid agent with improved efficiency.

Preferably, in the urinal with a sanitation device according to the present invention, the control unit sets smaller than the capacity of the trap unit the amount of the liquid agent to be ejected by executing the replacement ejection mode one time.

Even when urine remains in the trap unit, the extent of multiplication of various bacteria is comparatively small if the amount of urine is small. Therefore, if an attempt to reduce the amount of remaining urine to zero by replacing the remaining urine with the liquid agent to discharge the urine is made in such a case, a disjunction occurs between the amount of the liquid agent required for this operation and the effect of inhibiting the generation of the ammonia smell. In this preferable aspect, the amount of the liquid agent ejected by executing the replacement ejection mode one time is set smaller than the capacity of the trap unit. An amount of the liquid agent appropriate to the amount of remaining urine is thereby supplied while the liquid agent is conserved by avoiding replacing the entire urine in the trap unit, thus enabling maintenance of a sufficiently high level of sanitary condition in use of the urinal.

Preferably, in the urinal with a sanitation device according to the present invention, the control unit delays the time at which the chemical agent supply ejection mode is to be next executed by setting longer the predetermined first time period after the execution of the replacement ejection mode.

After the execution of the replacement ejection mode, the proportion of urine in the trap unit is small. Therefore, the amount of the chemical agent thereafter required for inhibition of generation of the ammonia smell, etc., is reduced. In this preferable aspect, the time at which the chemical agent supply ejection mode is to be next executed is delayed to conserve the chemical agent while maintaining a sanitary condition.

Preferably, in the urinal with a sanitation device according to the present invention, the trap unit has an inlet portion through which urine discharged from the drain hole flows into the trap unit, a retention portion in which urine flowing in from the inlet portion is retained and a closing member for closing the inlet portion when the water level in the retention portion becomes equal to or higher than a predetermined level, and the control unit is arranged so as to be capable of executing a first ejection mode of controlling the liquid agent ejection unit so that the liquid agent is ejected to the bowl portion by predetermined timing, and a second ejection mode of controlling the liquid agent ejection unit so that water is ejected to the trap unit by predetermined timing in order to restore the water level in the retention portion to the predetermined level.

In this preferable aspect, the generation of the ammonia smell and urine scale from urine remaining on the bowl portion can be inhibited with the chemical agent supplied by executing the first ejection mode. Further, when the water level in the retention portion is lowered, for example, by evaporation of urine, water can be supplied by executing the second ejection mode to restore the predetermined water level at which the inlet portion can be closed with the closing member, thereby preventing ammonia produced from urine in the trap unit from diffusing in a toilet room or the like through the inlet portion of the trap unit and the drain hole of the bowl portion and generating a smell. Even a urinal used by supplying no or substantially no water can be comfortably used by maintaining a highly sanitary condition.

Preferably, in the urinal with a sanitation device according to the present invention, the control unit executes the second ejection mode when the frequency of use of the urinal is lower than a predetermined first frequency.

In a situation where the frequency of use of the urinal is low, the frequency with which urine flows into the trap unit is also reduced. Therefore, a deficiency of urine due to evaporation is not replenished; the water level in the retention portion is lowered; and there is a possibility of failure to close the inlet portion with the closing member. Further, in a situation where the frequency of use of the urinal is low, the frequency with which urine retained in the trap unit is replaced is also reduced. Various bacteria multiply extensively in the urine to produce a large amount of ammonia and there is an apprehension of generation of a strong smell. In this preferable aspect, the second ejection mode is executed in a situation where the frequency of use of the urinal is lower than the predetermined first frequency. Even when the frequency of use of the urinal is low, generation of the ammonia smell can be reliably prevented by execution of the second ejection mode, thus enabling maintenance of a sanitary condition.

Preferably, in the urinal with a sanitation device according to the present invention, the control unit executes the second ejection mode when the lapse of time from the preceding use of the urinal exceeds a predetermined time period.

In this preferable aspect, the water level restoration can be performed by timing corresponding to lowering of the water level in the water level in the retention portion below the predetermined level in a situation where the urinal is not used during a long time period. This is achieved by executing the second ejection mode when the lapse of time from the preceding use of the urinal exceeds the predetermined time period. That is, water for water level restoration can be supplied by suitable timing to prevent generation of a smell with higher reliability.

Preferably, in the urinal with a sanitation device according to the present invention, the control unit includes condition change unit for changing the condition for execution of the second ejection mode.

In this preferable aspect, the condition for execution of the second ejection mode can be changed by referring to variation of the change in water level in the retention portion depending on an environment in which the urinal is used and other factors. Thus, generation of a smell can be reliably prevented while water to be supplied to the trap unit is conserved.

According to the present invention, a urinal with a sanitation device capable of preventing the generation of a smell and urine scale with reliability without reducing a water conservation effect can be provided.

BRIEF DESCRIPTION OF THE DRAWINGS

FIG. 19 is a flowchart showing a method of controlling the sanitation device shown in FIGS. 1 and 4;

DETAILED DESCRIPTION OF THE PREFERRED EMBODIMENTS

Figure 1:
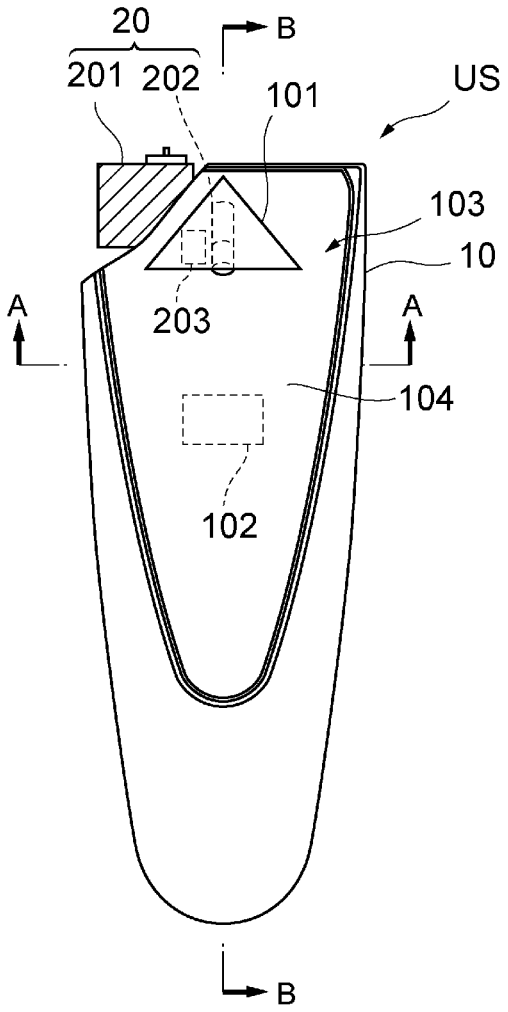
FIG. 1 is a diagram schematically showing the construction of a urinal according to an embodiment of the present invention.

An embodiment of the present invention will be described with reference to the accompanying drawings. For ease of understanding, indications of components identical to each other by the same reference characters are made as comprehensively as possible in the drawings and redundant descriptions of them will not be made.

Figure 2:
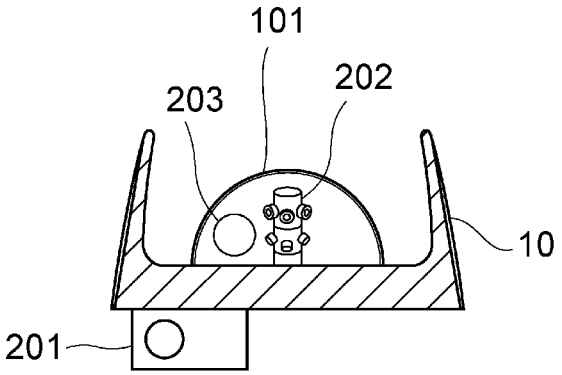
FIG. 2 is a sectional view taken along line A-A in FIG. 1.
Figure 3:
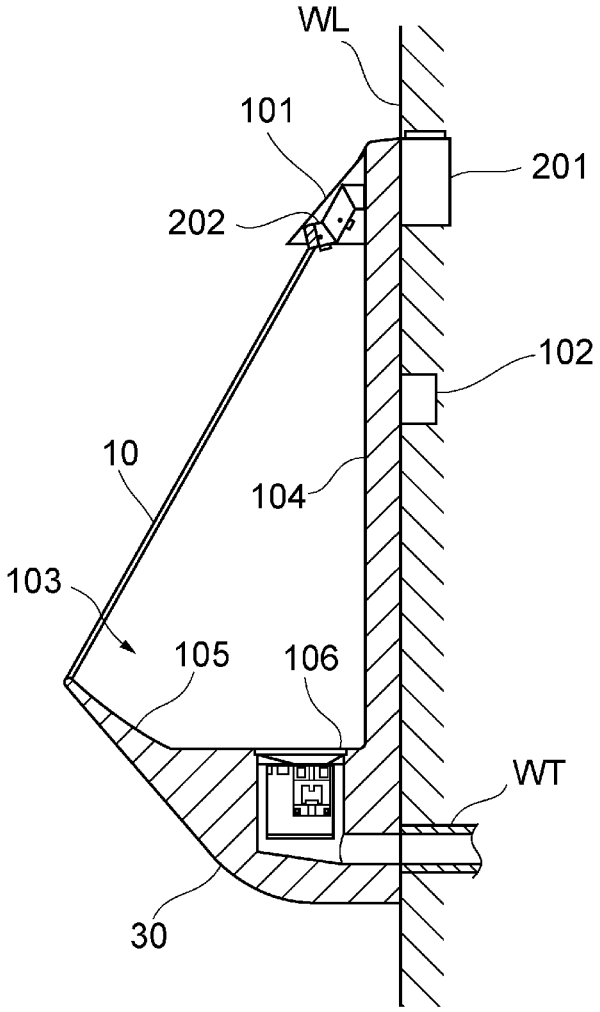
FIG. 3 is a sectional view taken along line B-B in FIG. 1.

A urinal with a sanitation device according to the embodiment of the present invention will be described first with reference to FIGS. 1, 2, and 3. FIG. 1 is a schematic front view of the construction of a urinal US according to the embodiment of the present invention. FIG. 2 is a sectional view taken along line A-A in FIG. 1. FIG. 3 is a sectional view taken along line B-B in FIG. 1. The urinal US includes a urinal body 10, a sanitation device 20 and a trap unit 30.

The urinal body 10 is installed, with its back surface brought into abutment on a wall WL of a toilet room. The urinal body 10 is formed by using a ceramic material, a resin material, or the like and a forming method such that the material can be formed into any shape. The urinal body 10 has a nozzle cover 101, a human body detection sensor 102 and a bowl portion 103.

The nozzle cover 101 is a cover for covering a nozzle unit 202 and a bowl drying fan 203 described later. The nozzle unit 202 and the bowl drying fan 203 are disposed on an upper portion of the urinal body 10, and the nozzle cover 101 is disposed in a corresponding upper position on the urinal body 10.

The human body detection sensor 102 is a sensor for sensing a user using the urinal US. The human body detection sensor 102 is provided on a back portion of the bowl portion 103 in the vicinity of a center of the bowl portion 103. The human body detection sensor 102 is a sensor using microwaves. The human body detection sensor 102 emits microwaves through a standing wall portion 104 and can sense a user using the urinal US and user's moving away from the urinal US after use through reflected waves returned by being reflected by the body of the user.

The bowl portion 103 includes the standing wall portion 104 and a bottom surface portion 105. A bottom surface opening portion 106 is formed in the bottom surface portion 105. The bowl portion 103 is a portion for receiving urine urinated by a user in a standing posture. The standing wall portion 104 is a portion which faces a user relieving himself and directly receives urine from the user, and which is a portion in wall form extending upward, downward, leftward and rightward directions. The bottom surface portion 105 is a portion which guides urine received by the standing wall portion 104 and flowing downward to the bottom surface opening portion 106 existing as a drain hole, and which is a bed portion extending frontward, rearward, leftward and rightward directions. Urine guided to the bottom surface opening portion 106 by the bottom surface portion 105 is discharged out of the bowl portion 103 from the bottom surface opening portion 106.

The sanitation device 20 has a control unit 201, the nozzle unit 202 and the bowl drying fan 203. The sanitation device 20 is provided on the back side of the urinal body 10. The control unit 201 outputs control signals for driving the nozzle unit 202 and the bowl drying fan 203. The configuration of a control system for the sanitation device 20 is described later.

The nozzle unit 202 is provided at an upper position on the standing wall portion 104 in the bowl portion 103, and ejects toward the cavity in the bowl portion 103 a liquid agent supplied from the control unit 201. The nozzle cover 101 in the form of a thin plate is provided on the front side of the nozzle unit 202 to cover the nozzle unit 202 so that the nozzle unit 202 cannot be seen from a user, thus improving the design appearance.

The bowl drying fan 203 is provided at an upper position on the standing wall portion 104 in the bowl portion 103 and covered with the nozzle cover 101. The bowl portion 103 can be dried by air blown in the bowl portion 103 by driving the bowl drying fan 203.

The trap unit 30 is provided below the bottom surface opening portion 106, which is a drain hole. The trap unit 30 is constructed so as to flow urine discharged through the bottom surface opening portion 106 thereinto, store the urine flowed in and form a water seal of the urine. A drain tube WT is provided in the wall WL on the downstream side of the trap unit 30. A backflow of a smell from the drain tube WT connected on the downstream side is prevented by forming a water seal of urine as described above. The trap unit 30 is constructed interchangeably so as to be detachably attached to the bottom surface opening portion 106.

Figure 4:
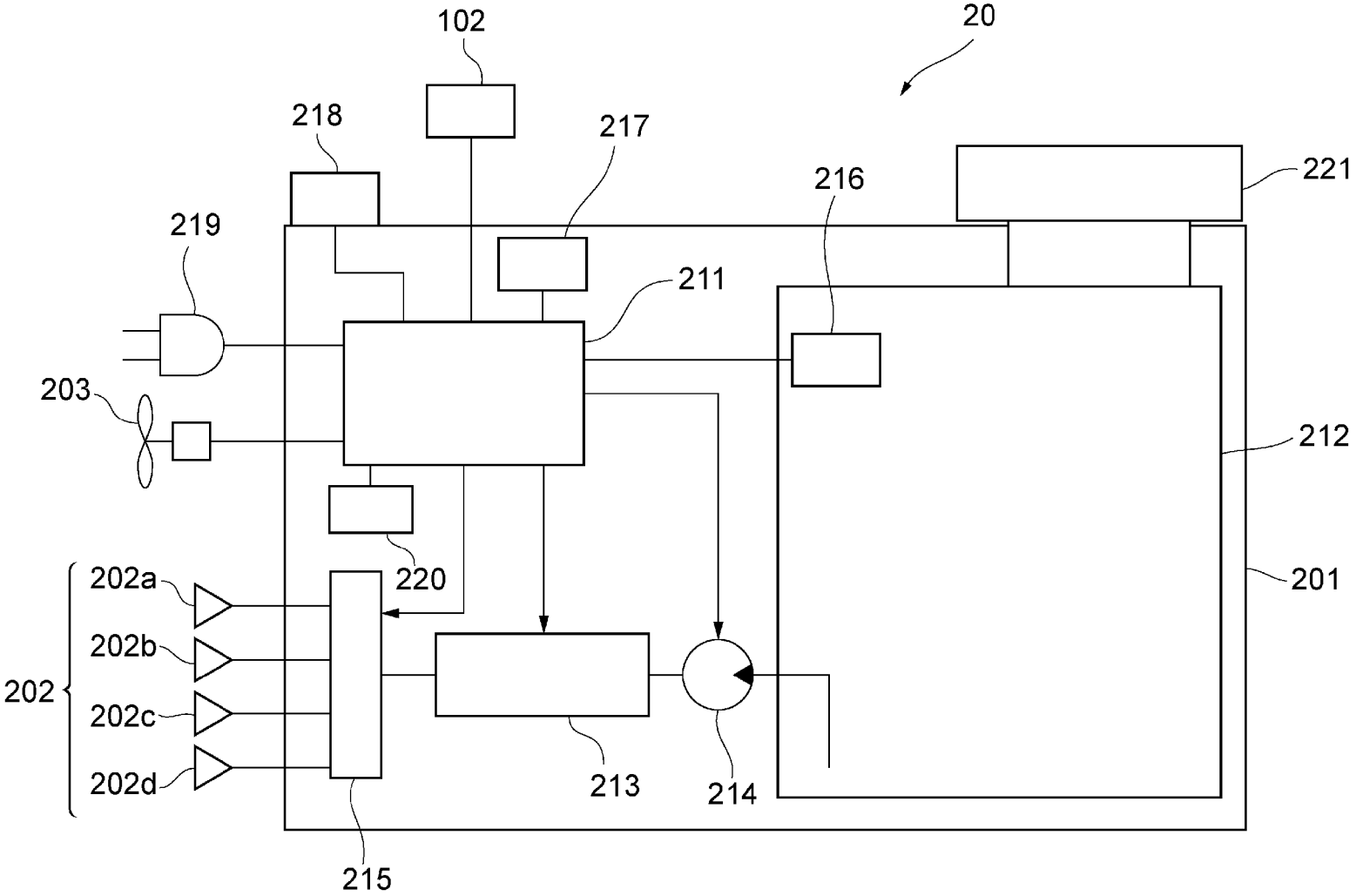
FIG. 4 is a block diagram showing the configuration of a control system for a sanitation device shown in FIG. 1.

The configuration of a control system for the urinal US will be described with reference to FIG. 4. FIG. 4 is a block diagram showing the configuration of a control system for the urinal US and the sanitation device 20.

As shown in FIG. 4, the sanitation device 20 of the urinal US includes the control unit 201, the nozzle unit 202 (a liquid agent ejection unit), the bowl drying fan 203 and a power supply connector 219.

The control unit 201 has a CPU 211, a liquid agent tank 212, an electrolysis unit 213, a motor-driven pump 214, a channel switch valve 215, a water level sensor 216, a temperature sensor 217, an operating switch 218 and a warning lamp 220.

The liquid agent tank 212 stores a liquid agent, which is city water (containing chloride ions) in the present embodiment. The capacity of the liquid agent tank 212 is 500 ml. In the present embodiment, a tank system for storing water is provided to eliminate the need for piping for supply of water to urinal apparatus 1. A lid 221 is provided on the liquid agent tank 212 and water can be added by removing the lid 221. A system may alternatively be adopted in which city water is supplied through water supply tube provided in the toilet room. In the present embodiment, city water containing chloride ions is electrolyzed to supply sterilizing water containing hypochlorous acid. However, the liquid agent is not limited to water containing hypochlorous acid. For example, a liquid agent using a *bacillus* bacterium or a sterilizing agent may be used as the liquid agent. An agent effective in sterilizing urine scale bacteria may be adopted as desired.

The water level sensor 216 is provided in the liquid agent tank 212. The water level sensor 216 senses the level of water in the liquid agent tank 212 and outputs a measurement signal indicating the sensing result to the CPU 211.

Water stored in the liquid agent tank 212 is supplied to the electrolysis unit 213 by driving the motor-driven pump 214.

The electrolysis unit 213 is provided on the downstream side of the motor-driven pump 214. A pair of electrodes (not shown in FIG. 4) are provided in the electrolysis unit 213. In water supplied from the liquid agent tank 212 by the motor-driven pump 214, hypochlorous acid is produced from chloride ions contained in the water by applying a voltage between the pair of electrodes in the electrolysis unit 213. Hypochlorous acid is a substance having sterilizing and bleaching effects and suitable for destroying various bacteria in urine. The water produced in the electrolysis unit 213 and containing hypochlorous acid is supplied to the channel switch valve 215.

The channel switch valve 215 is provided on the downstream side of the electrolysis unit 213. The channel switch valve 215 supplies water supplied from the electrolysis unit 213 and containing hypochlorous acid to the nozzle unit 202. More specifically, the channel switch valve 215 switches between channels so that water is ejected from one or more of a bowl mist nozzle 202*a*, a bowl mist nozzle 202*b*, a bowl mist nozzle 202*c* and a trap liquid nozzle 202*d*.

The nozzle unit 202 has the bowl mist nozzle 202*a*, the bowl mist nozzle 202*b*, the bowl mist nozzle 202*c* and the trap liquid nozzle 202*d*. The bowl mist nozzle 202*a*, the bowl mist nozzle 202*b* and the bowl mist nozzle 202*c* are nozzles for supplying the liquid agent to the bowl portion 103. The trap liquid nozzle 202*d* is a nozzle for supplying the liquid agent to the trap unit 30. The trap liquid nozzle 202*d* is provided at a position remoter from the standing wall portion 104 in the bowl portion 103 relative to the bowl mist nozzles 202*a*, 202*b*, and 202*c*.

The CPU 211 receives detection signals and operation signals from the human body detection sensor 102, the water level sensor 216, the temperature sensor 217 and the operating switch 218, and outputs control signals to the motor-driven pump 214, the electrolysis unit 213, the channel switch valve 215, the warning lamp 220 and the bowl drying fan 203. A flow of control with the CPU 211 as control means is described later.

The operating switch 218 is a switch which is turned on by a cleaning worker or the like to forcibly drive the electrolysis unit 213 so that the water containing hypochlorous acid is ejected from the nozzle unit 202 toward the bowl for the purpose of sterilizing the bowl portion. The operating switch 218 is provided by assuming that it is turned on at the time of cleaning.

The human body detection sensor 102 is a sensor for detecting the presence of a user in front of the urinal body 10, as described above. Upon detecting the presence of a user, the human body detection sensor 102 sends a detection signal to the CPU 211.

The temperature sensor 217 is a sensor for sensing the temperature in the toilet room or the like in which the urinal US is installed. The temperature sensor 217 is provided as means for obtaining the temperature of the urinal US for the purpose of using the liquid agent with efficiency according to the condition of the urinal US changing with temperature, as described later. While changes in temperature are detected as changes in condition in the present embodiment, rough control may be executed, for example, according to seasonal changes in temperature with a switch for setting use term divisions between summer and winter.

The bowl drying fan 203 is a fan for drying the surface of the bowl portion 103, as described above. The bowl drying fan 203 is driven on the basis of a command signal output from the CPU 211.

The warning lamp 220 is a lamp lit on the basis of a control signal output from the CPU 211. The warning lamp 220 exhibits a message having a predetermined content to a cleaning worker or the like by means of timing or intervals and a lighting color of blinking or lighting for example.

The power supply connector 219 is inserted into a receptacle on the building framework side to supply electric power to the sanitation device 20.

Ways of ejection of the liquid agent from the nozzle unit 202 and the operation of the bowl drying fan 203 will be described with reference to FIGS. 5, 6, 7, 8, 9, 10, 11, 12, and 13. FIGS. 5 to 13 are schematic diagrams showing ways of ejection of the liquid agent from the nozzle unit 202 and the operation of the bowl drying fan 203.

Figure 5:
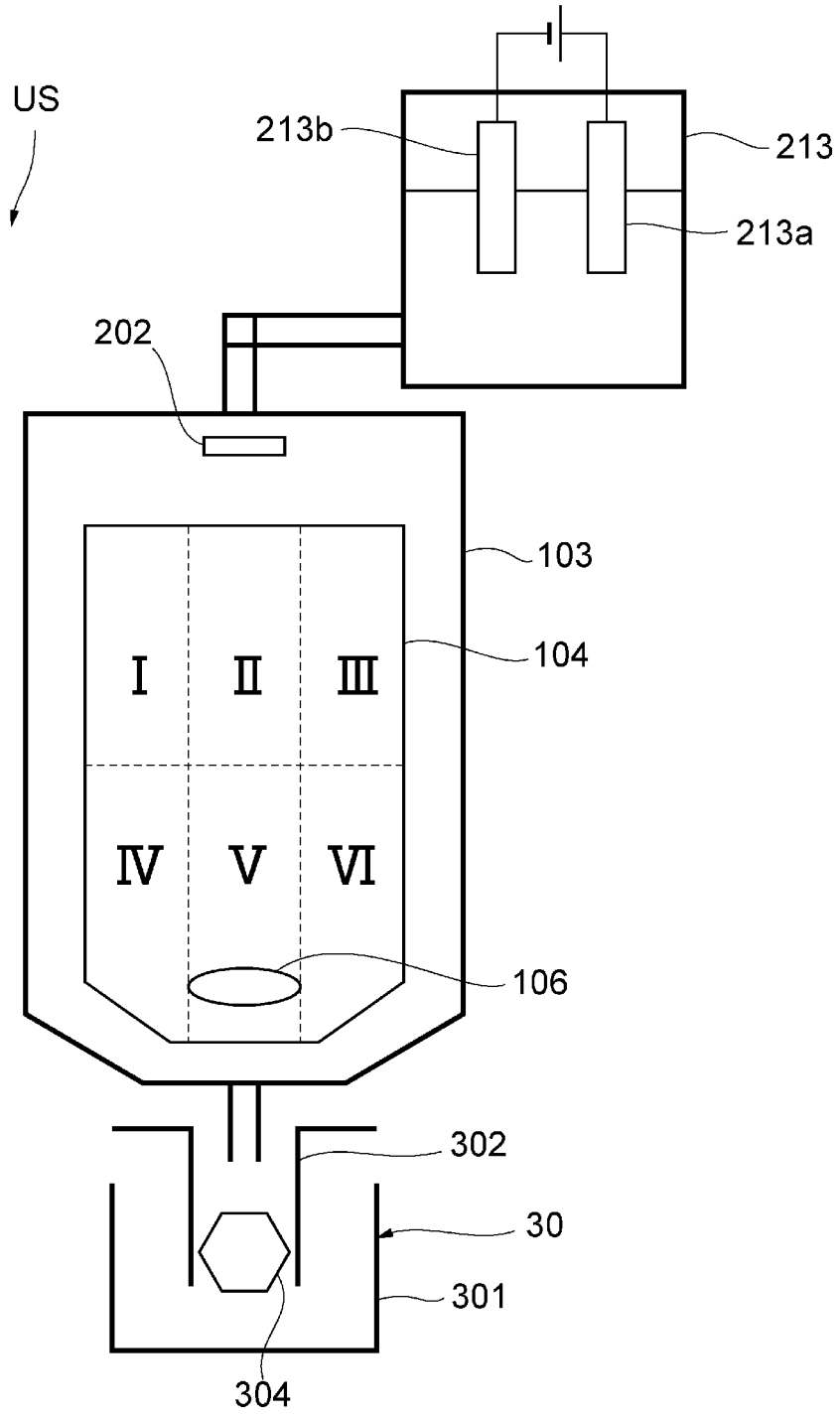
FIG. 5 is a diagram for explaining a control mode when a sanitary operation on the urinal is performed by using the sanitation device shown in FIGS. 1 and 4.

As shown in FIG. 5, electrodes 213*a* and 213*b* are provided in the electrolysis unit 213. A voltage is applied between the electrodes 213*a* and 213*b* by means of a control signal from the CPU 211 provided as control means to supply water containing hypochlorous acid to the nozzle unit 202. Water ejected from the nozzle unit 202 is sprayed on the bowl portion 103 and is discharged from the bottom surface opening portion 106 provided as a drain hole into the trap unit 30.

The trap unit 30 temporarily retains urine and water ejected from the nozzle unit 202 and discharges them into the drain tube WT (see FIG. 3). The trap unit 30 has a container 301, a cover 302 and a chemical agent 304. Details of the structure of the trap unit 30 are described later.

In the present embodiment, the standing wall portion 104 in the bowl portion 103 is divided into six zones, and ways of ejection of water containing hypochlorous acid are determined according to the tendencies of contamination in the zones. The standing wall portion 104 is divided into an upper stage and a lower stage. The upper stage is further divided into a zone I, a zone II and zone III. The lower stage is divided into a zone IV, a zone V and a zone VI. In the upper stage, the zone II is located at a center; the zone I is located on the left-hand side as seen in a direction toward the standing wall portion 104; and the zone III is located on the right-hand side. In the lower stage, the zone V is located at a center; the zone IV is located on the left-hand side as seen in a direction toward the standing wall portion 104; and the zone VI is located on the right-hand side.

The liquid agent ejected from the bowl mist nozzle 202*a* is ejected toward the lower left zone IV and toward the lower right zone VI. The liquid agent ejected from the bowl mist nozzle 202*b* is ejected toward the upper left zone I, toward the upper central zone II and toward the upper right zone III. The liquid agent ejected from the bowl mist nozzle 202*c* is ejected toward the lower central zone V. The liquid agent ejected from the trap liquid nozzle 202*d* is ejected toward bottom surface opening portion 106.

The liquid agent ejected from the bowl mist nozzle 202*a*, 202*b*, or 202*c* is supplied by being spread over at least one of the zones I to VI. Accordingly, the liquid agent is ejected in spray form from each of the bowl mist nozzles 202*a*, 202*b*, and 202*c*. On the other hand, the liquid agent ejected from the trap liquid nozzle 202*d* is unfailingly supplied to the bottom surface opening portion 106. Therefore, the liquid agent is ejected in liquid form from the trap liquid nozzle 202*d*.

More specifically, the particle size of the mist of the liquid agent ejected from the bowl mist nozzle 202*a* is comparatively large and the rate of flow from this nozzle is high. The liquid agent ejected from the bowl mist nozzle 202*a* has a medium flow velocity.

The particle sizes of the mists of the liquid agent ejected from the bowl mist nozzles 202*b* and 202*c* are comparatively small and the rates of flows from these nozzles are low. The flow velocities of the liquid agent ejected from the bowl mist nozzles 202*b* and 202*c* are lower than that of the liquid agent ejected from the bowl mist nozzle 202*a*.

The liquid agent ejected from the trap liquid nozzle 202*d* is ejected in intermittent or continuous liquid form. The rate of flow of the liquid agent ejected from the trap liquid nozzle 202*d* is variable. The flow velocity of the liquid agent ejected from the trap liquid nozzle 202*d* is substantially equal to that of the liquid agent ejected from the bowl mist nozzle 202*a*.

Characteristics of generation of a smell and urine scale in each area on the standing wall portion 104 in the bowl portion 103 will be described with reference to FIG. 5. From human urine, a strong smell and urine scale are not generated immediately after urination. However, the tendency of a smell and urine scale to generate increases with the passage of time. That is, human urine contains innumerable various bacteria, and the bacteria in the urine multiply increasingly with passage of time and decompose urea in the urine to generate ammonia. By this ammonia generation, an ammonia smell and urine scale (solid matters such as calcium phosphate and magnesium phosphate derived from constituents of urine) are generated. Therefore, if urine from a user remains for a long time on the urinal body 10, a smell and urine scale are generated by multiplication of various bacteria in the urine.

A user using the urinal body 10 urinates by standing in a position in front of the standing wall portion 104 corresponding generally to the center of the standing wall portion 104 in the width direction. Therefore, the possibility of urine urinated by the user directly hitting on the upper central zone II and the lower central zone V corresponding to the center of the standing wall portion 104 in the width direction is high. In particular, the possibility of the urine directly hitting on the lower central zone V is high irrespective of the height of the user. Therefore, even if urine from a user remains on the upper central zone II or the lower central zone V in the standing wall portion 104 after use (urination) by the user, the remaining urine can easily be flowed away by urine urinated by the next user to hit on the same area. Thus, the upper central zone II and the lower central zone V are areas where remaining urine, if any, can easily be replaced with new urine and, therefore, the increasing multiplication of various bacteria in the zones and the generation of a smell and urine scale by the bacteria are comparatively limited.

The frequencies of direct hitting of user's urine on the upper left zone I, the upper light zone III, the lower left zone IV and the lower right zone VI, which are width-direction-opposite-side areas on the standing wall portion 104 in the bowl portion 103, are not so high as those of direct hitting on the upper central zone II and the lower central zone V, which are width-direction-center areas. Also, urine diffusing and scattering after hitting on the width-direction-center areas can attach easily to the portions in the width-direction-opposite-side areas. In the width-direction-opposite-side areas in the standing wall portion 104, therefore, the same urine tends to remain for a long time without being replaced and the multiplication of various bacteria is comparatively intensified.

In the lower left zone IV and the lower right zone VI among the width-direction-opposite-side areas on the standing wall portion 104 in the bowl portion 103, the tendency to intensify the multiplication of various bacteria is particularly strong. This is because films of urine remaining in the upper left zone I and the upper right zone III flow gradually downward into the lower left zone IV and the lower right zone VI by their weights and, as a result, comparatively large amounts of urine remain in these zones.

On the standing wall portion 104 with the above-described tendency of multiplication of various bacteria, sterilizing operations are performed in three modes: "first bowl portion sterilization mode", "second bowl portion sterilization mode", and "third bowl portion sterilization mode" in the present embodiment. The state shown in FIG. 5 is a state where the urinal US is being used or a state where the urinal US is ready to be used, i.e., a "standby mode" in which the electrolysis unit 213 and the motor-driven pump 214 (see FIG. 4) are not operated and the liquid agent is not ejected from the nozzle unit 202.

Figure 6:
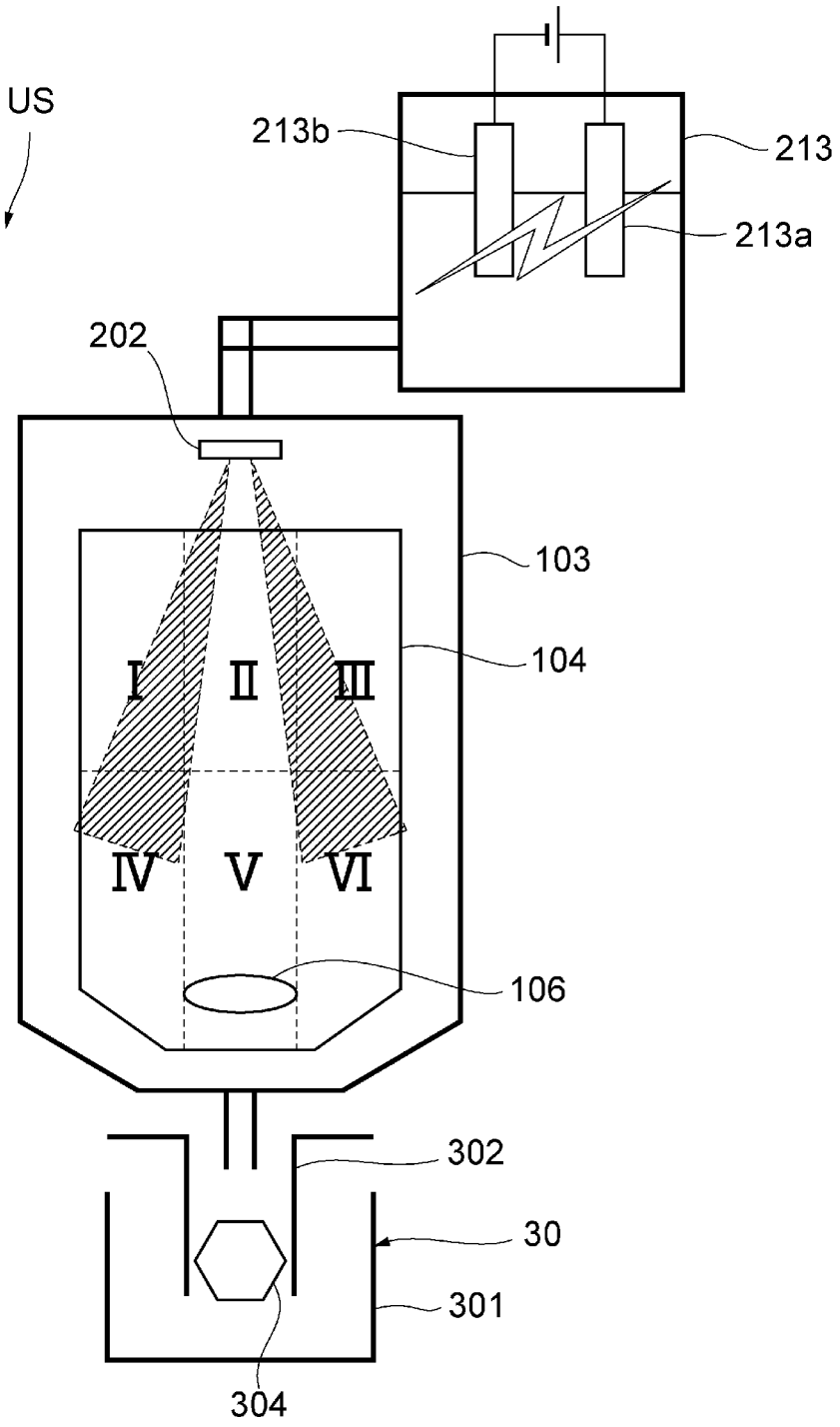
FIG. 6 is a diagram for explaining a control mode when a sanitary operation on the urinal is performed by using the sanitation device shown in FIGS. 1 and 4.

FIG. 6 schematically shows the state of liquid agent ejection in the "first bowl portion sterilization mode". The "first bowl portion sterilization mode" will be described with reference to FIGS. 4 and 6. In the "first bowl portion sterilization mode", the liquid agent is supplied to the lower width-direction-opposite-side areas (zone IV and zone VI) where the multiplication of various bacteria is particularly intensified among the areas on the standing wall portion 104 in the bowl portion 103 in order to inhibit generation of a smell and urine scale therein.

To be specific, a voltage is applied to the pair of electrodes 213*a* and 213*b* in the electrolysis unit 213 to electrolyze the liquid agent (water containing chloride ions) supplied from the motor-driven pump 214 so that hypochlorous acid is produced. More specifically, chlorine is generated by the anode-side electrode 213*b* and hypochlorous acid is produced by reaction between the generated chlorine and water. The liquid agent (water) containing this hypochlorous acid having a sterilization effect as a chemical agent is ejected from the bowl mist nozzle 202*a* in the nozzle unit 202.

The liquid agent ejected from the bowl mist nozzle 202*a* is ejected just toward the lower left zone IV and toward the lower right zone VI. The liquid agent is not supplied to the upper left zone I and the upper right zone III to be thereafter supplied to the lower left zone IV and the lower right zone VI below by moving along the standing wall portion 104. The directions of the nozzle orifices of the bowl mist nozzle 202*a* are set so that the liquid agent are first ejected toward the lower left zone IV and toward the lower right zone VI. Thus, the areas where the multiplication of various bacteria is intensified on the standing wall portion 104 in the bowl portion 103 are supplied with the chemical agent (hypochlorous acid) with priority to destroy various bacteria in urine remaining in the areas, thereby inhibiting production of ammonia and inhibiting generating of a smell and urine scale.

Figure 7:
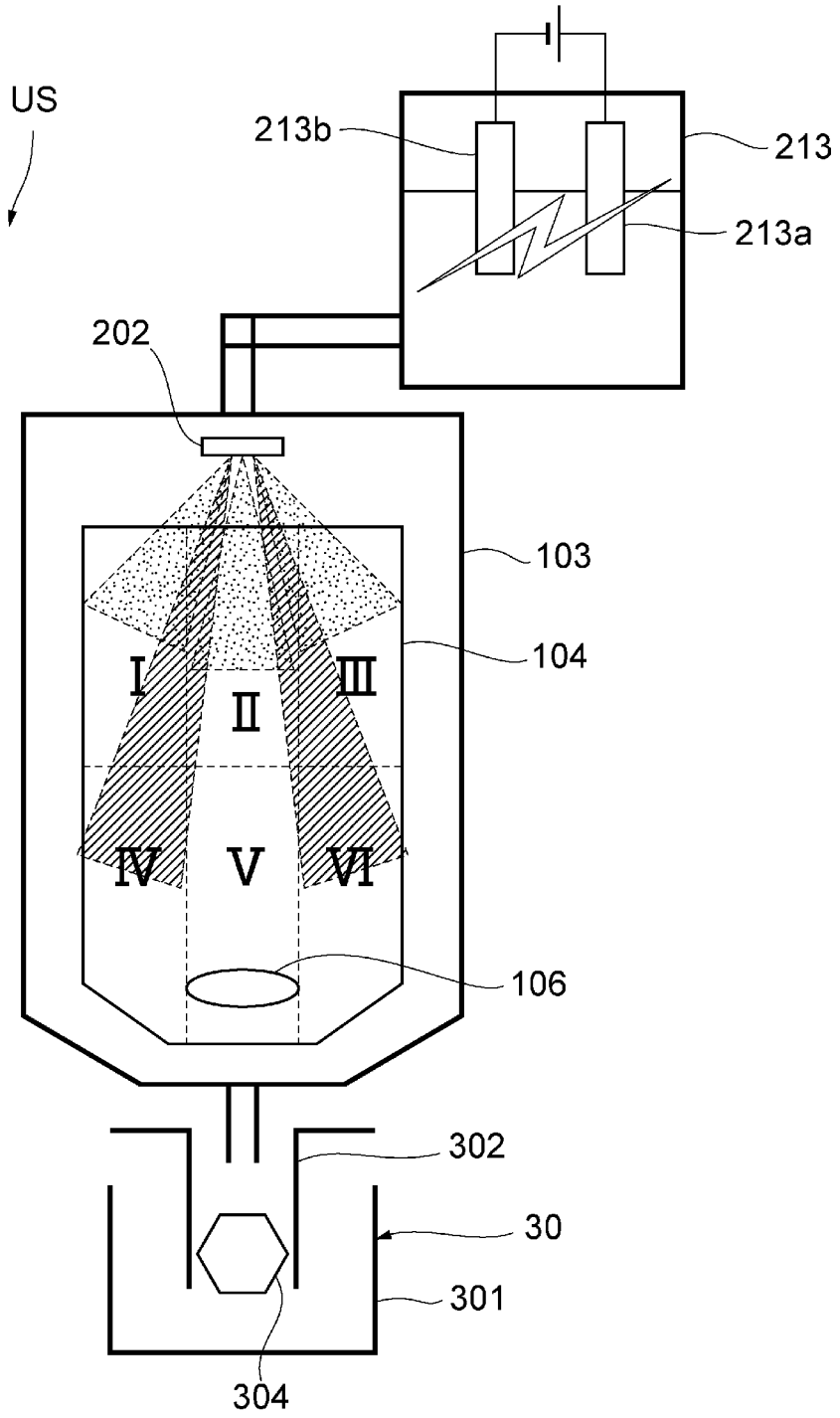
FIG. 7 is a diagram for explaining a control mode when a sanitary operation on the urinal is performed by using the sanitation device shown in FIGS. 1 and 4.

FIG. 7 schematically shows the state of liquid agent ejection in the "second bowl portion sterilization mode". The "second bowl portion sterilization mode" will be described with reference to FIGS. 4 and 7. In the "second bowl portion sterilization mode", the liquid agent is supplied to the upper areas on the standing wall portion 104 as well as to the lower width-direction-opposite-side areas on the standing wall portion 104 in the bowl portion 103 in order to inhibit generation of a smell and urine scale in the upper areas.

Hypochlorous acid is produced in the electrolysis unit 213, as in the "first bowl portion sterilization mode". The way of ejection from the nozzles differs from that in the "first bowl portion sterilization mode" in that ejection of the liquid agent (water containing hypochlorous acid) from the bowl mist nozzle 202*b* to the upper left zone I, the upper central zone II and the upper right zone III, which are the upper areas on the bowl portion 103, is performed in addition to ejection of the liquid agent from the bowl mist nozzle 202*a* to the lower left zone IV and the lower right zone VI.

Figure 8:
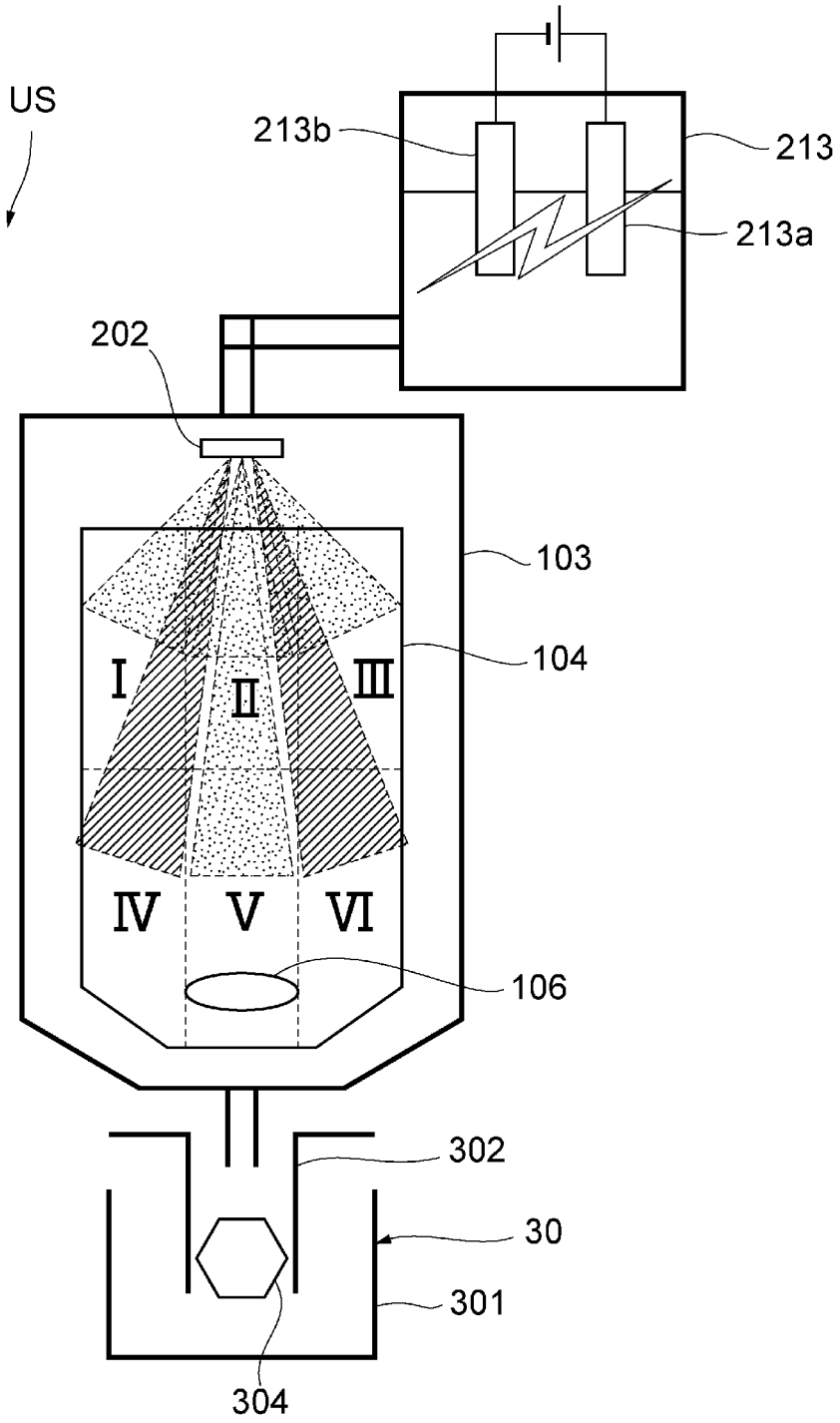
FIG. 8 is a diagram for explaining a control mode when a sanitary operation on the urinal is performed by using the sanitation device shown in FIGS. 1 and 4.

FIG. 8 schematically shows the state of liquid agent ejection in the "third bowl portion sterilization mode". The "third bowl portion sterilization mode" will be described with reference to FIGS. 4 and 8. The "third bowl portion sterilization mode" is a mode for inhibiting generation of a smell and urine scale by supplying the liquid agent to the entire standing wall portion 104 in a situation where the lapse of time from the preceding use of the urinal 1 is long and it is inferred that the multiplication of various bacteria on the standing wall portion 104 in the bowl portion 103 has progressed considerably.

Hypochlorous acid is produced in the electrolysis unit 213, as in the "first bowl portion sterilization mode". The way of ejection from the nozzles differs from that in the "first bowl portion sterilization mode" in that ejection of the liquid agent (water containing hypochlorous acid) from the bowl mist nozzle 202*b* to the upper left zone I, the upper central zone II and the upper right zone III, which are the upper areas on the bowl portion 103, and ejection of the liquid agent from the bowl mist nozzle 202*c* to the lower central zone V are performed in addition to ejection of the liquid agent from the bowl mist nozzle 202*a* to the lower left zone IV and the lower right zone VI.

Use of different ways of ejection, such as those in the "first bowl portion sterilization mode", "second bowl portion sterilization mode" and "third bowl portion sterilization mode" described above, respectively associated with the areas on the standing wall portion 104 in the bowl portion 103 ensures that generation of a smell and urine scale can be inhibited with the least necessary amounts of the liquid agent according to the different extents of multiplication of various bacteria differing among the areas.

A mode of ejection in which the liquid agent is ejected toward the trap unit 30 to inhibit generation of a smell and urine scale will be described with reference to FIGS. 9, 10, 11, and 12 as well to FIG. 4.

Figure 9:
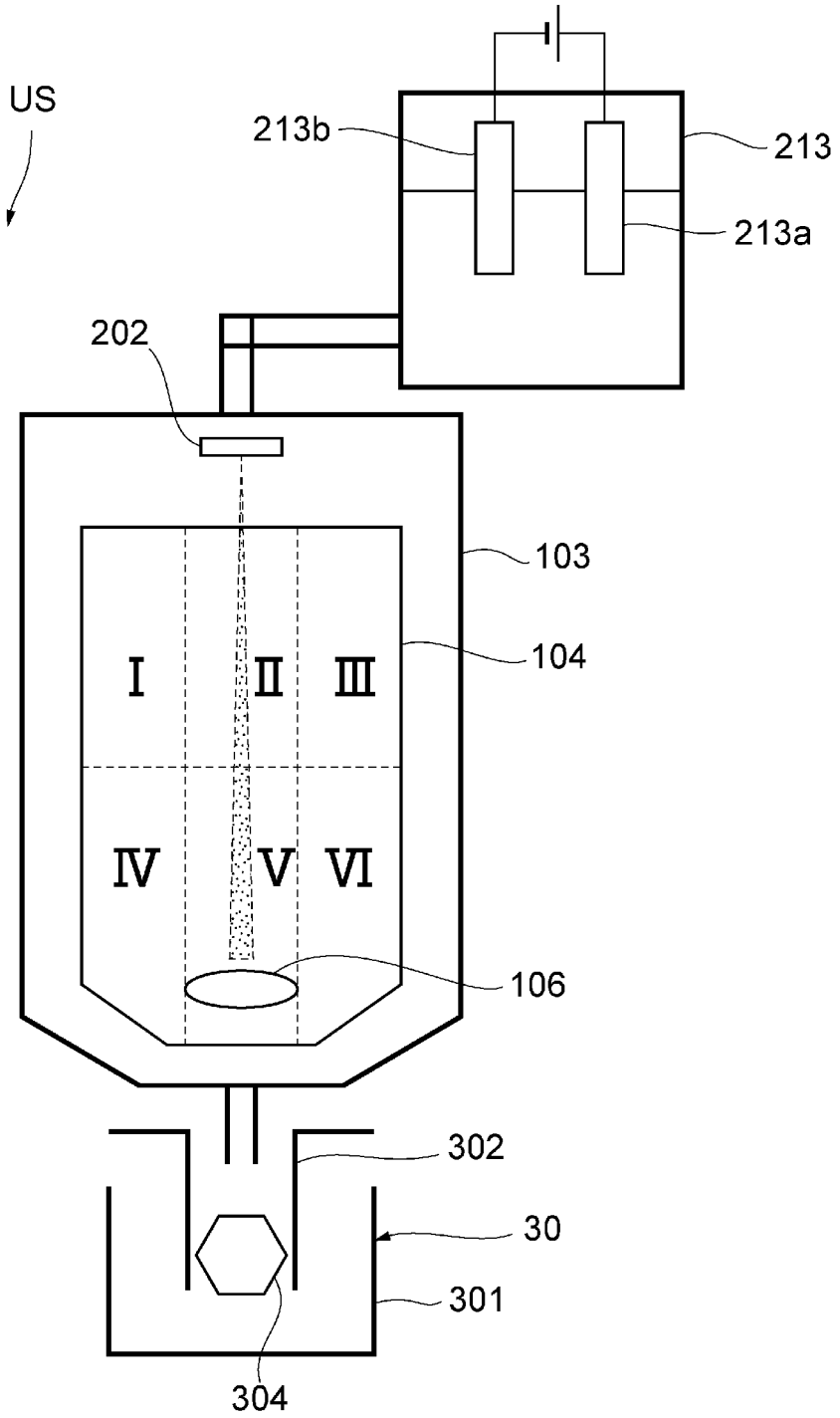
FIG. 9 is a diagram for explaining a control mode when a sanitary operation on the urinal is performed by using the sanitation device shown in FIGS. 1 and 4.

FIG. 9 is a schematic diagram showing the way of ejection in a "trap closing mode". The "trap closing mode" shown in FIG. 9 is a mode for restoring the water level in the trap unit 30 in a case where the urinal US is not used during a long time period, e.g., during a weekend; no user's urine newly flows into the trap unit; urine retained in the trap unit 30 evaporates; and the amount of water for the water seal becomes insufficient or there is a possibility of the amount of water for the water seal becoming insufficient.

To be specific, a small amount of the liquid agent (water containing chloride ions) supplied from the motor-driven pump 214 is directly supplied to the nozzle unit 202 without driving the electrolysis unit 213. The liquid agent is ejected from the trap liquid nozzle 202*d* in the nozzle unit 202. The trap liquid nozzle 202*d* ejects water toward the trap unit 30.

Therefore, the water is supplied as the liquid agent to the trap unit 30 with substantially no amount of water applied to the standing wall portion 104 in the bowl portion 103. The liquid agent is thereby caused to flow into the trap unit 30 to restore the water level in the trap unit 30, thus restoring the water seal function. At this time, dissolution of the chemical agent 304 provided in the trap unit 30 is promoted, though to a small degree, by the liquid agent flowing in, and generation of a smell and urine scale in the trap unit 30 is inhibited by the function of the chemical agent 304.

Figure 10:
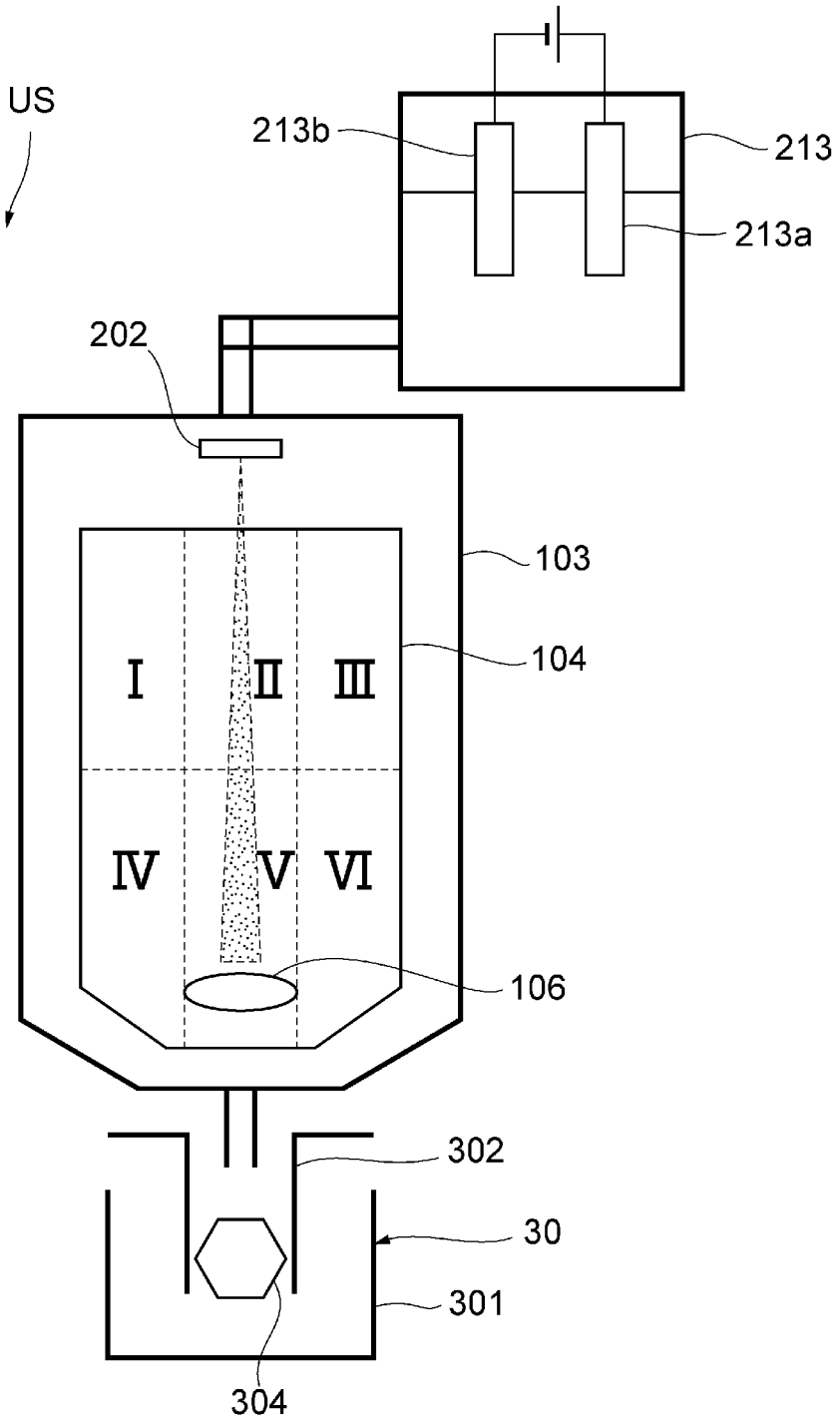
FIG. 10 is a diagram for explaining a control mode when a sanitary operation on the urinal is performed by using the sanitation device shown in FIGS. 1 and 4.

FIG. 10 is a schematic diagram showing the way of ejection in a "gradual dissolution mode". The "gradual dissolution mode" shown in FIG. 10 is a mode for promoting dissolution of the chemical agent 304 to cope with a situation where the urinal US is not used during a much longer time period and the multiplication of various bacteria in urine retained in the trap unit 30 is intensified.

To be specific, a somewhat large amount of the liquid agent (water containing chloride ions) supplied from the motor-driven pump 214 is directly supplied to the nozzle unit 202 without driving the electrolysis unit 213. The somewhat large amount of the liquid agent is ejected from the trap liquid nozzle 202*d* in the nozzle unit 202. The trap liquid nozzle 202*d* ejects water toward the trap unit 30. Therefore, the water is supplied as the liquid agent to the trap unit 30 with substantially no amount of water applied to the standing wall portion 104 in the bowl portion 103.

The somewhat large amount of the liquid agent is thereby caused to flow into the trap unit 30 to dilute urine existing in a state of being saturated with the dissolved chemical agent in the trap unit 30, thus promoting dissolution of the chemical agent. By the promotion of dissolution of the chemical agent 304, various bacteria in the trap unit 30 are destroyed, thus inhibiting generation of a smell and urine scale more strongly.

Figure 11:
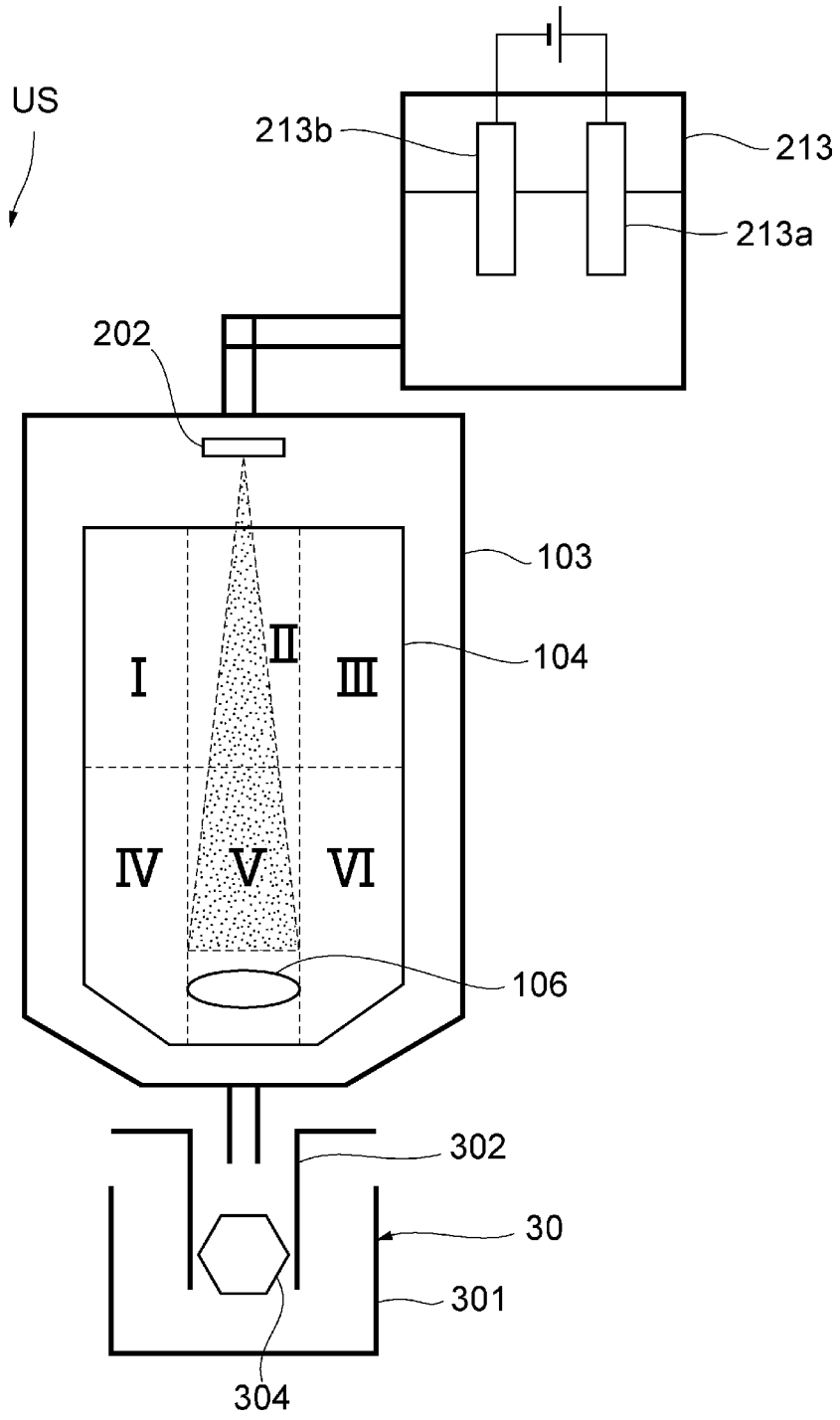
FIG. 11 is a diagram for explaining a control mode when a sanitary operation on the urinal is performed by using the sanitation device shown in FIGS. 1 and 4.

FIG. 11 is a schematic diagram showing the way of ejection in a "trap replacement mode". The "trap replacement mode" shown in FIG. 11 is a mode for replacing urine retained in the trap unit 30 with the liquid agent and discharging the urine out of the trap unit 30 to cope with a situation where the urinal US is not used during an extremely long time period such as a certain number of consecutive non-working days.

To be specific, a substantial amount of the liquid agent (water containing chloride ions) supplied from the motor-driven pump 214 is directly supplied to the nozzle unit 202 without driving the electrolysis unit 213. The substantial amount of the liquid agent is ejected from the trap liquid nozzle 202*d* in the nozzle unit 202. The trap liquid nozzle 202*d* ejects water toward the trap unit 30. Therefore, the water is supplied as the liquid agent to the trap unit 30 with substantially no amount of water applied to the standing wall portion 104 in the bowl portion 103.

The substantial amount of the liquid agent is thereby caused to flow into the trap unit 30 to discharge urine retained so far into the drain tube WT and reduce the proportion of urine in the trap unit 30. In a situation where the urinal 1 is not used during an extremely long time period, replacing urine in the trap unit 30 with the liquid agent at a time is more efficient than supplying small amounts of the chemical agent and the liquid agent a certain number of times in inhibiting generation of substances including a smell from urine in the trap unit 30. Thus, the trap replacement mode is based on a thought that such a one-time replacement operation is more effective in limiting the amount of the liquid agent and the amount of the chemical agent required for thereafter maintaining a state where generation of substances including a smell is inhibited.

Figure 12:
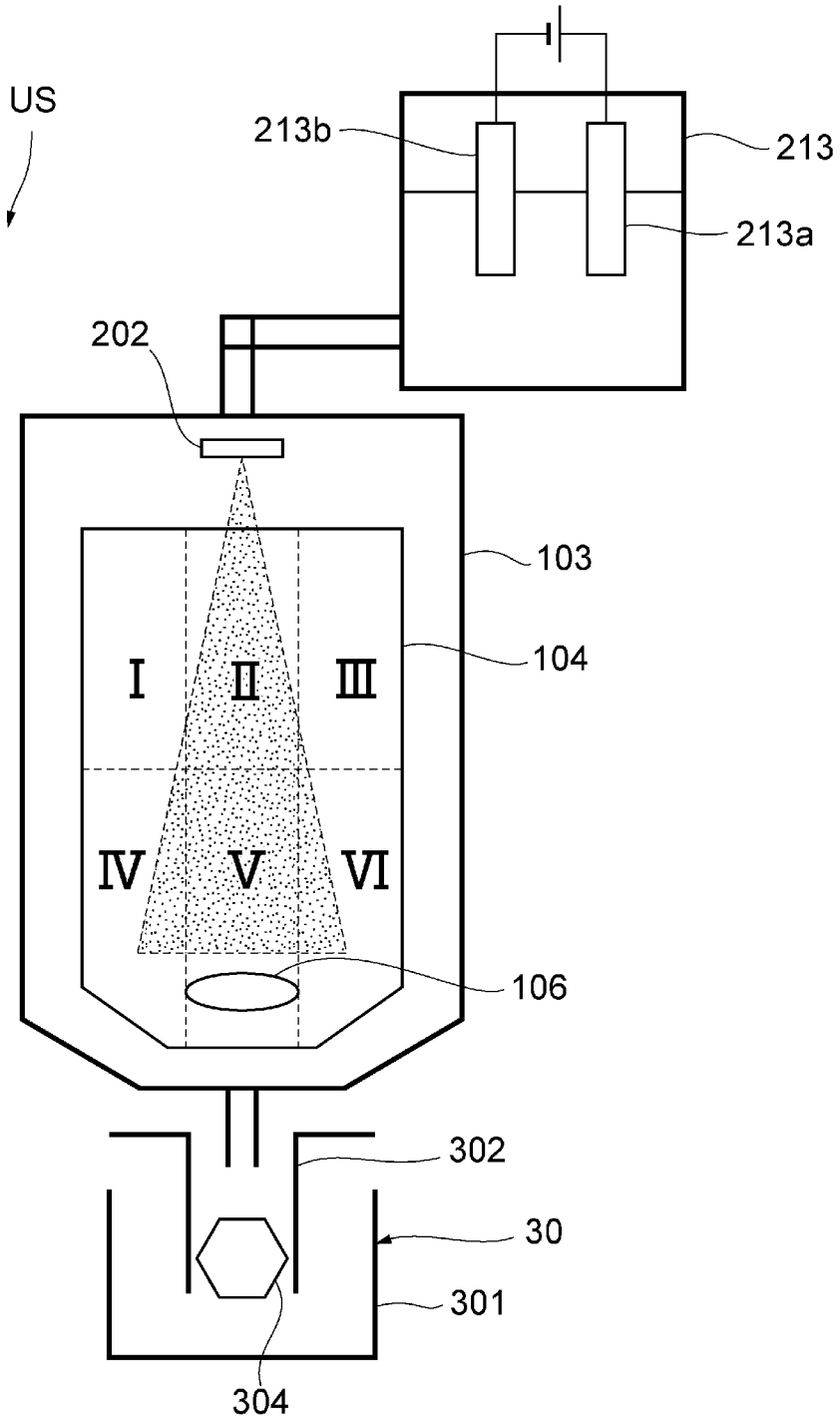
FIG. 12 is a diagram for explaining a control mode when a sanitary operation on the urinal is performed by using the sanitation device shown in FIGS. 1 and 4.

FIG. 12 is a schematic diagram showing the way of ejection in a "drain tube sterilization mode". The "drain tube sterilization mode" shown in FIG. 12 is a mode for supplying large amounts of the liquid agent and the chemical agent periodically (for example, once in a month) for the purpose of protecting the drain tube WT from generation of urine scale and a smell. This mode is executed by a cleaning worker or the like turning on the operating switch 218.

To be specific, the liquid agent (water containing chloride ions) supplied from the motor-driven pump 214 is directly supplied to the nozzle unit 202 without driving the electrolysis unit 213. The liquid agent is intermittently ejected at predetermined time intervals from the trap liquid nozzle 202*d* in the nozzle unit 202. The liquid agent ejected in this mode is the entire liquid agent stored in the liquid agent tank 212. A large amount of the chemical agent 304 dissolved by the liquid agent supplied into the trap unit 30 is thereby supplied intermittently into the drain tube WT. Thus, the drain tube WT, which is difficult to interchange unlike the trap unit 30, can be reliably protected from clogging caused by generation of urine scale.

Figure 13:
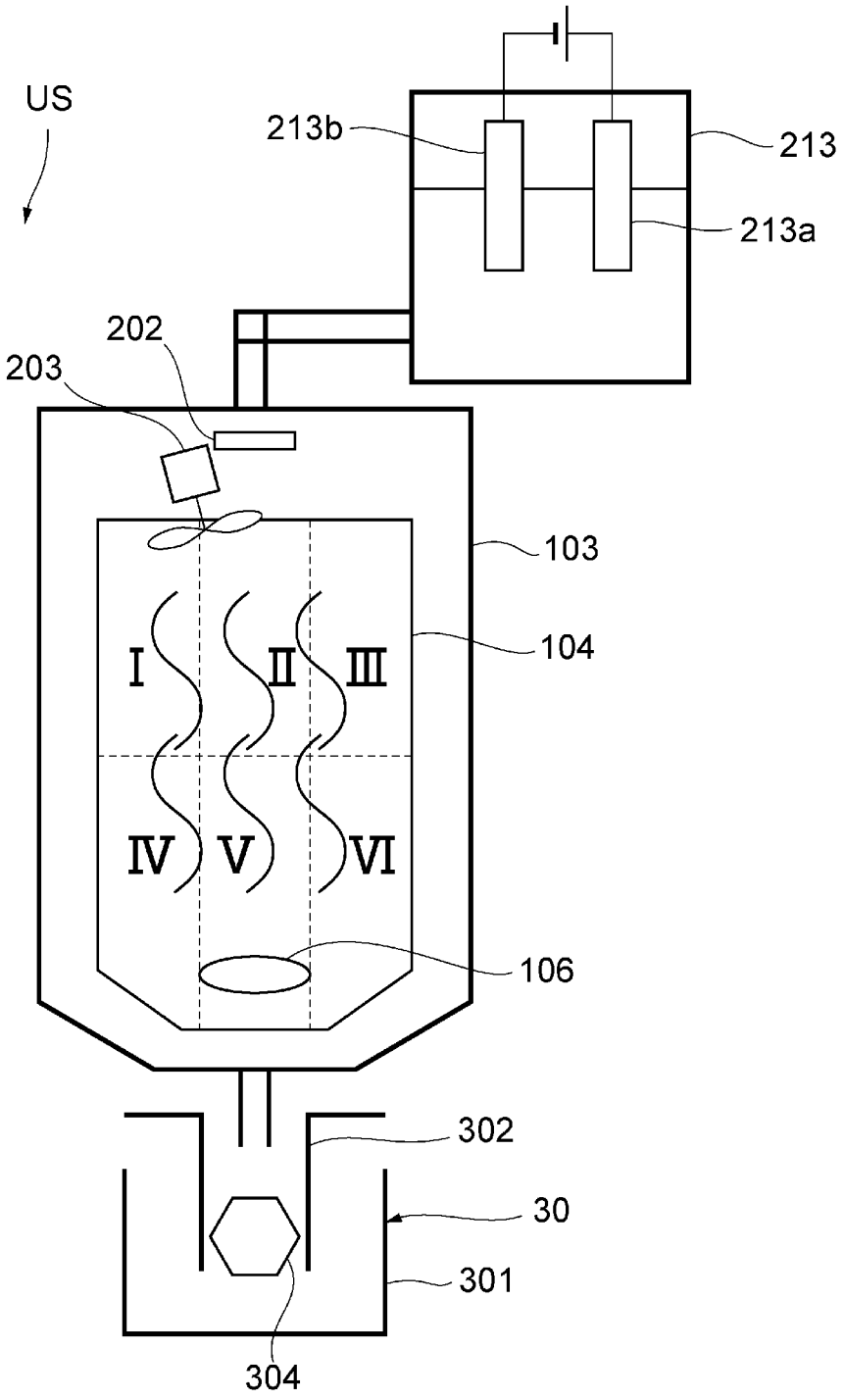
FIG. 13 is a diagram for explaining a control mode when a sanitary operation on the urinal is performed by using the sanitation device shown in FIGS. 1 and 4.

A "bowl portion drying mode" in which air is blown to the bowl portion 103 to inhibit generation of a smell and urine scale will be described with reference to FIG. 13. FIG. 13 is a schematic diagram showing the way of ejection in the "bowl portion drying mode".

The "bowl portion drying mode" shown in FIG. 13 is a mode executed to more reliably destroy various bacteria on the bowl portion 103 after the execution of the "first bowl portion sterilization mode", "second bowl portion sterilization mode" and "third bowl portion sterilization mode". To be specific, the electrolysis unit 213 and the motor-driven pump 214 are not driven and ejection of the liquid agent from the nozzle unit 202 is not performed. On the other hand, the bowl drying fan 203 is driven to blow air to the entire bowl portion 103. The entire bowl portion 103 can be dried to be maintained in such a state that it is difficult for various bacteria to multiply on the bowl portion 103.

Figure 14:
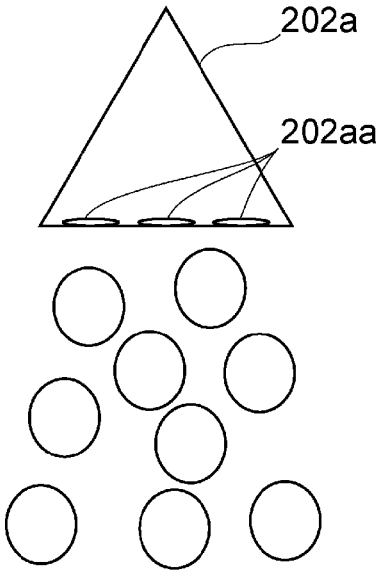
FIG. 14 is a diagram for explaining a way of ejection from a nozzle unit shown in FIG. 1.
Figure 15:
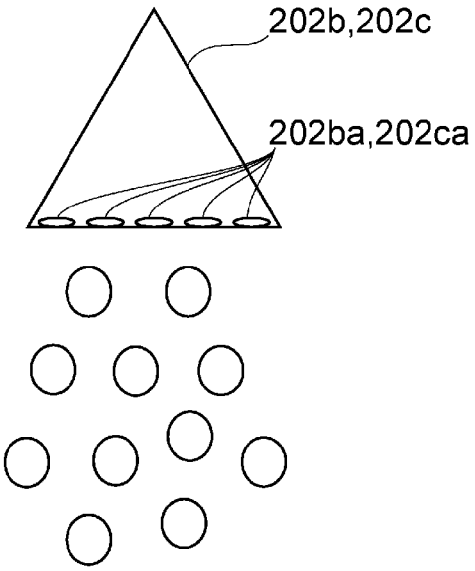
FIG. 15 is a diagram for explaining a way of ejection from the nozzle unit shown in FIG. 1.
Figure 16:
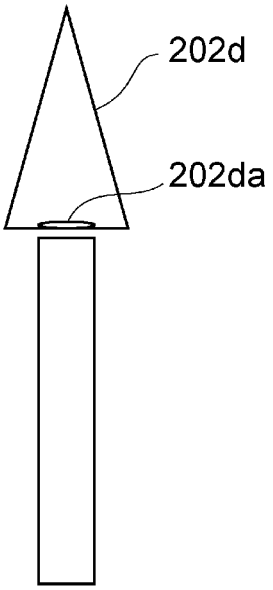
FIG. 16 is a diagram for explaining a way of ejection from the nozzle unit shown in FIG. 1.

Features of the nozzle unit 202 will be described with reference to FIGS. 14, 15, and 16. FIG. 14 is a schematic diagram showing the state of the liquid agent ejected from the bowl mist nozzle 202*a*. FIG. 15 is a schematic diagram showing the state of the liquid agent ejected from the bowl mist nozzle 202*b* or 202*c*. FIG. 16 is a schematic diagram showing the state of the liquid agent ejected from the trap liquid nozzle 202*d*.

The bowl mist nozzle 202*a* shown in FIG. 14 is a nozzle for supplying the liquid agent to the lower left zone IV and the lower right zone VI in the areas on the standing wall portion 104 in the bowl portion 103. The bowl mist nozzle 202*a* has in its lower surface a plurality of (three in the present embodiment) nozzle orifices 202*aa* of a comparatively large diameter, and ejects the liquid agent in mist form from each nozzle orifice 202*aa*. The particle size, the flow rate and the flow velocity of the liquid agent ejected from the bowl mist nozzle 202*a* are set larger than those in the case of ejection from the bowl mist nozzles 202*b* and 202*c* described later. This is because the bowl mist nozzle 202*a* is for ejection to the lower left zone IV and the lower right zone VI on the standing wall portion 104 remote from the upper position on the bowl portion 103 at which the nozzle unit 202 is mounted, and because there is a need to enable the mist to unfailingly reach these zones.

The bowl mist nozzle 202*b* shown in FIG. 15 is a nozzle for supplying the liquid agent to the upper left zone I, the upper central zone II and the upper right zone III in the areas on the standing wall portion 104 in the bowl portion 103. The bowl mist nozzle 202*c* is a nozzle for supplying the liquid agent to the lower central zone V in the areas on the standing wall portion 104 in the bowl portion 103. Each of the bowl mist nozzles 202*b* and 202*c* has in its lower surface a plurality of (five in the present embodiment) nozzle orifices 202*ba* or 202*ca* of a comparatively small diameter, and ejects the liquid agent in mist form from each nozzle orifice.

When water containing hypochlorous acid in mist form is ejected, an attenuation in concentration of hypochlorous acid occurs while the mist is drifting in the air. At a position remote from the ejection position, a substantially no sterilization effect of the ejected water is expected. This attenuation in concentration of hypochlorous acid is more considerable if the particle diameter of the ejected water is reduced.

The nozzles are constructed based on the above-described finding so that the particle size and the flow rate of the liquid agent ejected in mist form from the bowl mist nozzle 202*a* are respectively increased relative to those of water ejected from the bowl mist nozzles 202*b* and 202*c*. More specifically, the diameter of the nozzle orifices 202*aa* provided in the bowl mist nozzle 202*a* is set larger than the diameter of the nozzle orifices 202*ba* and 202*ca* of the bowl mist nozzles 202*b* and 202*c*, while the number of nozzle orifices 202*aa* is set smaller than the number of nozzle orifices 202*ba* or 202*ca*.

Thus, when water containing hypochlorous acid is ejected from the nozzle unit 202 to the lower left zone IV and the lower right zone VI on the standing wall portion 104 located comparatively remote from the nozzle unit 202, particles of water larger in size can be ejected. As a result, the attenuation in concentration of hypochlorous acid can be limited and various bacteria can be reliably destroyed in these areas. On the other hand, when water containing hypochlorous acid is ejected from the nozzle unit 202 to the upper left zone I, the upper central zone II and the upper right zone III on the standing wall portion 104 located comparatively near to the nozzle unit 202, particles of water smaller in size can be ejected. As a result, the water can be easily attached in these areas and hypochlorous acid contained in the water can function adequately to destroy various bacteria.

The trap liquid nozzle 202*d* shown in FIG. 16 is a nozzle for supplying the liquid agent directly to the trap unit 30. More specifically, the liquid agent is not ejected toward the wall surface of the bowl portion 103 to be supplied to the trap unit 30 by flowing and falling along the standing wall portion 104. The liquid agent falls from the trap liquid nozzle 202*d* in the air to be supplied substantially directly to the trap unit 30. At this time, the liquid agent is ejected not in mist form but in liquid form.

Thus, the nozzles for ejecting the liquid agent to the bowl portion 103 and the nozzle for ejecting the liquid agent to the trap unit 30 are provided separately from each other, the bowl mist nozzles 202*a*, 202*b*, and 202*c* ejecting the liquid agent along directions set toward the standing wall portion 104 in the bowl portion 103 rather than the trap unit 30, the trap liquid nozzle 202*d* ejecting the liquid agent along a direction set toward the trap unit 30 rather than the standing wall portion 104 in the bowl portion 103.

Therefore, the liquid agent can be reliably supplied to urine remaining on the standing wall portion 104 in the bowl portion 103 by the bowl mist nozzles 202*a*, 202*b*, and 202*c*. On the other hand, the liquid agent is ejected to urine retained in the trap unit 30 by the trap liquid nozzle 202*d*, so that the ejected liquid agent can be supplied to urine in the trap unit 30 with reliability while being inhibited from interfering with the bowl portion 103, and flowing into the trap unit 30 with the liquid agent of various bacteria attached to the standing wall portion 104 in the bowl portion 103 can be moderated.

Figure 17B:
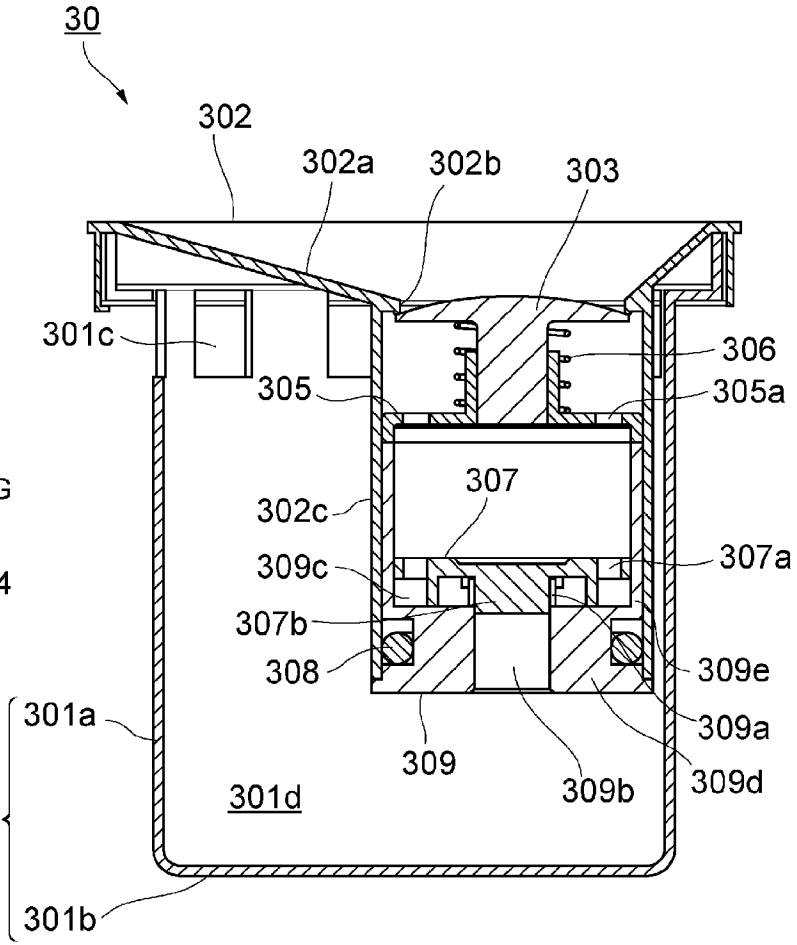
FIGS. 17(A) and 17(B) are schematic sectional views of a trap unit shown in FIG. 1.
Figure 17A:
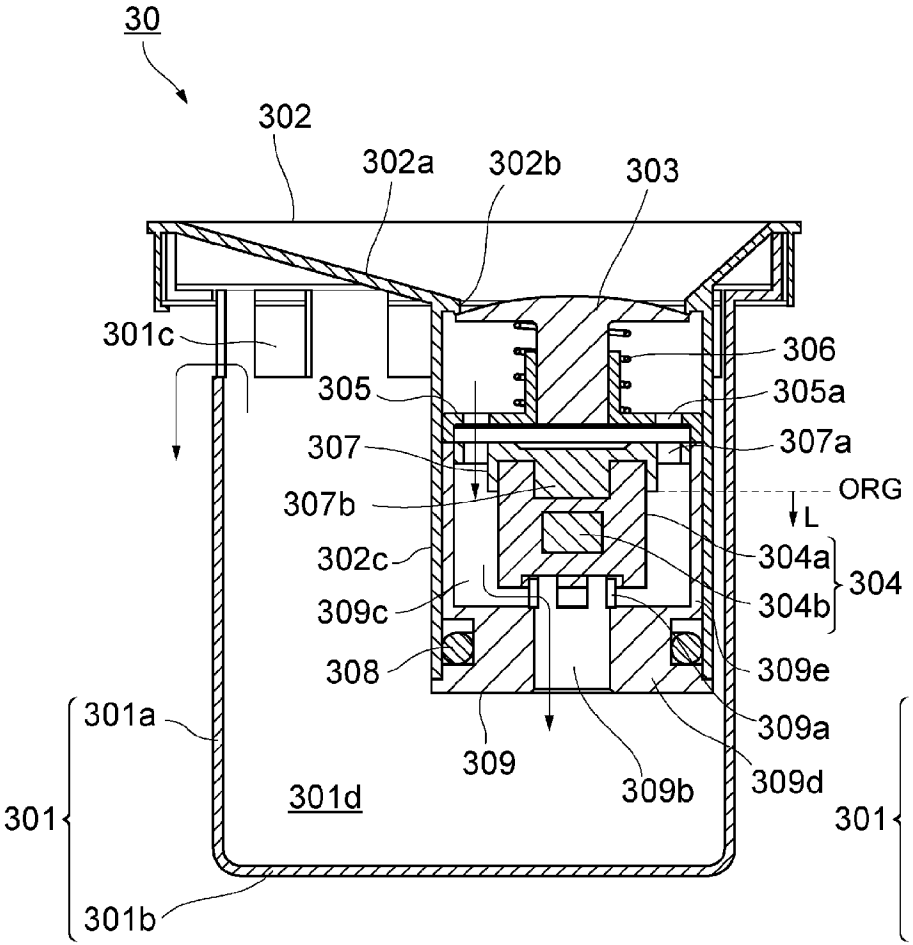

The construction of the trap unit 30 will be described with reference to FIGS. 17(A) and 17(B). FIGS. 17(A) and 17(B) are schematic sectional views showing the construction of the trap unit 30. FIG. 17(A) shows an initial state before the chemical agent 304 starts dissolving. FIG. 17(B) shows a state after the completion of dissolution of the chemical agent 304.

As shown in FIG. 17(A), the trap unit 30 has the container 301 and the cover 302. The container 301 has a side portion 301*a* and a bottom portion 301*b*. The bottom portion 301*b* is a portion in the form of a circular plate. The side portion 301*a* is a cylindrical portion formed so as to rise in one direction from the periphery of the bottom portion 301*b*. The bottom portion 301*b* and the side portion 301*a* thus form the shape of a cylinder closed at its bottom as the shape of the container 301, and form therein a retention chamber 301*d* capable of retaining a liquid. A plurality of outlet portions 301*c* are formed at an upper position on the side portion 301*a* at intervals along the circumferential direction of the side portion 301*a*. The outlet portions 301*c* provide communication between the inside and outside of the container 301.

The cover 302 is provided on the container 301. The cover 302 has a sloped wall 302*a*, an inlet portion 302*b* and a cylindrical partition wall 302*c*. The sloped wall 302*a* is sloped so as to extend toward the inlet portion 302*b* opened at a lower position. The cylindrical partition wall 302*c* extends opposite from the sloped wall 302*a* from the periphery of the inlet portion 302*b*.

A socket 309 is inserted inside the cylindrical partition wall 302*c* from below. The socket 309 has a bottom portion 309*d* and a cylindrical portion 309*e*. The bottom portion 309*d* is formed so as to close the cylindrical partition wall 302*c* at the lower end of the same. The cylindrical portion 309*e* is formed so as to extend in one direction from the periphery of the bottom portion 309*d* and is disposed along the inner surface of the cylindrical partition wall 302*c*. A small-diameter channel 309*b* is provided through the bottom portion 309*d* generally at a center of the same.

A plurality of projections 309*a* disposed by being spaced apart from each other are provided on the cylindrical portion 309*e* side of the small-diameter channel 309*b* along the direction in which the cylindrical portion 309*e* extends. A space surrounded by the cylindrical portion 309*e* is formed as a large-diameter channel 309*c* and communicates with the retention chamber 301*d* through the small-diameter channel 309*b*. A packing 308 is interposed between the socket 309 and the cylindrical partition wall 302*c*.

An inlet closing valve 303, the chemical agent 304, a pedestal 305, a spring 306 and a communication port closing valve 307 are disposed along with the socket 309 inside the cylindrical partition wall 302*c*.

The pedestal 305 is placed on the upper end of the socket 309 so as to cover the large-diameter channel 309*c* from above. A plurality of communication passages 305*a* are formed in the pedestal 305 at intervals along the circumferential direction of the pedestal 305. The inlet closing valve 303 is disposed above the pedestal 305. The spring 306 is disposed between the pedestal 305 and the inlet closing valve 303. With extension/contraction of the spring 306, the inlet closing valve 303 is slidable along a top-bottom direction relative to the pedestal 305. The spring 306 is disposed in a compressed state. Therefore, when no external force is exerted on the spring 306, the spring 306 forces the inlet closing valve 303 upward until the inlet closing valve 303 is brought into abutment against a lower surface in the vicinity of the inlet portion 302*b*, thereby closing the inlet portion 302*b*.

The communication port closing valve 307 and the chemical agent 304 are provided below the pedestal 305 and inside the large-diameter channel 309*c* in the socket 309. More specifically, the solid chemical agent 304 is placed on the plurality of projections 309*a* of the socket 309, and the communication port closing valve 307 is placed on the chemical agent 304. The communication port closing valve 307 has a plurality of communication passages 307*a* formed therein at intervals along the circumferential direction thereof.

The solid chemical agent 304 is formed of a first chemical agent 304*a* positioned at the outer surface before a start of use and a second chemical agent 304*b* positioned inside so as to be covered with the first chemical agent 304*a*. The first chemical agent 304*a* and the second chemical agent 304*b* have in common the capability of being dissolved and destroying various bacteria in urine. However, the rate at which the second chemical agent 304*b* dissolves in urine is higher than the rate at which the first chemical agent 304*a* dissolves in urine.

Operations in the trap unit 30 will be described by also referring to FIGS. 17(A) and 17(B). Urine discharged from the bottom surface opening portion 106 of the urinal US comes to the trap unit 30 and is collected at the inlet portion 302*b* by the sloped upper surface of the sloped wall 302*a*. The collected urine is retained on the inlet closing valve 303.

When the amount of urine retained on the inlet closing valve 303 reaches a predetermined value, the inlet closing valve 303 is moved downward against the urging force of the spring 306 by its weight. The inlet portion 302*b* is thereby opened to allow the retained urine to flow to the inside of the cylindrical partition wall 302*c*. The urine having flowed to the inside of the cylindrical partition wall 302*c* passes through the communication passages 305*a* in the pedestal 305 and passes through the communication passages 307*a* in the communication port closing valve 307.

The urine having passed through the communication passages 307*a* comes to the place by the side of the chemical agent 304 disposed below the communication passages 307*a*. The chemical agent 304 dissolves by contact with the urine. The urine flows through the gaps between the plurality of projections 309*a* of the socket 309 below the chemical agent 304 to come to the small-diameter channel 309*b*. The urine flows through the small-diameter channel 309*b* to be discharged from the socket 309 and retained in the retention chamber 301*d*.

After the retention chamber 301*d* is filled with urine, when new urine flows in from the inlet closing valve 303, the urine retained in the retention chamber 301*d* is discharged by being forced out from the outlet portions 301*c* on the side portion 301*a*. The urine discharged from the outlet portions 301*c* flows outside the container 301 to the drain tube WT.

The solid chemical agent 304 is composed so as to be reduced in volume as it is used. With the reduction in volume of the solid chemical agent 304, the communication port closing valve 307 placed on the chemical agent 304 moves downward in the large-diameter channel 309*c*. When the chemical agent 304 is completely consumed, a projection 307*b* provided on the lower side of the communication port closing valve 307 is fitted in the small-diameter channel 309*b* as shown in FIG. 17(B), thereby closing the small-diameter channel 309*b*, prohibiting new urine from entering the retention chamber 301*d* from the inlet portion 302*b*, and stopping delivery of urine from the trap unit 30 into the drain tube WT.

As a result of prohibiting urine from flowing into the trap unit 30 as described above, urine stays in the bowl portion 103 of the urinal body 10. A user seeing the stay of urine in the bowl portion 103 can recognize that the urinal US is in such a state that urine cannot be flowed, and refrain from using the urinal US. Thus, further worsening of the sanitary condition can be avoided. Also, a cleaning worker or the like is caused to recognize the time to perform a replacement operation for replenishment with the chemical agent, thus enabling prevention of urine having no chemical agent 304 dissolved therein from flowing into the drain tube WT, and protection of the drain tube WT.

Figure 18:
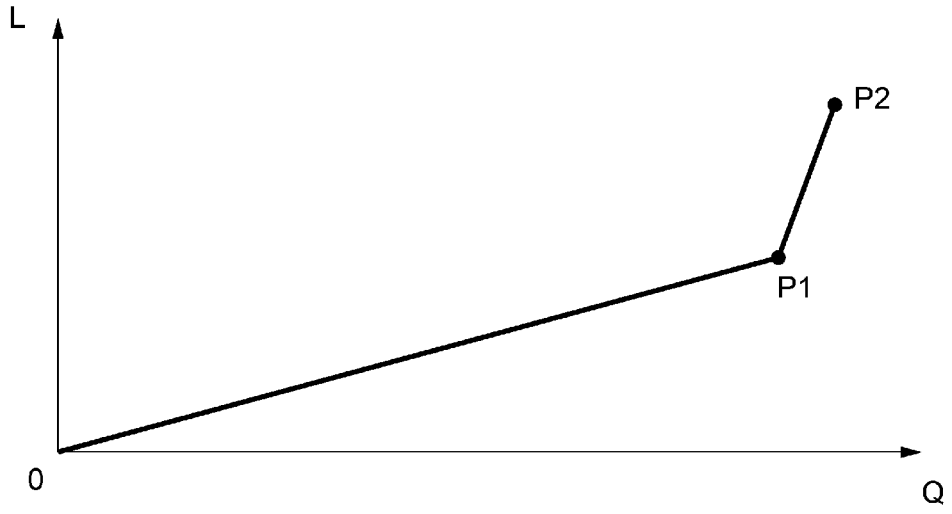
FIG. 18 is a diagram for explaining dissolution of a chemical agent shown in FIGS. 17(A) and 17(B)

The downward movement of the communication port closing valve 307 will be described with reference to FIG. 18 as well as to FIGS. 17(A) and 17(B). FIG. 18 is a graph showing the amount of downward movement of the communication port closing valve 307.

In the graph shown in FIG. 18, the abscissa represents the amount of urine Q passed through the trap unit 30. That is, a point on the abscissa farther to the right from the origin indicates a larger amount of urine passed through the trap unit 30 as a result of use of the urinal US for a longer time period. On the other hand, the ordinate represents the amount of downward movement L of the communication port closing valve 307. That is, reference position O designates a state before a start of use of the chemical agent 304 where the communication port closing valve 307 placed on the chemical agent 304 is at the uppermost position, as shown in FIG. 17(A), and the amount of downward movement of the communication port closing valve 307 from the reference position as a result of a reduction in volume of the chemical agent 304 with use is indicated as an amount of downward movement L.

Referring to changes in the graph shown in FIG. 18, the gradient in segment P1-P2 is extremely large compared with the gradient in segment P0-P1. This is because while the first chemical agent 304*a* existing at the surface in the first and second chemical agents 304*a* and 304*b* constituting the chemical agent 304 is dissolved with priority from a state of use during the period corresponding to segment P0-P1, the second chemical agent 304*b* covered with the first chemical agent 304*a* in the preceding period is dissolved with priority during the period corresponding to segment P1-P2.

In an initial stage of use of the chemical agent 304, the first chemical agent 304*a* dissolved at a comparatively low rate in urine is dissolved with priority and, therefore, the reduction in volume of the chemical agent 304 with respect to the amount of urine Q passed through the trap unit 30 is comparatively moderate. In contrast, in a later stage of use of the chemical agent 304, the second chemical agent 304*b* covered with the first chemical agent 304*a* is exposed as a result of dissolution of the first chemical agent 304*a*, and dissolution of the second chemical agent 304*b* at a comparatively high rate in urine is started. The reduction in volume of the chemical agent 304*b* is thereby accelerated with respect to the amount of urine Q passed through the trap unit 30. Correspondingly, the downward movement of the communication port closing valve 307 is also accelerated.

In the trap unit 30 shown in FIG. 18, if the rate of consumption of the chemical agent 304 is constant, the speed of downward movement of the communication port closing valve 307 is also constant with respect to usage. In such a case, the channel sectional area of the transport channel for urine in the large-diameter channel 309*c* is gradually reduced and the urine transportability is gradually degraded. If the transportability is gradually degraded in this way, a user seeing the change in transportability may misconstrue the cause of the change as the completion of consumption of the chemical agent 304 while the chemical agent 304 still remains. Such mistaking of the consumption of the chemical agent leads to unnecessary replacement of the trap unit 30 and the chemical agent 304 for replenishment with the chemical agent.

The chemical agent 304 in the present embodiment is of a simple composition formed of the first chemical agent 304*a* and the second chemical agent 304*b* but dissolves faster in the latter stage of use than in the initial stage of use to rapidly reduce the flow channel sectional area of the transport channel, thus enabling prevention of a user's mistake such as described above while maintaining high urine transportability till a time immediately before the complete consumption of the chemical agent 304.

Control operations in the urinal US in the present embodiment will now be described with reference to FIG. 19. FIG. 19 is a flowchart showing operations for control of bowl portion sterilization in the urinal US. In the urinal US in the present embodiment, a combination of a selection from the above-described "standby mode", "first bowl portion sterilization mode", "second bowl portion sterilization mode", "third bowl portion sterilization mode", "trap closing mode", "gradual dissolution mode", "trap replacement mode", "drain tube sterilization mode" and "bowl portion drying mode" is made and executed as desired by considering use conditions and bacteria multiplication conditions.

In step S01, the CPU 211 determines whether or not the urinal US is being used. When the human body detection signal is output from the human body detection sensor 102, the CPU 211 determines that the urinal US is being used. When the human body detection signal is not output from the human body detection sensor 102, the CPU 211 determines that the urinal US is not being used. If the CPU 211 determines that the urinal US is being used, it proceeds to processing in step S10. If the CPU 211 determines that the urinal US is not being used, it proceeds to processing in step S02.

In step S10, the CPU 211 forcibly executes the "standby mode". If the urinal US is being used by a user, water ejected from the nozzle unit 202 is sprayed on the user. To avoid the occurrence of such a state, the CPU 211 executes the "standby mode" in which no cleaning and sterilizing operation is performed.

In step S02, the CPU 211 determines whether or not the average room temperature in the last two hours is equal to or higher than 25° C. This determination is made for the purpose of performing processing for increasing the sterilization frequency if the average room temperature is equal to or higher than 25° C., because the multiplication of bacteria is promoted under such a condition. While a determination is made with respect to the average room temperature in the present embodiment, it is also preferable to check, for example, whether or not the present season is summer as a determination criterion. If the average room temperature is equal to or higher than 25° C., the process proceeds to processing in step S03. If the average room temperature is lower than 25° C., the process proceeds to processing in step S11.

In step S03, the CPU 211 determines whether or not two hours have passed from the preceding bowl sterilization. If the average room temperature is lower than 25° C., and if two hours have not passed from the preceding bowl sterilization, the extent of multiplication of bacteria is not so large. On the other hand, if the average room temperature is equal to or higher than 25° C., and if two hours have passed from the preceding bowl sterilization, the multiplication of bacteria progresses considerably. Therefore, the determination as to whether or not two hours have passed from the preceding bowl sterilization is made.

The fact that cleaning each time the urinal is used, as in the case of the conventional flush urinal, is not always necessary, and that performing cleaning at certain time intervals suffices will be described with reference to FIGS. 22, 23, 24, 25, and 26.

Figure 22:
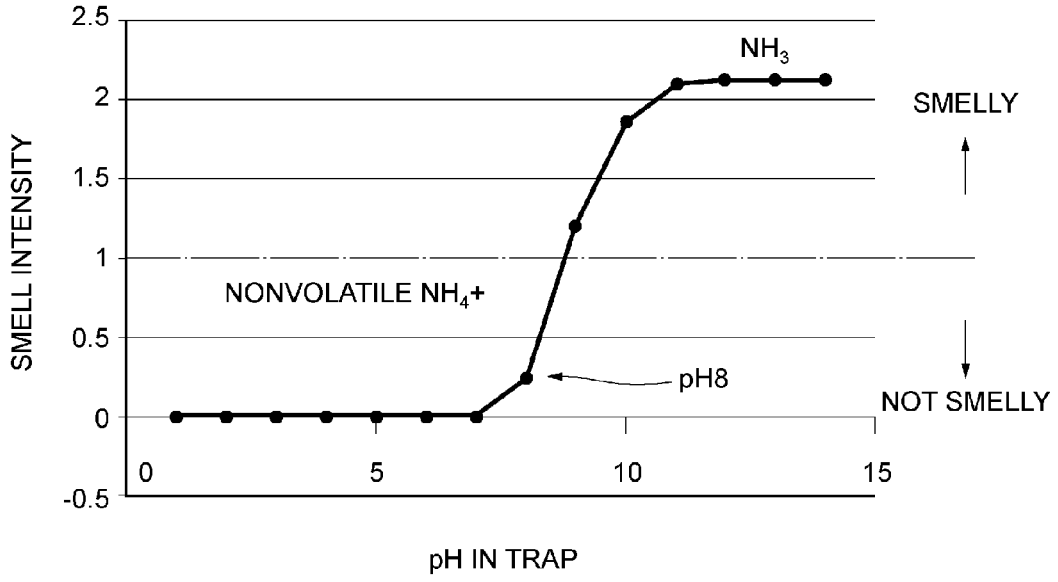
FIG. 22 is a diagram showing the correlation between pH and the intensity of a smell.

FIG. 22 is a diagram for explaining the correlation between pH and the intensity of a smell. In FIG. 22, the abscissa represents pH in the trap and the ordinate represents the intensity of a smell. When the smell intensity exceeds 1, the level of a smell is so high that the smell can be recognized. As shown in FIG. 22, nonvolatile $NH_4^+$ is dominant when pH is not higher than 8, and volatile $NH_3^+$ is dominant when pH exceeds 8. From this, it can be understood that limiting pH in the trap to 8 or less is necessary for smell suppression.

Figure 23:
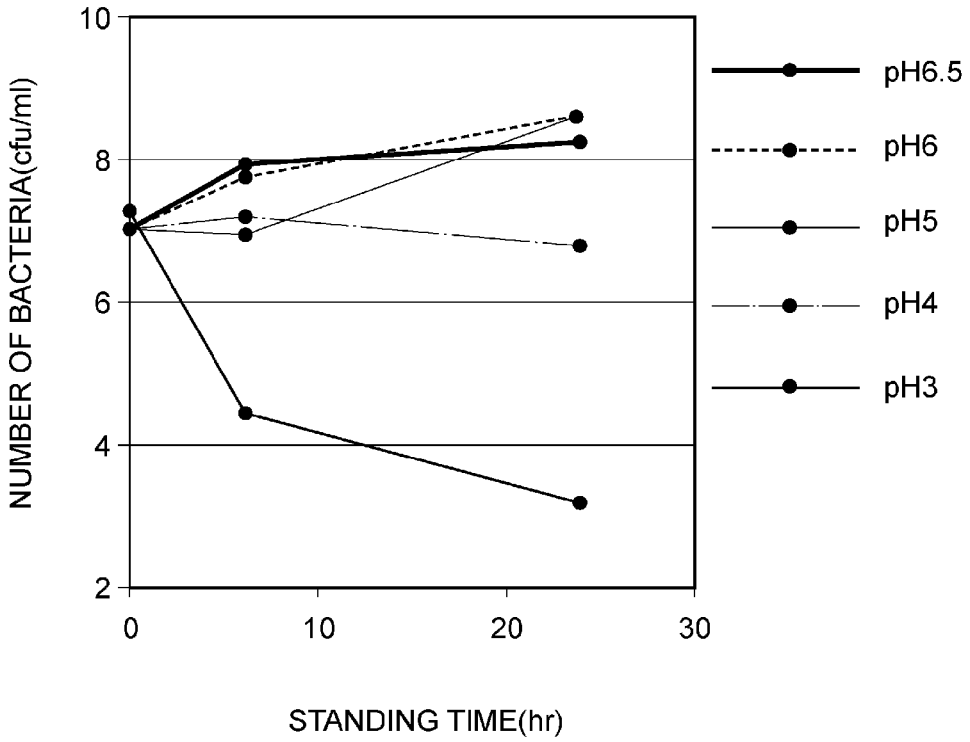
FIG. 23 is a diagram showing the correlation between pH and the number of bacteria.

FIG. 23 is a diagram for explaining the correlation between pH and the number of bacteria. In FIG. 23, the abscissa represents the standing time and the ordinate represents the number of bacteria, showing changes in the number of bacteria with respect to pH. It can be understood that the number of bacteria is not increased with passage of time if pH is limited to 4 or less, as shown in FIG. 23.

Figure 24:
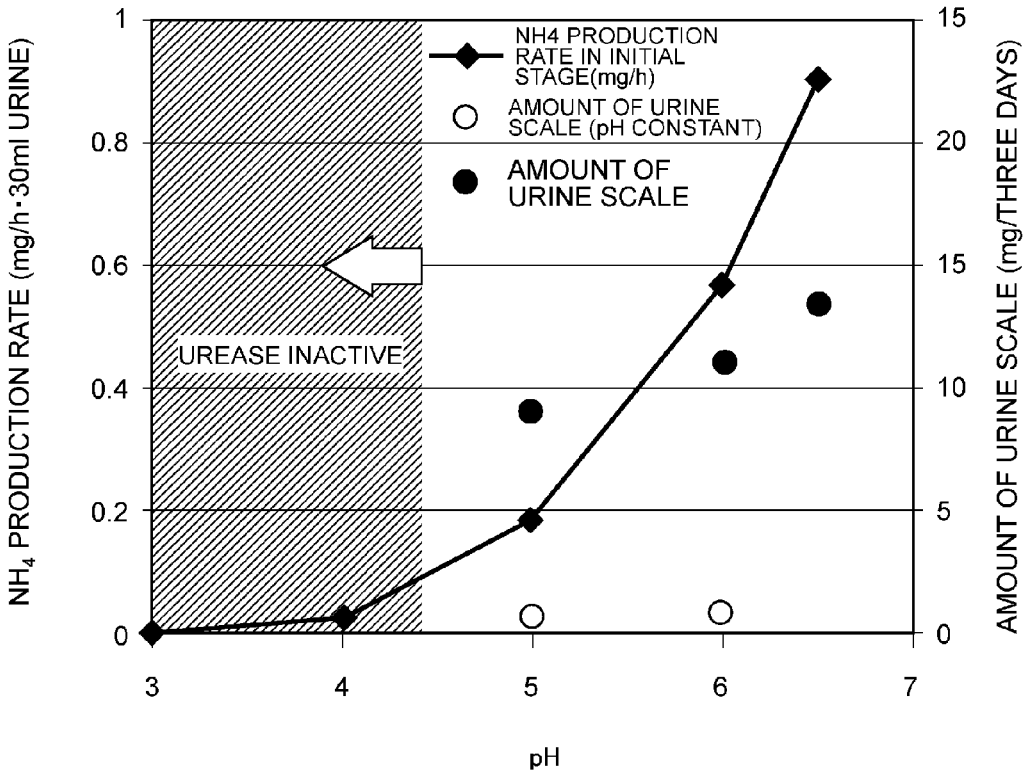
FIG. 24 is a diagram showing the correlation between pH and the amount of urine scale.

FIG. 24 is a diagram for explaining the correlation between pH and the amount of urine scale. In FIG. 24, the abscissa represents pH and the ordinate represents the rate of production of $NH_4$. It can be understood that when pH is not higher than 4.5, urease is inactive, the production of ammonia is inhibited and the production of urine scale is also inhibited, as shown in FIG. 24.

Figure 25:
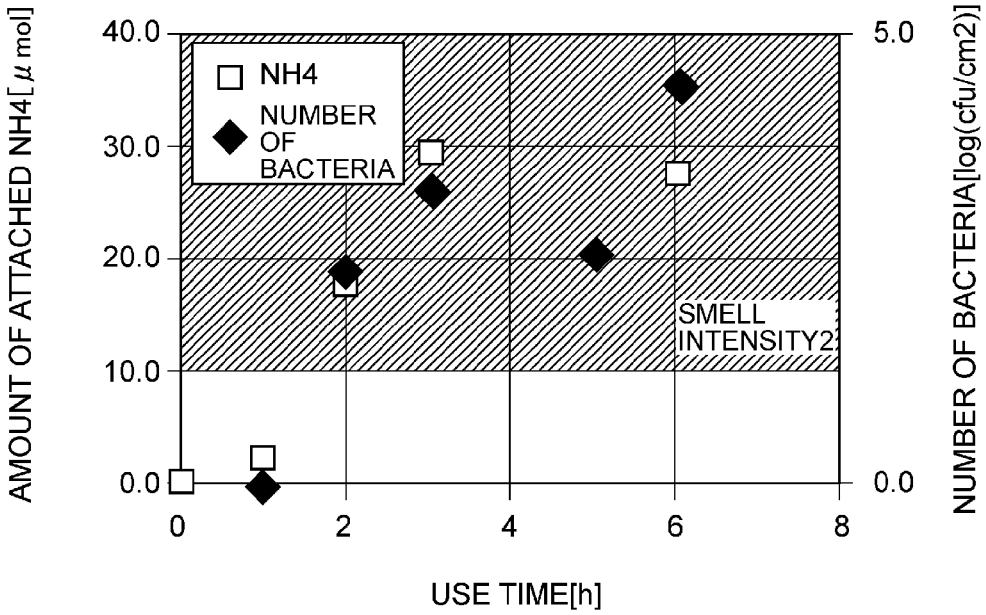
FIG. 25 is a diagram showing changes in the number of bacteria and the amount of attached ammonia on the urinal surface with respect to time.

FIG. 25 is a diagram for explaining changes in the amounts of bacteria and ammonia attached to the urinal surface with respect to time. In FIG. 25, the abscissa represents the use time and the ordinates represent the amount of $NH_4$ attached and the number of bacteria. It can be understood that while urine is attached to the urinal surface, the amount of $NH_4$ attached and the number of bacteria are not so increased as to increase the smell intensity to 2 or higher if the use time is no longer than two hours, as shown in FIG. 25.

Figure 26:
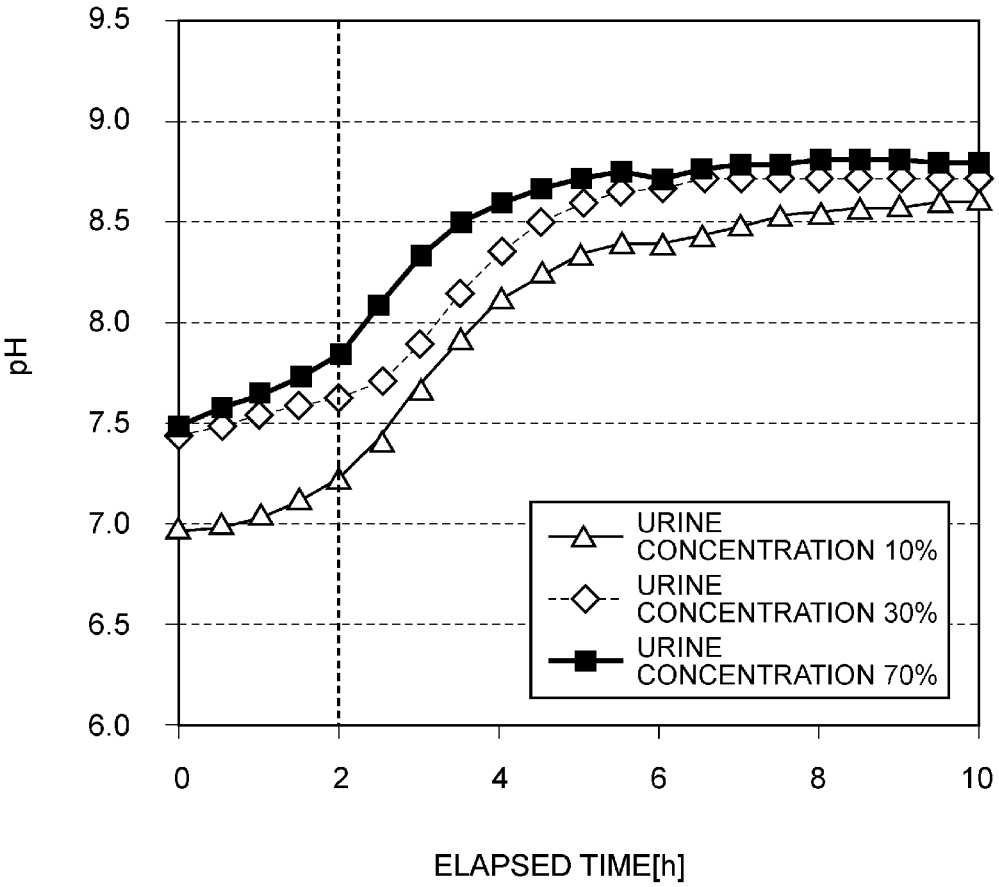
FIG. 26 is a diagram showing changes in pH with respect to time in a case where bacteria are added to urine.

FIG. 26 is a diagram for explaining changes in pH with passage of time in a case where bacteria are added to urine. In FIG. 26, the abscissa represents elapsed time and the ordinate represents changes in pH. It can be understood that pH is lower than 8 if the elapsed time is no longer than two hours, as shown in FIG. 26, and that no significant increase in smell intensity is observed, as described above with reference to FIG. 22.

From the above description with reference to FIGS. 22 to 26, it can be understood that it is preferable to limit pH in the water seal formed by urine to 4 or less and to perform limiting of pH to such a value at intervals of about two hours.

The description of step S03 is resumed by referring again to FIG. 19. If the average room temperature is equal to or higher than 25° C., and if the lapse of time from the preceding bowl sterilization is shorter than two hours, any sterilizing operation is not presently required and, therefore, the process returns by making a transition into the "standby mode". If the average room temperature is equal to or higher than 25° C., and if two hours have passed from the preceding bowl sterilization, the process proceeds to processing in step S04.

On the other hand, in step S11, which is processing to be performed in the case where the average room temperature is lower than 25° C., the CPU 211 determines whether or not three hours have passed from the preceding bowl sterilization. This is because the extent of multiplication of bacteria is not considerably larger if the average room temperature is lower than 25° C., and if three hours have not passed from the preceding bowl sterilization. If the average room temperature is lower than 25° C., and if three hours have not passed from the preceding bowl sterilization, any sterilizing operation is not presently required and, therefore, the process returns by making a transition into the "standby mode". If the average room temperature is lower than 25° C., and if three hours have passed from the preceding bowl sterilization, the process proceeds to processing in step S04.

In step S04, the CPU 211 energizes the electrolysis unit 213 to start producing hypochlorous acid. In step S05 following step S04, the CPU 211 determines whether or not the number of users is equal to or larger than ten. It is thought that when the number of users exceeds a certain number, the water seal in the trap unit 30 is replaced with new urine and the extent of multiplication of bacteria is not so large. On the other hand, it is inferred that urine is scattered and attached to side portions of the bowl portion 103, particularly to side portions of the standing wall portion 104, and that such side portions can be places suitable for multiplication of bacteria. Therefore, if the number of users is equal to or larger than ten, the process proceeds to processing in step S12. If the number of users is smaller than ten, the process proceeds to processing in step S06.

In step S12, the CPU 211 executes the "third bowl portion sterilization mode". In step S13 following step S12, the CPU 211 executes the "bowl portion drying mode" for ten minutes after an interval of ten minutes after the execution of the "third bowl portion sterilization mode". During the execution of the "bowl portion drying mode", the warning lamp 220 is lit.

In step S06, the CPU 211 determines whether or not the number of users is zero. This is because if the number of users is zero, the possibility of the contamination having progressed is high. If the number of users is zero, the process proceeds to processing in step S07. If the number of users is not zero, the process proceeds to processing in step S14.

In step S07, the CPU 211 determines whether or not eight hours have passed from the last bowl portion sterilization. This is because if the number of users is zero and if eight hours have passed from the last bowl portion sterilization, there is a possibility of the urinal being used during a low-frequency use time period such as a night time and the multiplication of bacteria progressing. If eight hours have not passed from the last bowl portion sterilization, the process returns. If eight hours have passed from the last bowl portion sterilization, the process proceeds to processing in step S08.

In step S08, the CPU 211 executes the "third bowl portion sterilization mode". Thereafter, bowl portion sterilization is not performed until the urinal is used.

In step S09 following step S08, the CPU 211 executes the "bowl portion drying mode" for thirty minutes after an interval of ten minutes after the execution of the "third bowl portion sterilization mode". During the execution of the "bowl portion drying mode", the warning lamp 220 is lit.

In step S14, the CPU 211 determines whether or not the number of users is equal to or smaller than three. If the number of users is equal to or smaller than three, the process proceeds to processing in step S15. If the number of users is larger than three, the process proceeds to processing in step S18.

In step S15, the CPU 211 determines whether or not the preceding bowl portion sterilization is the execution of the "first bowl portion sterilization mode". This is because if the "first bowl portion sterilization mode" in which the liquid agent is not supplied to the center of the bowl portion 103 is continued, there is a possibility of bacteria in a central area and an upper area on the bowl portion 103 multiplying largely. If the preceding bowl portion sterilization is the execution of the "first bowl portion sterilization mode", the process proceeds to processing in step S18. If the preceding bowl portion sterilization is not the execution of the "first bowl portion sterilization mode", the process proceeds to processing in step S16.

In step S16, the CPU 211 executes the "first bowl portion sterilization mode". In step S17 following step S16, the CPU 211 executes the "bowl portion drying mode" for ten minutes after an interval of ten minutes after the execution of the "first bowl portion sterilization mode". During the execution of the "bowl portion drying mode", the warning lamp 220 is lit.

In step S18, the CPU 211 executes the "second bowl portion sterilization mode". In step S19 following step S18, the CPU 211 executes the "bowl portion drying mode" for ten minutes after an interval of ten minutes from the execution of the "second bowl portion sterilization mode". During the execution of the "bowl portion drying mode", the warning lamp 220 is lit.

Figure 20:
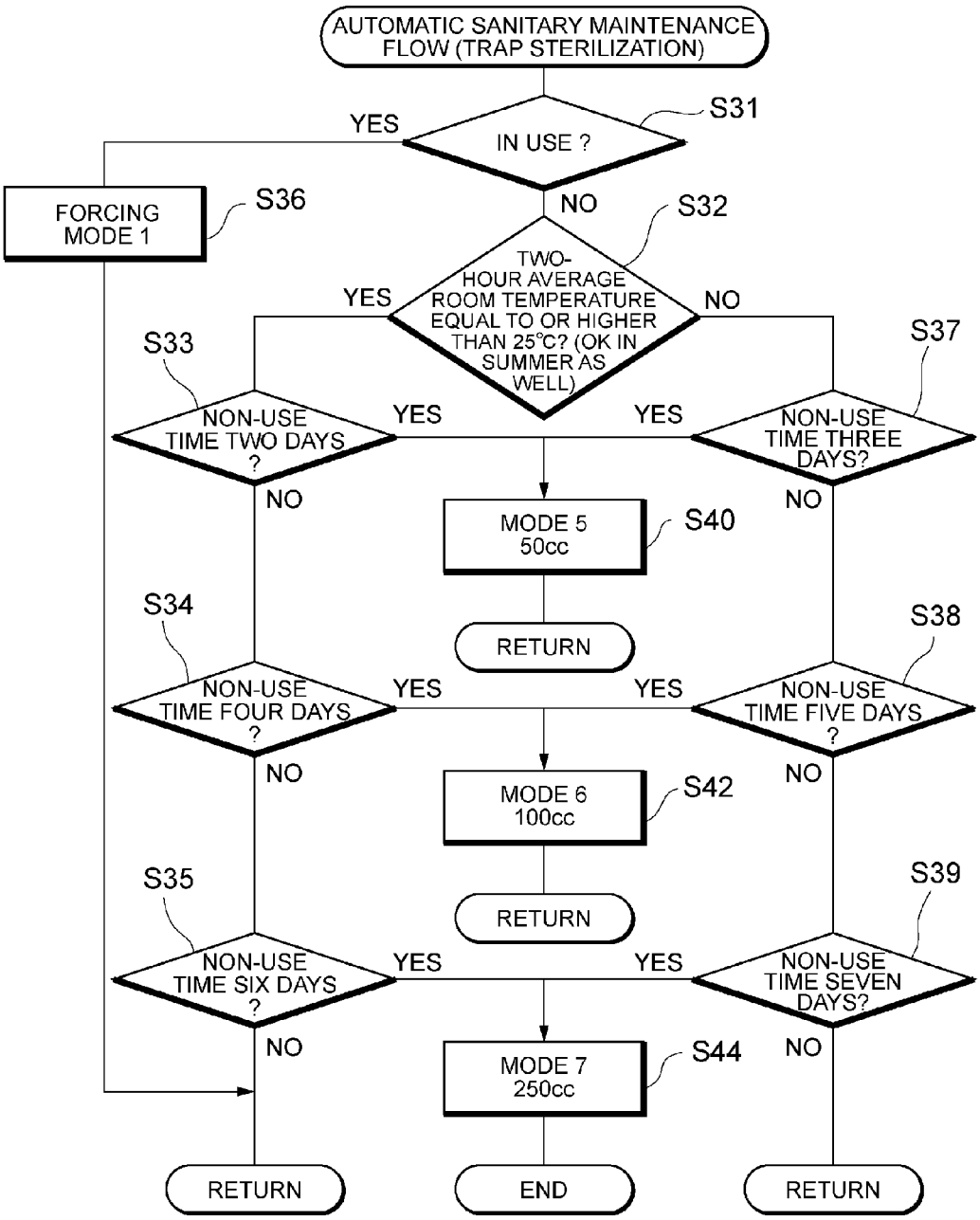
FIG. 20 is a flowchart showing the method of controlling the sanitation device shown in FIGS. 1 and 4.

Control operations in the urinal US in the present embodiment will be described with reference to FIG. 20. FIG. 20 is a flowchart showing operations for control of trap sterilization in the urinal US. In the urinal US in the present embodiment, a combination of a selection from the above-described "standby mode", "first bowl portion sterilization mode", "second bowl portion sterilization mode", "third bowl portion sterilization mode", "trap closing mode", "gradual dissolution mode", "trap replacement mode", "drain tube sterilization mode" and "bowl portion drying mode" is made and executed as desired by considering use conditions and bacteria multiplication conditions.

In step S31, the CPU 211 determines whether or not the urinal US is being used. When the human body detection signal is output from the human body detection sensor 102, the CPU 211 determines that the urinal US is being used. When the human body detection signal is not output from the human body detection sensor 102, the CPU 211 determines that the urinal US is not being used. If the CPU 211 determines that the urinal US is being used, it proceeds to processing in step S36. If the CPU 211 determines that the urinal US is not being used, it proceeds to processing in step S32.

In step S36, the CPU 211 forcibly executes the "standby mode". If the urinal US is being used by a user, water ejected from the nozzle unit 202 is sprayed on the user. To avoid the occurrence of such a state, the CPU 211 executes the "standby mode" in which no cleaning and sterilizing operation is performed.

In step S32, the CPU 211 determines whether or not the average room temperature in the last two hours is equal to or higher than 25° C. This determination is made for the purpose of performing processing for increasing the sterilization frequency if the average room temperature is equal to or higher than 25° C., because the multiplication of bacteria is promoted under such a condition. While a determination is made with respect to the average room temperature in the present embodiment, it is also preferable to check, for example, whether or not the present season is summer as a determination criterion. If the average room temperature is equal to or higher than 25° C., the process proceeds to processing in step S33. If the average room temperature is lower than 25° C., the process proceeds to processing in step S37.

In step S33, the CPU 211 determines whether or not the non-use time period has reached two days. This is because there is no need to consider scattering of urine with respect to sterilization of the trap unit 30, and because consideration of only the non-use time period therefore suffices. If the non-use time period has reached two days, the process proceeds to processing in step S40. If the non-use time period has not reached two days, the process proceeds to processing in step S34.

In step S37, the CPU 211 determines whether or not the non-use time period has reached three days. If the non-use time period has reached three days, the process proceeds to processing in step S40. If the non-use time period has not reached three days, the process proceeds to processing in step S38.

In step S40, the CPU 211 executes the "trap closing mode". The amount of water ejected in this case is 50 cc.

In step S34, the CPU 211 determines whether or not the non-use time period has reached four days. If the non-use time period has reached four days, the process proceeds to processing in step S42. If the non-use time period has not reached four days, the process proceeds to processing in step S35.

In step S38, the CPU 211 determines whether or not the non-use time period has reached five days. If the non-use time period has reached five days, the process proceeds to processing in step S42. If the non-use time period has not reached five days, the process proceeds to processing in step S39.

In step S42, the CPU 211 executes the "gradual dissolution mode". The amount of water ejected in this case is 100 cc.

In step S35, the CPU 211 determines whether or not the non-use time period has reached six days. If the non-use time period has reached six days, the process proceeds to processing in step S44. If the non-use time period has not reached six days, the process returns.

In step S39, the CPU 211 determines whether or not the non-use time period has reached seven days. If the non-use time period has reached seven days, the process proceeds to processing in step S44. If the non-use time period has not reached seven days, the process returns.

In step S44, the CPU 211 executes the "trap replacement mode". The amount of water ejected in this case is 250 cc.

Figure 21:
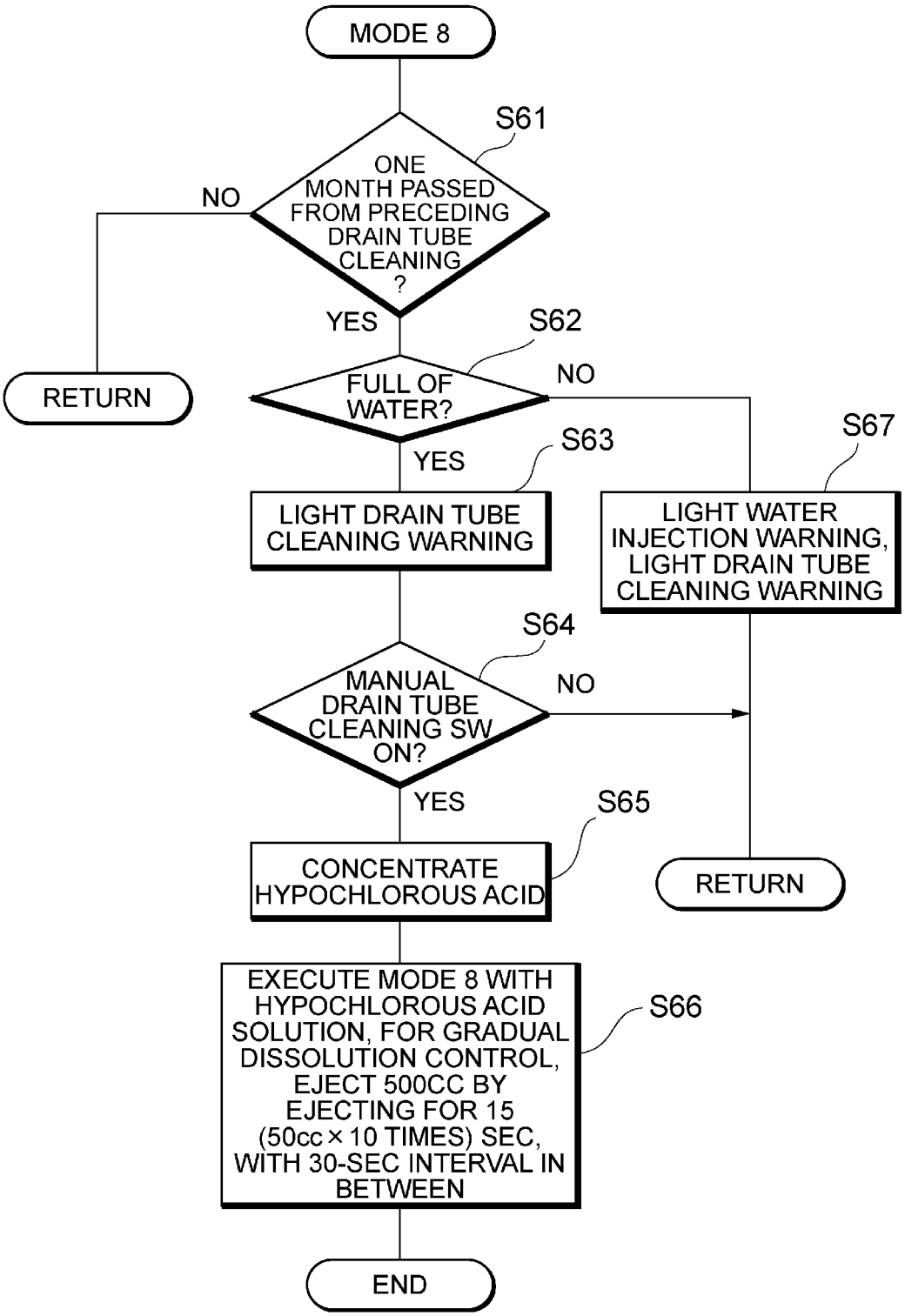
FIG. 21 is a flowchart showing the method of controlling the sanitation device shown in FIGS. 1 and 4.

Control operations in the urinal US in the present embodiment will be described with reference to FIG. 21. FIG. 21 is a flowchart showing operations for control of drain tube sterilization in the urinal US. In the urinal US in the present embodiment, a combination of a selection from the above-described "standby mode", "first bowl portion sterilization mode", "second bowl portion sterilization mode", "third bowl portion sterilization mode", "trap closing mode", "gradual dissolution mode", "trap replacement mode", "drain tube sterilization mode" and "bowl portion drying mode" is made and executed as desired by considering use conditions and bacteria multiplication conditions.

In step S61, the CPU 211 determines whether or not one month has passed from the preceding drain tube cleaning. This is because there is no need to consider scattering of urine with respect to sterilization of the drain tube WT, and because consideration of only cleaning intervals therefore suffices. If one month has passed from the preceding drain tube cleaning, the process proceeds to processing in step S62. If one month has not passed from the preceding drain tube cleaning, the process returns.

In step S62, the CPU 211 determines whether or not the liquid agent tank 212 is full of water. If the liquid agent tank 212 is full of water, the process proceeds to processing in step S63. If the liquid agent tank 212 is not full of water, the process proceeds to processing in step S67.

In step S63, the CPU 211 lights the warning lamp 220 to notify the execution of drain tube cleaning. In step S67, the CPU 211 lights the warning lamp 220 to demand injection of water into the liquid agent tank 212 and notify the execution of drain tube cleaning.

In step S64, the CPU 211 determines whether or not the operating switch 218 has been operated. If the operating switch 218 has not been operated, the process returns. If the operating switch 218 has been operated, the process proceeds to processing in step S65.

In step S65, the CPU energizes the electrolysis unit 213 to start producing hypochlorous acid.

In step S66 following step S65, the CPU 211 executes the "drain tube sterilization mode". The CPU 211 energizes the electrolysis unit 213 to produce water containing hypochlorous acid. For gradual dissolution control, ejection of water for fifteen seconds is performed at intervals of thirty seconds, thereby discharging a total of 500 cc (50 cc, ten times).

Figure 27B:
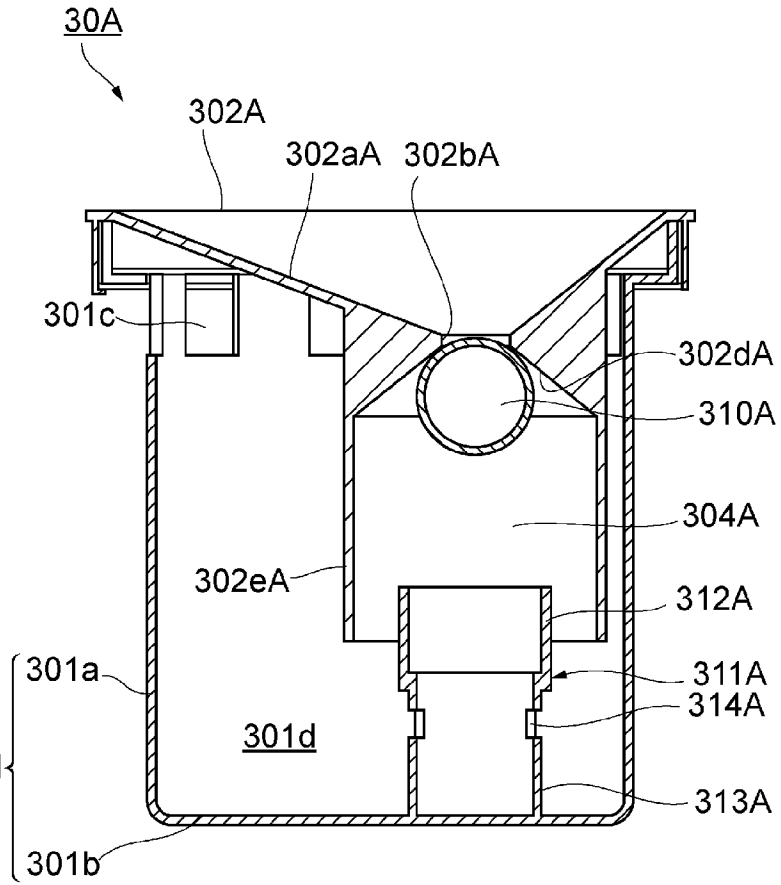
FIGS. 27(A) and 27(B) are schematic sectional views of a trap unit according to a modified example of the present embodiment.
Figure 27A:
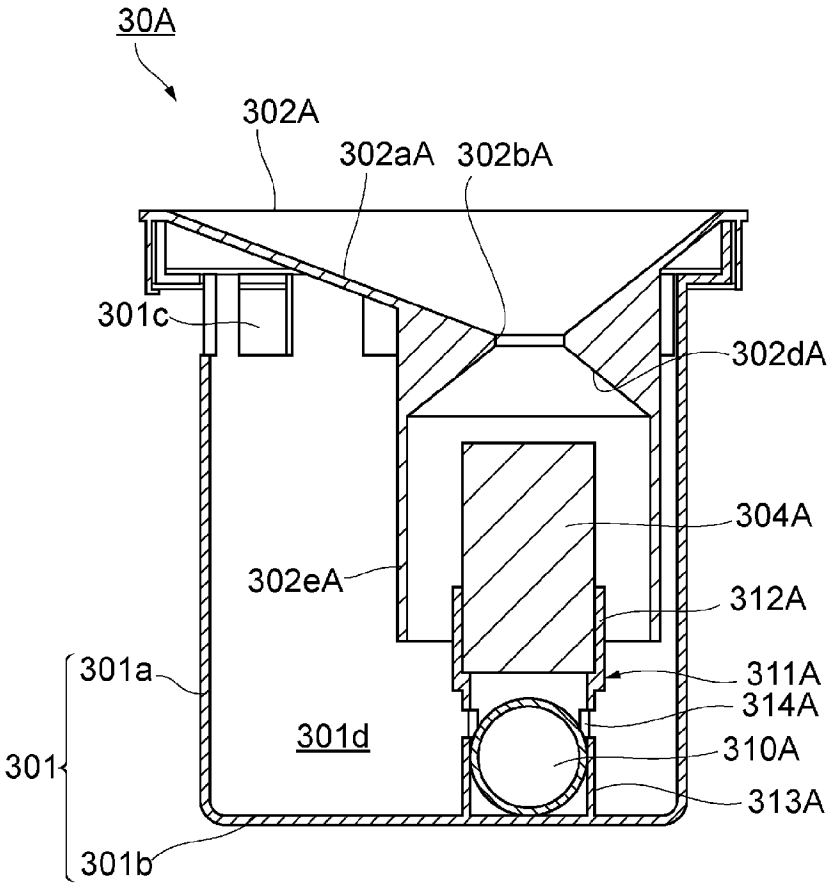

A first modified example of the trap unit in the present embodiment will be described with reference to FIGS. 27(A) and 27(B). FIGS. 27(A) and 27(B) are schematic sectional views showing the construction of a modified example trap unit 30A. FIG. 27(A) shows an initial state before a chemical agent 304A starts dissolving. FIG. 27(B) shows a state after the completion of dissolution of the chemical agent 304A.

As shown in FIG. 27(A), the trap unit 30A has a container 301 and a cover 302A. The container 301 has a side portion 301*a* and a bottom portion 301*b*. The bottom portion 301*b* is a portion in the form of a circular plate. The side portion 301*a* is a cylindrical portion formed so as to rise in one direction from the periphery of the bottom portion 301*b*. The bottom portion 301*b* and the side portion 301*a* thus form the shape of a cylinder closed at its bottom as the shape of the container 301, and form therein a retention chamber 301*d* capable of retaining a liquid. A plurality of outlet portions 301*c* are formed at an upper position on the side portion 301*a* at intervals along the circumferential direction of the side portion 301*a*. The outlet portions 301*c* provide communication between the inside and outside of the container 301.

The cover 302A is provided on the container 301. The cover 302A has a sloped wall 302*a*A, an inlet portion 302*b*A, a cylindrical partition wall 302*c*A, and a lower sloped wall 302*d*A. The sloped wall 302*a*A is sloped so as to extend toward the inlet portion 302*b*A opened at a lower position. The cylindrical partition wall 302*c*A extends opposite from the sloped wall 302*a*A from the periphery of the inlet portion 302*b*A. The lower sloped wall 302*d*A formed so as to expand downward from the inlet portion 302*b*A is provided below the inlet portion 302*b*A.

A chemical agent holder 311A extends from the bottom portion 301*b* of the container 301 toward the cover 302A. The chemical agent holder 311A is formed so as to project to the inside of the cylindrical partition wall 302*c*A.

The chemical agent holder 311A has a float holding portion 313A and a chemical agent holding portion 312A. The chemical agent holding portion 312A is formed so as to hold the cylindrical chemical agent 304A. The float holding portion 313A is provided below the chemical agent holding portion 312A. The float holding portion 313A is a portion for holding a float 310A. A liquid inflow opening 314A is formed at the upper end of the float holding portion 313A.

Urine discharged from the bottom surface opening portion 106 of the urinal US comes to the trap unit 30A and is collected at the inlet portion 302*b*A by the sloped upper surface of the sloped wall 302*a*A. The collected urine flows from the inlet portion 302*b*A to the inside of the cylindrical partition wall 302*c*A.

The collected urine having flowed to the inside of the cylindrical partition wall 302*c*A directly hits the chemical agent 304A placed below. The chemical agent 304A dissolves by contact with the urine. The urine is retained in the retention chamber 301*d*.

After the retention chamber 301*d* is filled with urine, when new urine flows in from the inlet portion 302*b*A, the urine retained in the retention chamber 301*d* is discharged by being forced out from the outlet portions 301*c* on the side portion 301*a*. The urine discharged from the outlet portions 301*c* flows outside the container 301 to the drain tube WT.

The solid chemical agent 304A is composed so as to be reduced in volume as it is used. When the chemical agent 304A is completely consumed with the advancement of this reduction in volume, the float 310A floats up to close the inlet portion 302*b*A (see FIG. 27(B)). After the inlet portion 302*b*A has been closed in this way, urine cannot flow into the trap unit 30A; urine stays in the bowl portion 103 of the urinal body 10. A user seeing the stay of urine in the bowl portion 103 can recognize that the urinal US is in such a state that urine cannot be flowed, and refrain from using the urinal US. Thus, further worsening of the sanitary condition can be avoided. Also, a cleaning worker or the like is caused to recognize the time to perform a replacement operation for replenishment with the chemical agent, thus enabling prevention of urine having no chemical agent 304A dissolved therein from flowing into the drain tube WT, and protection of the drain tube WT.

Figure 28B:
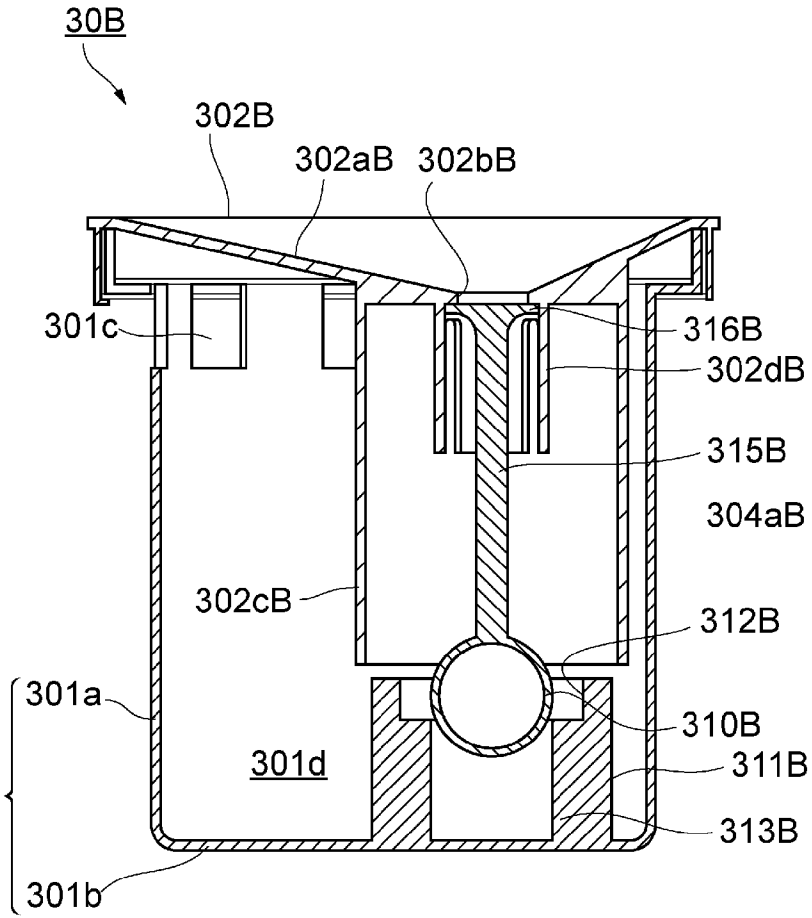
FIGS. 28(A) and 28(B) are schematic sectional views of a trap unit according to another modified example of the present embodiment.
Figure 28A:
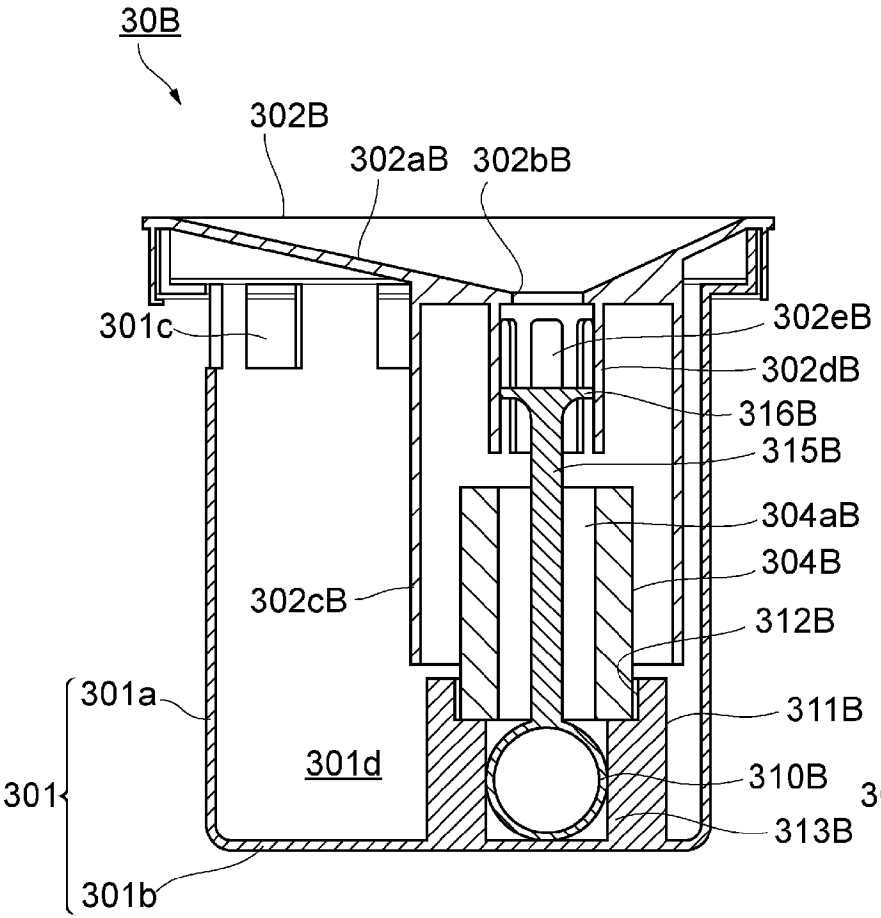

A second modified example of the trap unit in the present embodiment will be described with reference to FIGS. 28(A) and 28(B). FIGS. 28(A) and 28(B) are schematic sectional views showing the construction of a modified example trap unit 30B. FIG. 28(A) shows an initial state before a chemical agent 304B starts dissolving. FIG. 28(B) shows a state after the completion of dissolution of the chemical agent 304B.

As shown in FIG. 28(A), the trap unit 30B has a container 301 and a cover 302B. The container 301 has a side portion 301*a* and a bottom portion 301*b*. The bottom portion 301*b* is a portion in the form of a circular plate. The side portion 301*a* is a cylindrical portion formed so as to rise in one direction from the periphery of the bottom portion 301*b*. The bottom portion 301*b* and the side portion 301*a* thus form the shape of a cylinder closed at its bottom as the shape of the container 301, and form therein a retention chamber 301*d* capable of retaining a liquid. A plurality of outlet portions 301*c* are formed in an upper portion on the side portion 301*a* at intervals along the circumferential direction of the side portion 301*a*. The outlet portions 301*c* provide communication between the inside and outside of the container 301.

The cover 302B is provided on the container 301. The cover 302B has a sloped wall 302*a*B, an inlet portion 302*b*B, a cylindrical partition wall 302*c*B, and downward projections 302*d*B. The sloped wall 302*a*B is sloped so as to extend toward the inlet portion 302*b*B opened in a lower portion. The cylindrical partition wall 302*c*B extends opposite from the sloped wall 302*a*B from outside the edge of the inlet portion 302*b*B. The downward projections 302*d*B are provided below the inlet portion 302*b*B so as to extend vertically downwardly from the inlet portion 302*b*B. A plurality of the downward projections 302*d*B are provided so as to surround the inlet portion 302*b*B. A gap 302*e*B is formed between each adjacent pair of the downward projections 302*d*B.

A chemical agent holder 311B extends from the bottom portion 301*b* of the container 301 toward the cover 302B. The chemical agent holder 311B is formed so as to extend toward the inside of the cylindrical partition wall 302*c*B.

The chemical agent holder 311B has a float holding portion 313B and a chemical agent holding portion 312B. The chemical agent holding portion 312B is formed so as to hold the cylindrical chemical agent 304B. The float holding portion 313B is provided below the chemical agent holding portion 312B. The float holding portion 313B is a portion for holding a float 310B.

A through hole 304*a*B is provided in the chemical agent 304B in the vicinity of a center thereof. The float 310B has a connection rod 315B for connection to a lid portion 316B. The connection rod 315B is disposed so as to pass through the through hole 304*a*B of the chemical agent 304B. The lid portion 316B is disposed so as to be surrounded by the downward projections 302*d*B.

Urine discharged from the bottom surface opening portion 106 of the urinal US comes to the trap unit 30B and is collected at the inlet portion 302*b*B by the sloped upper surface of the sloped wall 302*a*B. The collected urine flows from the inlet portion 302*b*B into the space surrounded by the downward projections 302*d*B and flows from the gaps 302*e*B to the inside of the cylindrical partition wall 302*c*B.

The urine having flowed to the inside of the cylindrical partition wall 302*c*B directly hits the chemical agent 304B placed below. The chemical agent 304B dissolves by contact with the urine. The urine is retained in the retention chamber 301*d*.

When new urine flows into the retention chamber 301*d* from the inlet portion 302*b*B after the retention chamber 301*d* has been filled with urine, the urine retained in the retention chamber 301*d* is discharged by being forced out from the outlet portions 301*c* on the side portion 301*a*. The urine discharged from the outlet portions 301*c* flows outside the container 301 to the drain tube WT.

The solid chemical agent 304B is composed so as to be reduced in volume as it is used. When the chemical agent 304B is completely consumed with the advancement of this reduction in volume, the float 310B floats up to close the inlet portion 302*b*B with the lid portion 316B (see FIG. 28(B)). After the inlet portion 302*b*B has been closed in this way, urine cannot flow into the trap unit 30B; urine stays in the bowl portion 103 of the urinal body 10. A user seeing the stay of urine in the bowl portion 103 can recognize that the urinal US is in such a state that urine cannot be flowed, and refrain from using the urinal US. Thus, further worsening of the sanitary condition can be avoided. Also, a cleaning worker or the like is caused to recognize the time to perform a replacement operation for replenishment with the chemical agent, thus enabling prevention of urine having no chemical agent 304B dissolved therein from flowing into the drain tube WT, and protection of the drain tube WT.

A third modified example of the trap unit in the present embodiment will be described with reference to FIGS.

Figure 29B:
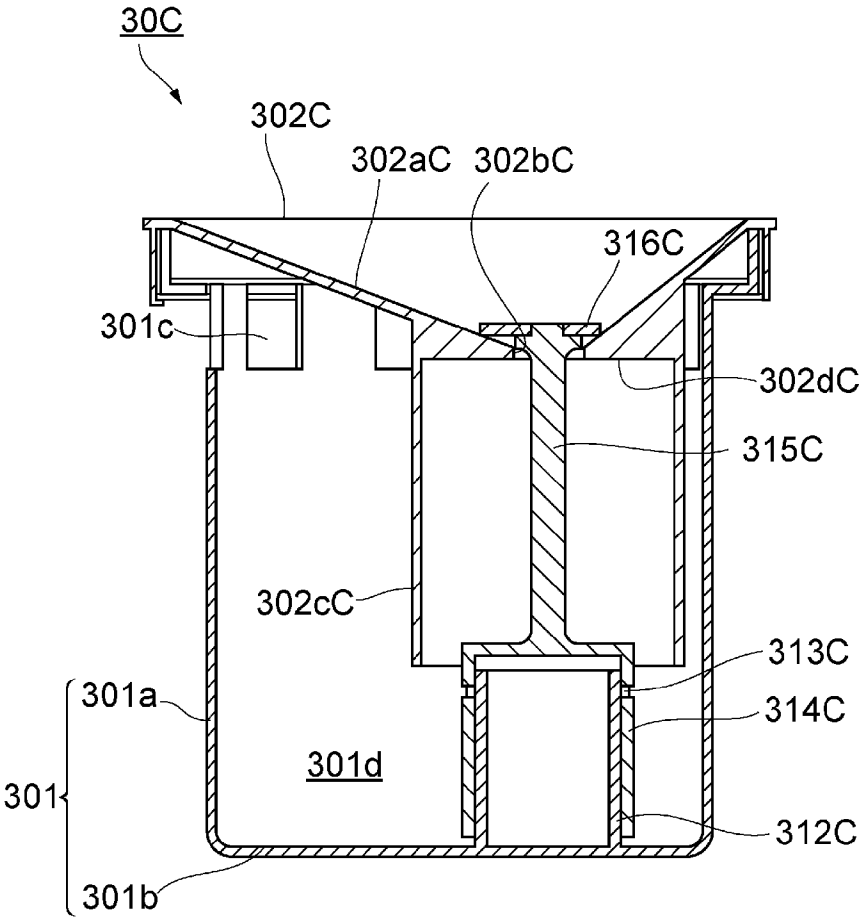
FIGS. 29(A) and 29(B) are schematic sectional views of a trap unit according to still another modified example of the present embodiment.
Figure 29A:
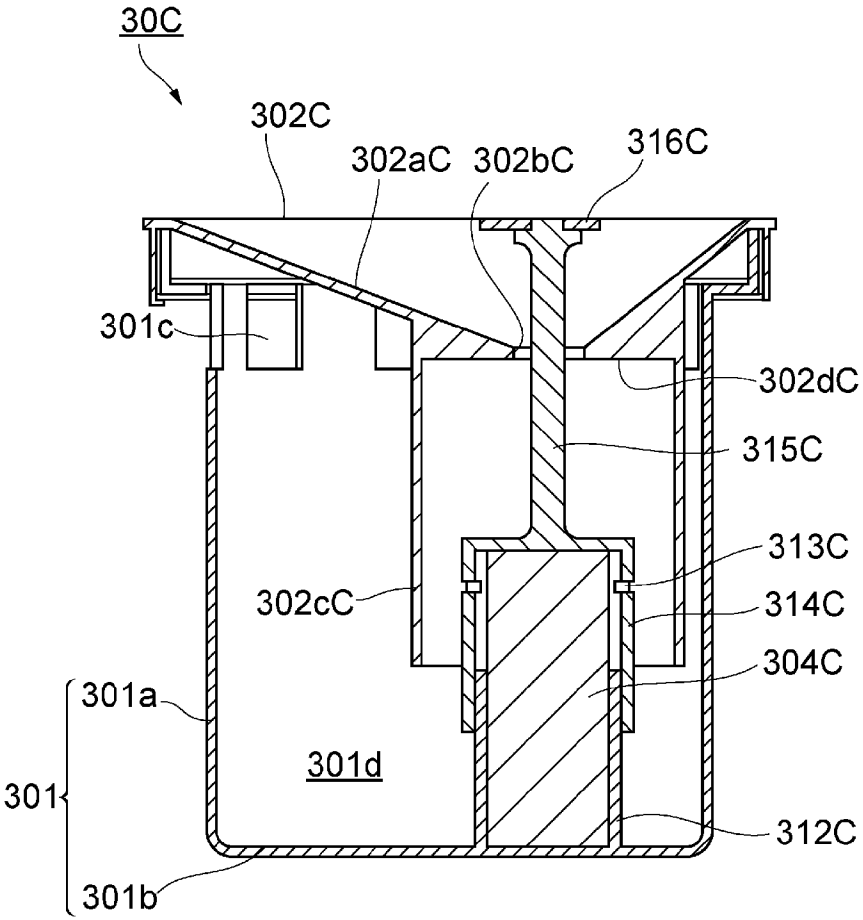

29(A) and 29(B). FIGS. 29(A) and 29(B) are schematic sectional views showing the construction of a modified example trap unit 30C. FIG. 29(A) shows an initial state before a chemical agent 304C starts dissolving. FIG. 29(B) shows a state after the completion of dissolution of the chemical agent 304C.

As shown in FIG. 29(A), the trap unit 30C has a container 301 and a cover 302C. The container 301 has a side portion 301*a* and a bottom portion 301*b*. The bottom portion 301*b* is a portion in the form of a circular plate. The side portion 301*a* is a cylindrical portion formed so as to rise in one direction from the periphery of the bottom portion 301*b*. The bottom portion 301*b* and the side portion 301*a* thus form the shape of a cylinder closed at its bottom as the shape of the container 301, and form therein a retention chamber 301*d* capable of retaining a liquid. A plurality of outlet portions 301*c* are formed in an upper portion on the side portion 301*a* at intervals along the circumferential direction of the side portion 301*a*. The outlet portions 301*c* provide communication between the inside and outside of the container 301.

The cover 302C is provided on the container 301. The cover 302C has a sloped wall 302*a*C, an inlet portion 302*b*C, a cylindrical partition wall 302*c*C, and a lower horizontal wall 302*d*C. The sloped wall 302*a*C is sloped so as to extend toward the inlet portion 302*b*C opened in a lower portion. The cylindrical partition wall 302*c*C extends opposite from the sloped wall 302*a*C from outside the edge of the inlet portion 302*b*C. The lower horizontal wall 302*d*C is provided generally horizontally from the inlet portion 302*b*C to the cylindrical partition wall 302*c*C.

A chemical agent holder 312C extends from the bottom portion 301*b* of the container 301 toward the cover 302C. The chemical agent holder 312C is formed so as to project to the inside of the cylindrical partition wall 302*c*C.

A connection rod 315C for connecting a lid portion 316C and a chemical agent placement portion 314C to each other is provided by being passed through the inlet portion 302*b*C. The lid portion 316C is disposed at a higher position relative to the inlet portion 302*b*C. Liquid inflow openings 313C are formed in the chemical agent placement portion 314C.

Urine discharged from the bottom surface opening portion 106 of the urinal US comes to the trap unit 30C and is collected at the inlet portion 302*b*C by the sloped upper surface of the sloped wall 302*a*C. The collected urine flows from the inlet portion 302*b*C to the inside of the cylindrical partition wall 302*c*C.

The urine having flowed to the inside of the cylindrical partition wall 302*c*C is retained in the retention chamber 301*d*. The urine retained in the retention chamber 301*d* flows from the liquid inflow openings 313C to the chemical agent 304C. The chemical agent 304C dissolves by contact with the urine. The urine is also retained in the retention chamber 301*d*.

When new urine flows into the retention chamber 301*d* from the inlet portion 302*b*C after the retention chamber 301*d* has been filled with urine, the urine retained in the retention chamber 301*d* is discharged by being forced out from the outlet portions 301*c* on the side portion 301*a*. The urine discharged from the outlet portions 301*c* flows outside the container 301 to the drain tube WT.

The solid chemical agent 304C is composed so as to be reduced in volume as it is used. When the chemical agent 304C is completely consumed with the advancement of this reduction in volume, the lid portion 316C, the chemical agent placement portion 314C and the connection rod 315C move downward as one integral body to close the inlet portion 302*b*C with the lid portion 316C (see FIG. 29(B)). After the inlet portion 302*b*C has been closed in this way, urine cannot flow into the trap unit 30C; urine stays in the bowl portion 103 of the urinal body 10. A user seeing the stay of urine in the bowl portion 103 can recognize that the urinal US is in such a state that urine cannot be flowed, and refrain from using the urinal US. Thus, further worsening of the sanitary condition can be avoided. Also, a cleaning worker or the like is caused to recognize the time to perform a replacement operation for replenishment with the chemical agent, thus enabling prevention of urine having no chemical agent 304C dissolved therein from flowing into the drain tube WT, and protection of the drain tube WT.

Figure 30B:
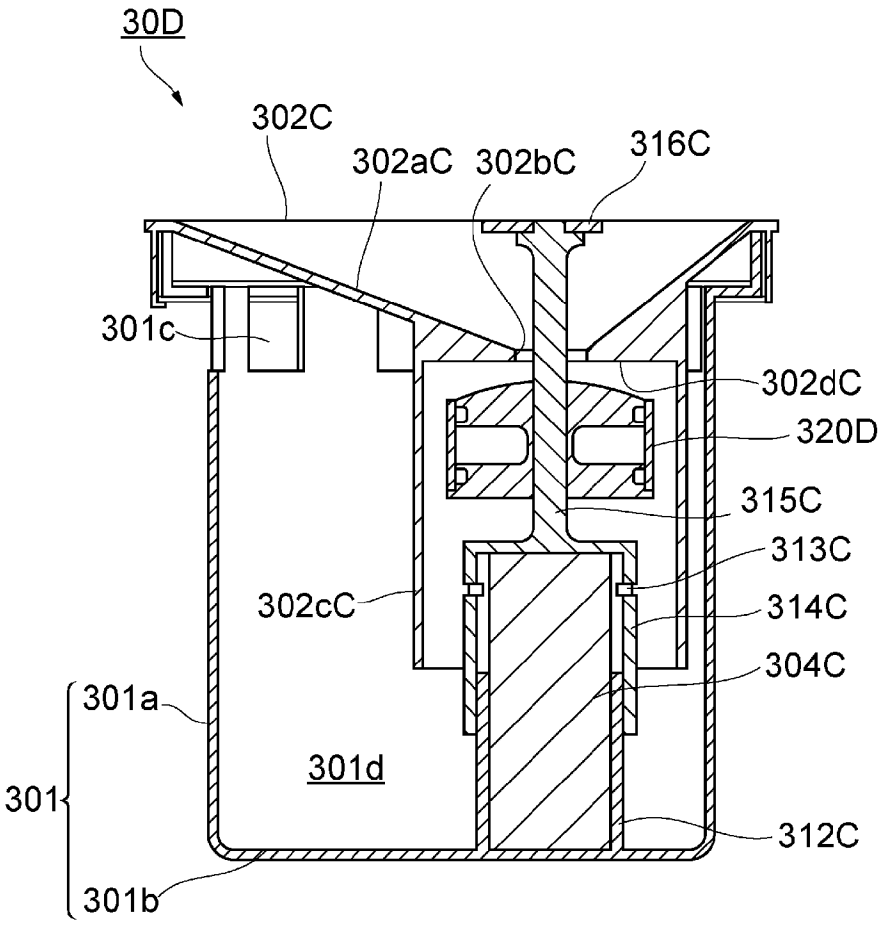
FIGS. 30(A) and 30(B) are schematic sectional views of a trap unit according to a further modified example of the present embodiment.
Figure 30A:
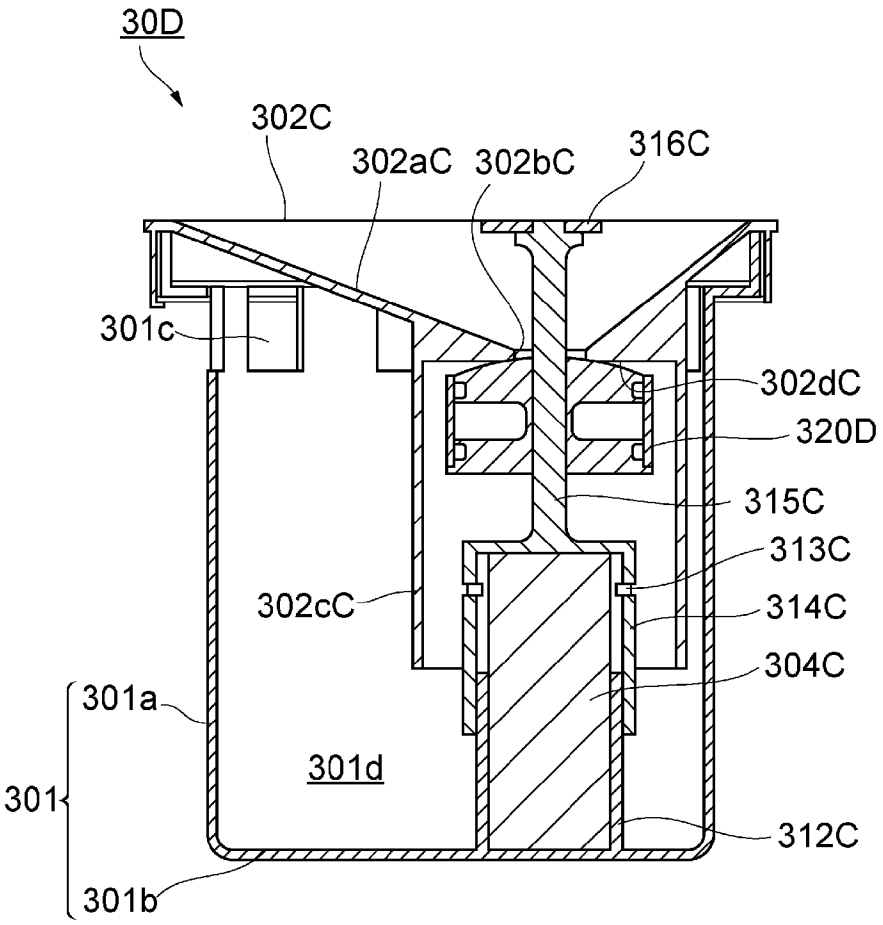

A fourth modified example of the trap unit in the present embodiment will be described with reference to FIGS. 30(A) and 30(B). FIGS. 30(A) and 30(B) are schematic sectional views showing the construction of a modified example trap unit 30D. FIG. 30(A) shows an initial state before use. FIG. 30(B) shows a state at the time of urination.

The trap unit 30D is obtained by adding an inflow limiting float 320D to the trap unit 30C described above with reference to FIGS. 29(A) and 29(B). The description of the portions common to the trap units 30C and 30D will not be repeated.

When the urinal is not used, the inflow limiting float 320D is maintained in contact with the lower horizontal wall 302*d*C, closing the inlet portion 302*b*C, as shown in FIG. 30(A).

Urine discharged from the bottom surface opening portion 106 of the urinal US comes to the trap unit 30D and is collected at the inlet portion 302*b*C by the sloped upper surface of the sloped wall 302*a*C. The collected urine presses and moves the inflow limiting float 320D downward by its weight and flows from the inlet portion 302*b*C to the inside of the cylindrical partition wall 302*c*C (see FIG. 30(B)).

The urine having flowed to the inside of the cylindrical partition wall 302*c*C is retained in the retention chamber 301*d*. The urine retained in the retention chamber 301*d* flows from the liquid inflow openings 313C to the chemical agent 304C. The chemical agent 304C dissolves by contact with the urine. The urine is also retained in the retention chamber 301*d*.

When new urine flows into the retention chamber 301*d* from the inlet portion 302*b*C after the retention chamber 301*d* has been filled with urine, the urine retained in the retention chamber 301*d* is discharged by being forced out from the outlet portions 301*c* on the side portion 301*a*. The urine discharged from the outlet portions 301*c* flows outside the container 301 to the drain tube WT.

The solid chemical agent 304C is composed so as to be reduced in volume as it is used. When the chemical agent 304C is completely consumed with the advancement of this reduction in volume, the lid portion 316C, the chemical agent placement portion 314C and the connection rod 315C move downward as one integral body to close the inlet portion 302*b*C with the lid portion 316C. After the inlet portion 302*b*C has been closed in this way, urine cannot flow into the trap unit 30D; urine stays in the bowl portion 103 of the urinal body 10. A user seeing the stay of urine in the bowl portion 103 can recognize that the urinal US is in such a state that urine cannot be flowed, and refrain from using the urinal US. Thus, further worsening of the sanitary condition can be avoided. Also, a cleaning worker or the like is caused to recognize the time to perform a replacement operation for replenishment with the chemical agent, thus enabling prevention of urine having no chemical agent 304C dissolved therein from flowing into the drain tube WT, and protection of the drain tube WT.

Figure 31:
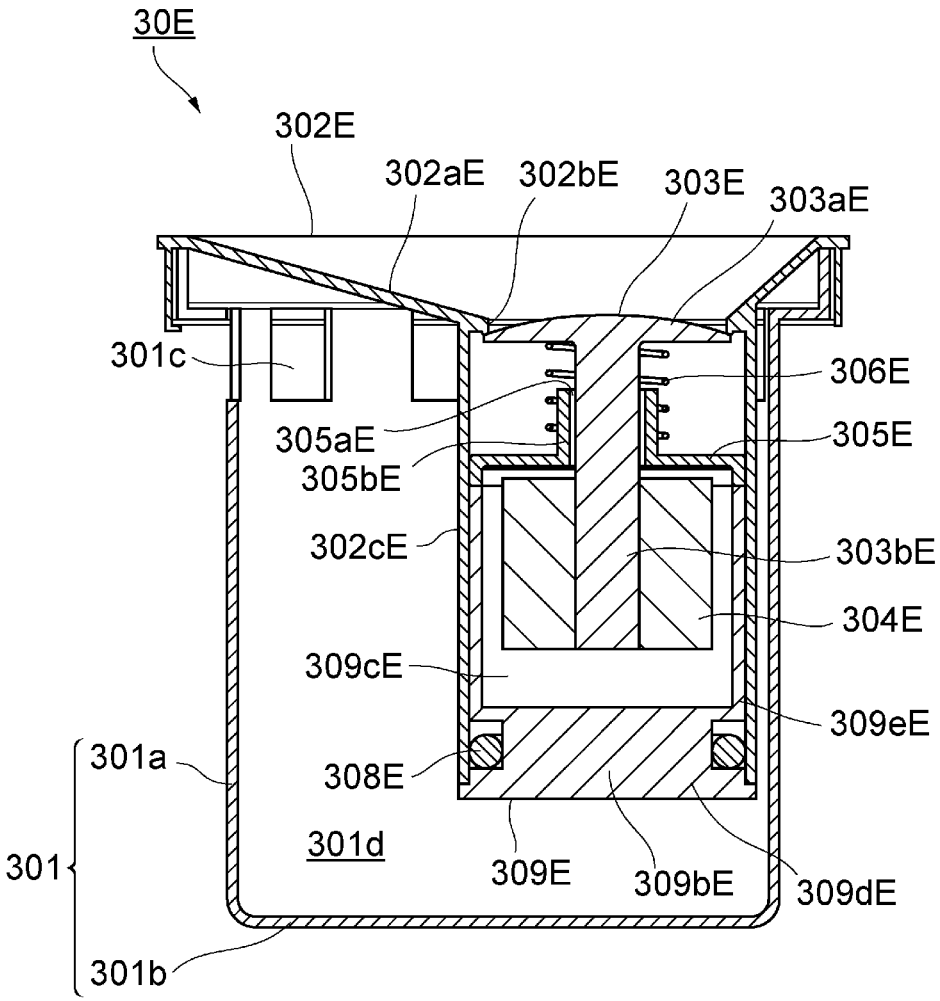
FIG. 31 is a schematic sectional view of a trap unit according to a still further modified example of the present embodiment.

A fifth modified example of the trap unit in the present embodiment will be described with reference to FIG. 31. FIG. 31 is a schematic sectional view showing the construction of a modified example trap unit 30E.

As shown in FIG. 31, the trap unit 30E has a container 301 and a cover 302E. The container 301 has a side portion 301*a* and a bottom portion 301*b*. The bottom portion 301*b* is a portion in the form of a circular plate. The side portion 301*a* is a cylindrical portion formed so as to rise in one direction from the periphery of the bottom portion 301*b*. The bottom portion 301*b* and the side portion 301*a* thus form the shape of a cylinder closed at its bottom as the shape of the container 301, and form therein a retention chamber 301*d* capable of retaining a liquid. A plurality of outlet portions 301*c* are formed in an upper portion on the side portion 301*a* at intervals along the circumferential direction of the side portion 301*a*. The outlet portions 301*c* provide communication between the inside and outside of the container 301.

The cover 302E is provided on the container 301. The cover 302E has a sloped wall 302*a*E, an inlet portion 302*b*E and a cylindrical partition wall 302*c*E. The sloped wall 302*a*E is sloped so as to extend toward the inlet portion 302*b*E opened in a lower portion. The cylindrical partition wall 302*c*E extends opposite from the sloped wall 302*a*E from the periphery of the inlet portion 302*b*E.

A socket 309E is inserted inside the cylindrical partition wall 302*c*E from below. The socket 309E has a bottom portion 309*d*E and a cylindrical portion 309*e*E. The bottom portion 309*d*E is formed so as to close the cylindrical partition wall 302*c*E at the lower end of the same. The cylindrical portion 309*e*E is formed so as to extend in one direction from the periphery of the bottom portion 309*d*E and is disposed along the inner surface of the cylindrical partition wall 302*c*E. A small-diameter channel 309*b*E is provided through the bottom portion 309*d*E generally at a center of the same.

A space surrounded by the cylindrical portion 309*e*E is formed as a large-diameter channel 309*c*E and communicates with the retention chamber 301*d* through the small-diameter channel 309*b*E. A packing 308E is interposed between the socket 309E and the cylindrical partition wall 302*c*E.

An inlet closing valve 303E, a chemical agent 304E, a pedestal 305E and a spring 306E are disposed along with the socket 309E inside the cylindrical partition wall 302*c*E.

The pedestal 305E is placed on the upper end of the socket 309E so as to cover the large-diameter channel 309*c*E from above. An upward projection 305*b*E is provided on the pedestal 305E in the vicinity of a center thereof. The upward projection 305*b*E is a cylindrical projection extending toward the inlet portion 302*b*E. A chemical agent holding rod 303*b*E of the inlet closing valve 303E is passed through the upward projection 305*b*E. A gap is formed between the upward projection 305*b*E and the chemical agent holding rod 303*b*E, thereby forming a communication passage 305*a*E.

The inlet closing valve 303E is disposed above the pedestal 305E. The inlet closing valve 303E has a valve portion 303*a*E and the chemical agent holding rod 303*b*E. The spring 306E is disposed between the pedestal 305E and the valve portion 303*a*E. With extension/contraction of the spring 306E, the valve portion 303*a*E is slidable along a top-bottom direction relative to the pedestal 305E. When no external force is exerted on the spring 306E, the spring 306E maintains the valve portion 303*a*E in abutment against a lower surface in the vicinity of the inlet portion 302*b*E, thereby closing the inlet portion 302*b*E.

The chemical agent 304E is attached to the chemical agent holding rod 303*b*E and is disposed inside the large-diameter channel 309*c*E in the socket 309E below the pedestal 305E.

Urine discharged from the bottom surface opening portion 106 of the urinal US comes to the trap unit 30E and is collected at the inlet portion 302*b*E by the sloped upper surface of the sloped wall 302*a*E. The collected urine is retained on the inlet closing valve 303E.

When the amount of urine retained on the inlet closing valve 303E reaches a predetermined value, the inlet closing valve 303E is moved downward against the urging force of the spring 306E by its weight. The inlet portion 302*b*E is thereby opened to allow the retained urine to flow to the inside of the cylindrical partition wall 302*c*E. The urine having flowed to the inside of the cylindrical partition wall 302*c*E passes through the communication passage 305*a*E in the pedestal 305E to come to the chemical agent 304E disposed below the pedestal 305E. The chemical agent 304E dissolves by contact with the urine. Further, the urine comes to the small-diameter channel 309*b*E below the chemical agent 304E. The urine flows through the small-diameter channel 309*b*E and is discharged out of the socket 309E and retained in the retention chamber 301*d*.

When new urine flows into the retention chamber 301*d* from the inlet closing valve 303E after the retention chamber 301*d* has been filled with urine, the urine retained in the retention chamber 301*d* is discharged by being forced out from the outlet portions 301*c* on the side portion 301*a*. The urine discharged from the outlet portions 301*c* flows outside the container 301 to the drain tube WT.

The solid chemical agent 304E is composed so as to be reduced in volume as it is used. When the chemical agent 304E is completely consumed with the advancement of this reduction in volume, the urging force of the spring 306E prevails over the force to move the inlet closing valve 303E downward even though urine is accumulated, and the inlet closing valve 303E is not moved downward. New urine is thereby prohibited from entering the retention chamber 301*d* from the inlet portion 302*b*E, thus stopping delivery of urine from the trap unit 30E into the drain tube WT.

As a result of prohibiting urine from flowing into the trap unit 30E as described above, urine stays in the bowl portion 103 of the urinal body 10. A user seeing the stay of urine in the bowl portion 103 can recognize that the urinal US is in such a state that urine cannot be flowed, and refrain from using the urinal US. Thus, further worsening of the sanitary condition can be avoided. Also, a cleaning worker or the like is caused to recognize the time to perform a replacement operation for replenishment with the chemical agent, thus enabling prevention of urine having no chemical agent 304E dissolved therein from flowing into the drain tube WT, and protection of the drain tube WT.

Figure 32:
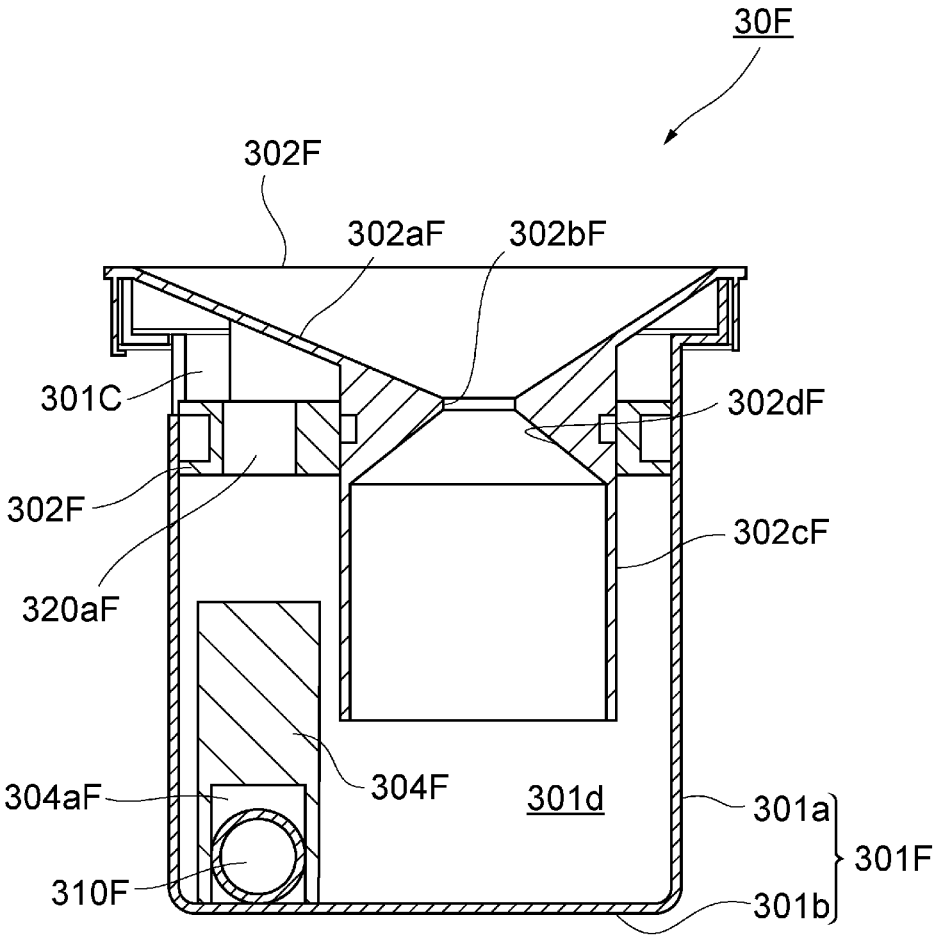
FIG. 32 is a schematic sectional view of a trap unit according to a still further modified example of the present embodiment.

A sixth modified example of the trap unit in the present embodiment will be described with reference to FIG. 32. FIG. 32 is a schematic sectional view showing the construction of a modified example trap unit 30F.

As shown in FIG. 32, the trap unit 30F has a container 301F and a cover 302F. The container 301F has a side portion 301*a* and a bottom portion 301*b*. The bottom portion 301*b* is a portion in the form of a circular plate. The side portion 301*a* is a cylindrical portion formed so as to rise in one direction from the periphery of the bottom portion 301*b*. The bottom portion 301*b* and the side portion 301*a* thus form the shape of a cylinder closed at its bottom as the shape of the container 301F, and form therein a retention chamber 301*d* capable of retaining a liquid. A plurality of outlet portions 301*c* are formed in an upper portion on the side portion 301*a* at intervals along the circumferential direction of the side portion 301*a*. The outlet portions 301*c* provide communication between the inside and outside of the container 301F. A disk member 320F is disposed below the outlet portions 301*c* inside the side portion 301*a* in contact with the inner wall surface of the side portion 301*a*. A communication hole 320*a*F is formed in the disk member 320F.

The cover 302F is provided on the container 301F. The cover 302F has a sloped wall 302*a*F, an inlet portion 302*b*F, a cylindrical partition wall 302*c*F, and a lower sloped wall 302*d*F. The sloped wall 302*a*F is sloped so as to extend toward the inlet portion 302*b*F opened in a lower portion. The cylindrical partition wall 302*c*F extends opposite from the sloped wall 302*a*F from the periphery of the inlet portion 302*b*F. The lower sloped wall 302*d*F formed so as to expand downward from the inlet portion 302*b*F is provided below the inlet portion 302*b*F.

The chemical agent 304F is disposed below the communication hole 320*a*F. In a recess 304*a*F provided in the chemical agent 304F at the lower end of the same, a float 310F is disposed.

Urine discharged from the bottom surface opening portion 106 of the urinal US comes to the trap unit 30F and is collected at the inlet portion 302*b*F by the sloped the upper surface of the sloped wall 302*a*F. The collected urine flows from the inlet portion 302*b*F to the inside of the cylindrical partition wall 302*c*F.

The urine having flowed to the inside of the cylindrical partition wall 302*c*F is retained in the retention chamber 301*d*. The urine retained in the retention chamber 301*d* contacts the chemical agent 304F disposed in the retention chamber 301*d*. The chemical agent 304F dissolves by contact with the urine.

When new urine flows into the retention chamber 301*d* from the inlet portion 302*b*F after the retention chamber 301*d* has been filled with urine, the urine retained in the retention chamber 301*d* is discharged by being forced out from the outlet portions 301*c* on the side portion 301*a*. The urine discharged from the outlet portions 301*c* flows outside the container 301F to the drain tube WT.

The solid chemical agent 304F is composed so as to be reduced in volume as it is used. When the chemical agent 304F is completely consumed with the advancement of this reduction in volume, the float 310F floats up to close the communication hole 320*a*F. After the communication hole 320*a*F has been closed in this way, urine cannot flow into the trap unit 30F; urine stays in the bowl portion 103 of the urinal body 10. A user seeing the stay of urine in the bowl portion 103 can recognize that the urinal US is in such a state that urine cannot be flowed, and refrain from using the urinal US. Thus, further worsening of the sanitary condition can be avoided. Also, a cleaning worker or the like is caused to recognize the time to perform a replacement operation for replenishment with the chemical agent, thus enabling prevention of urine having no chemical agent 304F dissolved therein from flowing into the drain tube WT, and protection of the drain tube WT.

Figure 33:
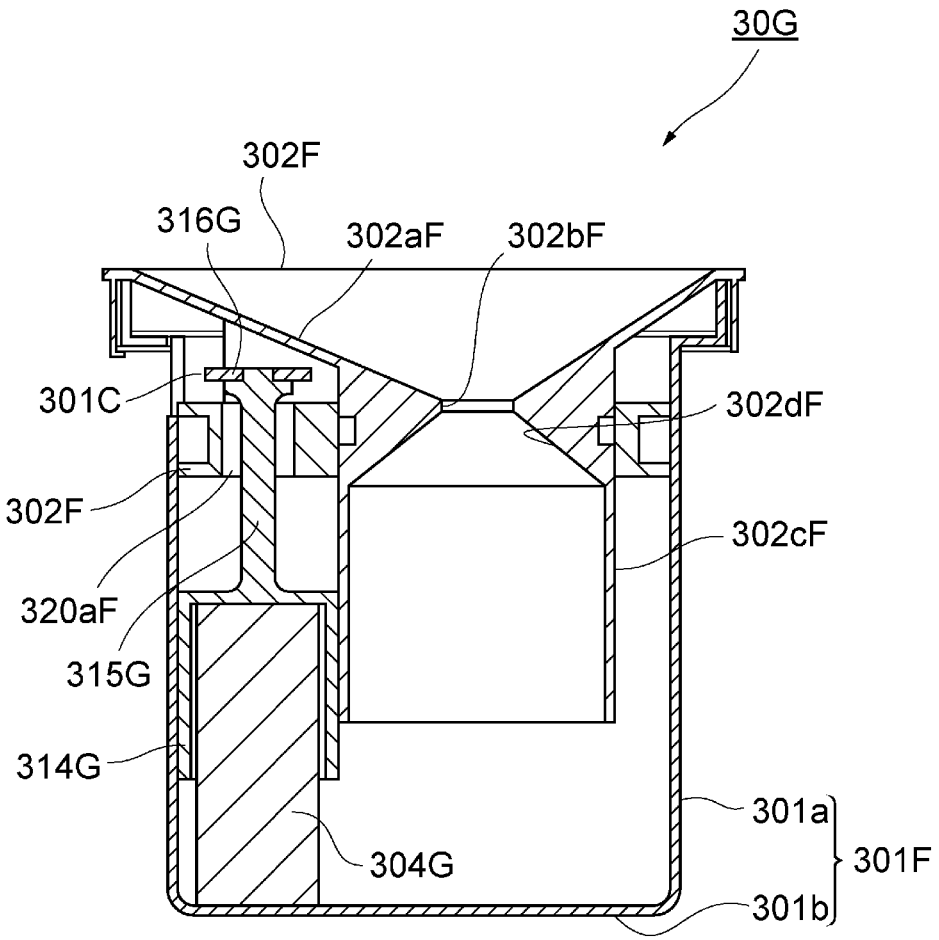
FIG. 33 is a schematic sectional view of a trap unit according to a still further modified example of the present embodiment.

A seventh modified example of the trap unit in the present embodiment will be described with reference to FIG. 33. FIG. 33 is a schematic sectional view showing the construction of a modified example trap unit 30G.

As shown in FIG. 33, the trap unit 30G has a container 301F and a cover 302F. The container 301F has a side portion 301*a* and a bottom portion 301*b*. The bottom portion 301*b* is a portion in the form of a circular plate. The side portion 301*a* is a cylindrical portion formed so as to rise in one direction from the periphery of the bottom portion 301*b*. The bottom portion 301*b* and the side portion 301*a* thus form the shape of a cylinder closed at its bottom as the shape of the container 301F, and form therein a retention chamber 301*d* capable of retaining a liquid. A plurality of outlet portions 301*c* are formed in an upper portion on the side portion 301*a* at intervals along the circumferential direction of the side portion 301*a*. The outlet portions 301*c* provide communication between the inside and outside of the container 301F. A disk member 320F is disposed below the outlet portions 301*c* inside the side portion 301*a* in contact with the inner wall surface of the side portion 301*a*. A communication hole 320*a*F is formed in the disk member 320F.

The cover 302F is provided on the container 301F. The cover 302F has a sloped wall 302*a*F, an inlet portion 302*b*F, a cylindrical partition wall 302*c*F, and a lower sloped wall 302*d*F. The sloped wall 302*a*F is sloped so as to extend toward the inlet portion 302*b*F opened in a lower portion. The cylindrical partition wall 302*c*F extends opposite from the sloped wall 302*a*F from the periphery of the inlet portion 302*b*F. The lower sloped wall 302*d*F formed so as to expand downward from the inlet portion 302*b*F is provided below the inlet portion 302*b*F.

The chemical agent 304G is disposed below the communication hole 320*a*F. A connection rod 315G for connecting a lid portion 316G and a chemical agent placement portion 314G to each other is provided by being passed through the communication hole 320*a*F. The lid portion 316G is disposed at a higher position relative to the communication hole 320*a*F. The chemical agent placement portion 314G is placed on the chemical agent 304G.

Urine discharged from the bottom surface opening portion 106 of the urinal US comes to the trap unit 30F and is collected at the inlet portion 302*b*F by the sloped upper surface of the sloped wall 302*a*F. The collected urine flows from the inlet portion 302*b*F to the inside of the cylindrical partition wall 302*c*F.

The urine having flowed to the inside of the cylindrical partition wall 302*c*F is retained in the retention chamber 301*d*. The urine retained in the retention chamber 301*d* contacts the chemical agent 304G disposed in the retention chamber 301*d*. The chemical agent 304G dissolves by contact with the urine.

When new urine flows into the retention chamber 301*d* from the inlet portion 302*b*F after the retention chamber 301*d* has been filled with urine, the urine retained in the retention chamber 301*d* is discharged by being forced out from the outlet portions 301*c* on the side portion 301*a*. The urine discharged from the outlet portions 301*c* flows outside the container 301F to the drain tube WT.

The solid chemical agent 304G is composed so as to be reduced in volume as it is used. When the chemical agent 304G is completely consumed with the advancement of this reduction in volume, the lid portion 316G, the chemical agent placement portion 314G and the connection rod 315G move downward as one integral body to close the communication hole 320*a*F with the lid portion 316G. After the communication hole 320*a*F has been closed in this way, urine cannot flow into the trap unit 30G; urine stays in the bowl portion 103 of the urinal body 10. A user seeing the stay of urine in the bowl portion 103 can recognize that the urinal US is in such a state that urine cannot be flowed, and refrain from using the urinal US. Thus, further worsening of the sanitary condition can be avoided. Also, a cleaning worker or the like is caused to recognize the time to perform a replacement operation for replenishment with the chemical agent, thus enabling prevention of urine having no chemical agent 304G dissolved therein from flowing into the drain tube WT, and protection of the drain tube WT.

While the trap units 30 in the above-described embodiment have been described as an interchangeable type, even an apparatus with a non-interchangeable trap to which the concept of the present invention is applied may favorably be used. For example, an apparatus having a chemical agent and a channel-closing float integrally disposed below an existing strainer is conceivable. When the chemical agent is completely consumed during use, the float moves upward to close the inflow opening of the strainer.

The embodiment of the present invention has been described by referring to the concrete examples thereof. However, the present invention is not limited to those concrete examples. That is, apparatuses designed by those skilled in the art making design changes to the concrete examples are included in the scope of the present invention as long as they have the features of the present invention. For example, the components provided in the above-described concrete examples and the dispositions, materials, conditions, shapes, sizes, and so on of the components can be changed as desired without being limited to the described examples. Also, combinations of selections from the components provided in the above-described embodiment and modified examples can be made if the combination is technically possible, and such combinations are also included in the scope of the present invention as long as they include the features of the present invention.

DESCRIPTION OF SYMBOLS

US: Urinal
10: Urinal body
101: Nozzle cover
102: Human body detection sensor
103: Bowl portion
104: Standing wall portion
105: Bottom surface portion
106: Bottom surface opening portion
20: Sanitation device
201: Control unit
202: Nozzle unit (the liquid agent ejection unit)
202*a*: Bowl mist nozzle
202*b*: Bowl mist nozzle
202*c*: Bowl mist nozzle
202*d*: Trap liquid nozzle
203: Bowl drying fan
211: CPU (control means)
212: Liquid agent tank
213: Electrolysis unit
214: Motor-driven pump
215: Channel-switch valve
216: Water level sensor
217: Temperature sensor
218: Operating switch
219: Power supply connector
220: Warning lamp
221: Lid
30: Trap unit
301: Container
301*a*: Side portion
301*b*: Bottom portion
301*c*: Outlet portion
301*d*: Retention chamber
302: Cover
302*a*: Sloped wall
302*b*: Inlet portion
302*c*: Cylindrical partition wall
303: Inlet closing valve
304: Chemical agent
304*a*: First chemical agent
304*b*: Second chemical agent
305: Pedestal
305*a*: Communication passage
306: Spring
307: Communication port closing valve
307*a*: Communication passage
308: Packing
309: Socket
309*a*: Projection
309*b*: Small-diameter channel
309*c*: Large-diameter channel
309*d*: Bottom portion
309*e*: Cylindrical portion

What is claimed is:

1. A urinal with a sanitation device that includes a trap unit having a liquid seal formed by urine, the entire trap unit being interchangeable, the urinal comprising:

a bowl portion including a standing wall portion facing a user and a bottom surface portion that guides urine received by the standing wall portion to a drain hole;

a trap unit that retains urine flowing in from the bowl portion to form a liquid seal, and that communicates with a drain tube, the trap unit containing a first chemical agent dissolved by contact with the urine;

a liquid agent ejection unit for ejecting a liquid agent to the trap unit for dissolving the first chemical agent within the trap unit;

a chemical liquid ejection unit for ejecting a chemical liquid containing a second chemical agent that differs from the first chemical agent to the bowl portion an use state detection unit for detecting the state of use of the urinal; and a control unit for controlling the liquid agent ejection unit on the basis of the detecting result of the use state detection unit, wherein the control unit controls the liquid agent ejection unit so that the total amount of the liquid agent flowing into the trap unit in a prescribed period is smaller when the frequency of use of the urinal is high during the prescribed period than when the frequency of use of the urinal is low during the prescribed period, and wherein the control unit controls the chemical liquid ejection unit so that a reduction in the amount of the liquid agent ejected from the liquid agent ejection unit when a transition is made from a state where the frequency of use of the urinal is low to a state where the frequency of use of the urinal is high is larger than a reduction in the amount of the chemical liquid ejected from the chemical liquid ejection unit to the bowl portion when a transition is made from a state where the frequency of use of the urinal is low to a state where the frequency of use of the urinal is high.

2. The urinal with a sanitation device according to claim 1, wherein when a transition is made from a state where the frequency of use of the urinal is low to a state where the frequency of use of the urinal is high, the control unit reduces the amount of the liquid agent flowing from the liquid agent ejection unit into the trap unit without reducing the amount of the chemical liquid ejected from the chemical liquid ejection unit to the bowl portion.

3. The urinal with a sanitation device according to claim 1, wherein the chemical liquid ejection unit is arranged so as to be capable of ejecting supplementary water for supplementing the water seal in the trap unit, and wherein the control unit increases the amount of the supplementary water to be ejected when the frequency of use of the urinal is low relative to the amount of the supplementary water to be ejected when the frequency of use of the urinal is high.

4. The urinal with a sanitation device according to claim 1, wherein the chemical liquid ejection unit is arranged so as to be capable of ejecting the chemical liquid to the drain tube, and wherein the control unit reduces the amount of the chemical liquid to be ejected to the drain tube when the frequency of use of the urinal is high relative to the amount of the chemical liquid to be ejected to the drain tube when the frequency of use of the urinal is low.

5. The urinal with a sanitation device according to claim 1, further comprising a substitute water ejection unit for ejecting substitute water for replacing urine retained in the trap unit, wherein the control unit executes replacement discharge control for controlling the substitute water ejection unit so that the substitute water is ejected to replace urine retained in the trap unit when the frequency of use of the urinal becomes equal to or lower than a predetermined frequency, and reduces the amount of the liquid agent flowing into the trap unit after the execution of the replacement discharge control relative to the amount of the liquid agent before the execution of the replacement discharge control.

6. A urinal with a sanitation device that includes a trap unit having a liquid seal formed by urine, the entire trap unit being interchangeable, the urinal comprising:

a bowl portion including a standing wall portion facing a user and a bottom surface portion that guides urine received by the standing wall portion to a drain hole;

a trap unit that retains urine flowing in from the bowl portion to form a liquid seal, and that communicates with a drain tube, the trap unit containing a first chemical agent dissolved by contact with the urine;

a liquid agent ejection unit for ejecting a liquid agent to the trap unit for dissolving the first chemical agent within the trap unit;

an use state detection unit for detecting the state of use of the urinal; and a control unit for controlling the liquid agent ejection unit on the basis of the detecting result of the use state detection unit, wherein the control unit controls the liquid agent ejection unit so that the total amount of the liquid agent flowing into the trap unit in a prescribed period is smaller when the frequency of use of the urinal is high during the prescribed period than when the frequency of use of the urinal is low during the prescribed period, wherein the control unit is arranged so as to be capable of executing by predetermined timing:

a bowl portion ejection mode of ejecting the liquid agent containing a second chemical agent to the bowl portion;

a chemical agent supply ejection mode of ejecting the liquid agent so that the second chemical agent is supplied to the trap unit; and a replacement ejection mode of ejecting an amount of the liquid agent larger than the amount of the liquid agent ejected in the chemical agent supply ejection mode to replace urine retained in the trap unit with the liquid agent, wherein the control unit executes the chemical agent supply ejection mode when the frequency of use of the urinal is lower than a predetermined first frequency, and executes the replacement ejection mode when the frequency of use of the urinal is lower than a predetermined second frequency, and wherein the predetermined second frequency is lower than the predetermined first frequency.

7. The urinal with a sanitation device according to claim 6, wherein the control unit executes the chemical agent supply ejection mode when the lapse of time from the preceding use of the urinal exceeds a predetermined first time period, and executes the replacement ejection mode when the lapse of time from the preceding use of the urinal exceeds a predetermined second time period, and the predetermined second time period is longer than the predetermined first time period.

8. The urinal with a sanitation device according to claim 7, wherein the control unit sets the amount of the liquid agent to be ejected to be smaller than the capacity of the trap unit by executing the replacement ejection mode one time.

9. The urinal with a sanitation device according to claim 7, wherein the control unit delays the time at which the chemical agent supply ejection mode is to be next executed by setting the predetermined first time period to be longer after the execution of the replacement ejection mode.

* * * * *